US005700002A

United States Patent [19]

Kato et al.

[11] Patent Number: 5,700,002

[45] Date of Patent: Dec. 23, 1997

[54] SHEET-BUNDLE PROCESSING APPARATUS IN WHICH SHEETS ARE ALIGNED USING VARIABLE PRESSING FORCE

[75] Inventors: Katsuhito Kato, Kawasaki; Seiichiro Adachi, Yokohama, both of Japan

[73] Assignee: Canon Kabushiki Kaisha, Tokyo, Japan

[21] Appl. No.: 550,784

[22] Filed: Oct. 31, 1995

[30] Foreign Application Priority Data

Nov. 11, 1994 [JP] Japan ..... 6-277303

[51] Int. Cl.[6] ..... B65H 39/02

[52] U.S. Cl. ..... 270/58.12; 270/58.13; 270/58.16; 270/58.17; 270/58.27

[58] Field of Search ..... 270/58.08, 58.09, 270/58.11, 58.12, 58.13, 58.16, 58.17, 58.27

[56] References Cited

U.S. PATENT DOCUMENTS 4,855,790 8/1989 Suzuki .

4,898,372 2/1990 Hirabayashi et al. ..... 270/58.12

5,092,509 3/1992 Naito et al. ..... 270/58.16 X 5,288,062 2/1994 Rizzolo et al. ..... 270/58.12

*Primary Examiner*—Hoang Nguyen

*Attorney, Agent, or Firm*—Fitzpatrick, Cella, Harper & Scinto

[57] ABSTRACT

A sheet processing apparatus has at least one sheet receiving tray for accommodating sheets; a sheet discharge device for discharging the sheets onto the sheet receiving tray; an aligning device that presses end surfaces of the sheets accommodated in the sheet receiving tray to align the sheets; and a processing device for binding the sheets accommodated in the sheet receiving tray, wherein the pressing force in the widthwise direction of the sheets exerted by the aligning device is changed in accordance with the change in mode of the process when the processing device performs the process.

40 Claims, 68 Drawing Sheets

FIG. 10

| TYPE OF BINDING | SIZE | MULTIGUIDE 156 | SWINGING GUIDE 55b |
|---|---|---|---|
| ONE FRONT PORTION IS BOUND | A4 B5 LTR | 1 | 3 |
| | A3 B4 A4R LGL LDL | 5 | 3 |
| ONE REAR PORTION IS BOUND | A4R | 3 | 2 |
| | LGL LTRR | 4 | 4 |
| TWO PORTIONS ARE BOUND | A4 | 1 | 3 |
| | B5 | 1 | 1 |
| | LTR | 1 | 2 |
| | A3 | 5 | 3 |
| | B4 | 2 | 1 |
| | LDR | 3 | 2 |

| |
|---|
| FIG. 34A |
| FIG. 34B |

| FIG. 35A |
| --- |
| FIG. 35B |

SHEET-BUNDLE PROCESSING APPARATUS IN WHICH SHEETS ARE ALIGNED USING VARIABLE PRESSING FORCE

BACKGROUND OF THE INVENTION

1. Field of the Invention

The present invention relates to a sheet-bundle processing apparatus, and, more particularly, to a sheet-bundle processing apparatus having a function of aligning sheets, such as copying paper, that are discharged from an image processing apparatus, such as a copying machine, a printing machine or a laser beam printer, to receiving trays (hereinafter called "bin trays") after images have been formed on the sheets and then the sheets have been classified and accommodated.

2. Related Background Art

Hitherto, some image forming apparatuses, such as copying machines, printing machines and laser beam printers, comprise sheet processing apparatuses for, for example, binding sheets after images have been formed on the sheets. Among the sheet processing apparatuses, a sorter having a stapling function has a structure such that, if a sorting mode has been selected, sheets are moved to a reference position by an aligning rod whenever the sheets are discharged and stacked on each bin tray, the ends of the sheets are again pushed to the reference position by the aligning rod so as to be aligned before a stapling operation is performed by a stapler, and then the stapler is moved to a predetermined position to bind the sheets.

Since, in the foregoing conventional technique requires pushing the sheet ends to the reference position by the aligning rod before the stapling operation is performed, no problem arises when one front portion is bound (the binding position: $H_1$) or two front portions are bound (the binding position: $H_2$). However, when the one inner portion or two inner portions are bound (the binding position: $H_3$), as shown in FIG. 64, pushing the sheets with an aligning rod 501 causes sheet bundle S opposing the reference guide 502 to be deflected. As a result, the stacked sheets are disordered and, thus, the binding position may be dislocated undesirably. That is, a convex portion 800 formed due to the deflection of the sheets S is improperly stapled, as shown in FIG. 65. Moreover, pushing with the aligning rod 501 may cause the sheets S to become skewed with respect to line $B_K$ of the bin. As a result, the staple is not parallel to the end line of the sheets, and thus the same is stapled diagonally. If the quantity of dislocation lx of the sheets S shown in FIG. 44 is excessively large, stapling sometimes cannot be performed.

If the number of sheets stacked on the bin tray B is small, for example, 10 or less, the sheets S easily deflect when the aligning rod 501 pushes the sheets S in a case where one front portion is stapled ($H_1$) or two front portions are stapled ($H_2$). Therefore, the stacked sheets S will be disordered and the binding position can easily be dislocated.

SUMMARY OF THE INVENTION

An object of the present invention is to provide a sheet-bundle processing apparatus capable of overcoming the foregoing problems and preventing disorder in the position, at which a processing means performs a process such as a binding process, due to an aligning operation that is performed prior to performing an operation such as binding.

In order to achieve the foregoing object, according to one aspect of the present invention, there is provided a sheet processing apparatus including: at least one sheet receiving tray for accommodating sheets; a sheet discharge device for discharging the sheets onto the sheet receiving tray; an aligning device that presses end surfaces of the sheets accommodated in the sheet receiving tray to align the sheets; and a processing device for binding the sheets accommodated in the sheet receiving tray, wherein the pressing force in the widthwise direction of the sheets using the aligning device is changed in accordance with the change in the mode of the process when the processing device performs the process.

According to another aspect of the present invention, the pressing force exerted on the ends of the sheet by the aligning device changes in accordance with the number of stacked sheets.

The foregoing apparatus is arranged so that the pressing force exerted on the ends of sheets by the aligning device in a case where one or two inner portions are bound is less than the pressing force exerted by the aligning device where one or two front portions are bound. Moreover, no pressing is performed where one or two inner portions are bound.

If the number of sheets to be stacked is small, for example, 10 or fewer sheets, the ends of sheets are not pressed by the aligning device; or the pressing force is reduced.

According to the present invention, the pressing force exerted by the aligning device to press changes in accordance with the stapling mode of the stapler, or with the number of sheets to be stacked. Thus, the stapling position is not disordered by the aligning operation prior to performing the stapling operation. Therefore, stapling can be accurately performed in accordance with the mode of the stapling operation. Thus, the subsequent processing function can be used effectively.

Further specific aspects of the invention are described below with reference to apparatuses embodying these features. According to another aspect of the present invention, a sheet processing apparatus includes at least one sheet receiving tray for accommodating one or more sheets, a sheet discharge device for discharging the sheets onto one of the sheet receiving trays to form a sheet bundle, an aligning device for pressing the end surfaces of the sheets accommodated in a sheet receiving tray to align the sheets, and a processing device for binding the sheets held in the sheet receiving tray. The pressing force in the widthwise direction of the sheets exerted by the aligning device is changed in accordance with a change in the number of sheet bundles accommodated on the sheet receiving tray when the processing device performs binding.

According to another aspect of the present invention, a sheet processing apparatus includes at least one sheet receiving tray for accommodating one or more sheets, a sheet discharge device for discharging the sheets onto a sheet receiving tray to form a sheet bundle, an aligning device for pressing the end surfaces of the sheets held in the sheet receiving tray to align the sheets, and a processing device for binding the sheets in the sheet receiving tray. The aligning device has a first mode for aligning each sheet after the sheet is discharged, and a second mode for aligning the sheet bundle when the sheet bundles is bound. A pressing force exerted in the widthwise direction of the sheets by the aligning device in the second mode, is less than the pressing force exerted in the first mode.

According to yet another aspect of the present invention, a sheet processing apparatus includes at least one sheet receiving tray for accommodating one or more sheets, a sheet discharge device for discharging the sheets onto the sheet receiving tray to form a sheet bundle, an aligning device for pressing end surfaces of the sheets accommodated in the sheet receiving tray to align the sheets, and a processing device for binding the sheets held in the sheet receiving tray. The sheet processing apparatus also includes a controller for controlling the aligning device such that when a position at which binding is performed by the processing device is distant from a position at which alignment is performed by the aligning device, the aligning device presses the end surfaces of the sheets to align the sheets when the processing device performs binding. The controller also controls the aligning device such that when the position at which binding is performed by the processing device is near the position at which alignment is performed by the aligning device, the aligning device is located apart from the end surfaces of the sheets when the processing device performs binding.

According to another aspect of the present invention, a sheet processing apparatus includes at least one sheet receiving tray for accommodating one or more sheets, a sheet discharge device for discharging the sheets onto the sheet receiving tray to form a sheet bundle, an aligning device for pressing end surfaces of the sheets accommodated in the sheet receiving tray to align the sheets, and a processing device for binding the sheets accommodated in the sheet receiving tray. The sheet processing apparatus also includes a controller for controlling the aligning device such that when a number of sheet bundles is large, the aligning device presses the end surfaces of the sheets to align the sheets when the processing device performs binding, and when the number of sheet bundles is small the aligning device is located apart from the end surfaces of the sheets when the processing device performs binding.

According to a still further aspect of the present invention, a sheet processing apparatus includes at least one sheet receiving tray for accommodating sheets, a sheet discharge device for discharging the sheets onto each of at least one sheet receiving tray to form a sheet bundle, an aligning device for pressing the end surfaces of the sheets held in the tray to align the sheets, and a processing device for binding the sheets held in the sheet receiving tray. The aligning device operates in a first mode when the sheet is discharged and operates in a second mode when the sheet bundle is processed. The sheet processing apparatus also includes a controller for controlling the aligning device such that the aligning device presses the end surfaces of the sheets when the aligning means is in the first mode and the aligning device is located apart from the end surfaces of the sheets when the aligning device is in the second mode.

According to another aspect of the present invention, an image forming apparatus which includes a sheet processing apparatus, also includes an image forming device, at least one sheet receiving tray for accommodating sheets on which images have been formed, a sheet discharge device for discharging the sheets onto the sheet receiving tray, an aligning device for pressing end surfaces of the sheets accommodated in each of the at least one sheet receiving tray to align the sheets, and a processing device for binding the sheets held in the sheet receiving tray. The pressing force exerted in the widthwise direction of the sheets by the aligning device is changed in accordance with the change in the mode of the processing device performing binding.

According to a still further aspect of the present invention, an image forming apparatus having a sheet processing apparatus also includes an image forming device, at least one sheet receiving tray for accommodating sheets on which images have been formed, a sheet discharge device for discharging the sheets onto the sheet receiving tray, an aligning device for pressing end surfaces of the sheets accommodated in each receiving tray to align the sheets, and a processing device for binding the sheets accommodated in at least one sheet receiving tray. The pressing force exerted in the widthwise direction of the sheets by the aligning means is changed in accordance with a change in the number of sheet bundles when the processing means performs binding.

According to a still further aspect of the present invention, an image forming apparatus including a sheet processing apparatus, also has an image forming device, at least one sheet receiving tray, a sheet discharge device for discharging the sheets onto the sheet receiving tray forming sheet bundles, an aligning device for pressing the end surfaces of sheets accommodated in each of the at least one sheet receiving tray to align the sheets, and a processing device for binding the sheets held in the sheet receiving tray. The aligning device operates in a first mode when the sheet is discharged and operates in a second mode when the sheet bundle is bound. The pressing force exerted in the widthwise direction of the sheets by the aligning device in the second mode is less than the pressing force in the first mode.

According to a still further aspect of the present invention, an image forming apparatus includes an image forming device, at least one sheet receiving tray, a sheet discharge device, an aligning device for pressing the end surfaces of the sheets held in the sheet receiving tray to align the sheets, a processing device for binding the sheets held in the sheet receiving tray, and a controller. The controller controls the aligning device such that when a position at which binding is performed by the processing device is distant from a position at which alignment is performed by the aligning device, the aligning device presses the end surfaces of the sheets to align the sheets when the processing device performs binding. When the position at which binding is performed is near the position at which alignment is performed, the aligning device is located apart form the end surfaces of the sheet when the processing device performs binding.

According to a still further aspect of the present invention, an image forming apparatus includes an image forming device, at least one sheet receiving tray, a sheet discharge device for discharging the sheets onto the sheet receiving tray to form sheet bundles, an aligning device for pressing end surfaces of the sheets accommodated in the sheet receiving tray to align the sheets, a processing device for binding the sheets accommodated in the sheet receiving tray, and a controller for controlling the aligning device. When a number of sheet bundles is large, the aligning device presses the end surfaces of the sheets to align the sheets when the processing means performs binding. When the number of sheet bundles is small, the aligning device is located apart from the end surfaces of the sheets when the processing device performs binding.

According to yet another aspect of the present invention, an image forming apparatus includes an image forming device, at least one sheet receiving tray, a sheet discharge device, and an aligning device for pressing end surfaces of the sheets accommodated in the sheet receiving tray to align sheets. The image forming apparatus also includes a processing device for binding the sheets accommodated in the sheet receiving tray. The aligning device operates in a first mode when the sheet is discharged and operates in a second mode when the sheet bundle is bound. The image forming apparatus also includes a controller for controlling the aligning device such that the aligning device presses the end surfaces of the sheets to align the sheets when the aligning device is in the first mode when the processing device performs binding, and the aligning device is located apart from the end surfaces of the sheets when the aligning device is in the second mode when the processing device performs binding.

Other objects, features and advantages of the invention will be evident from the following detailed description of the preferred embodiments described in conjunction with the attached drawings.

BRIEF DESCRIPTION OF THE DRAWINGS

FIG. 9 (*b*) is a diagram illustrating alignment reference position;

FIG. 10 is a diagram showing the operation relationship among the reference guide, the aligning rod and the multiguide;

DESCRIPTION OF THE PREFERRED EMBODIMENTS

An embodiment of a sheet processing apparatus according to the present invention will now be described with reference to the drawings.

Figure 1:
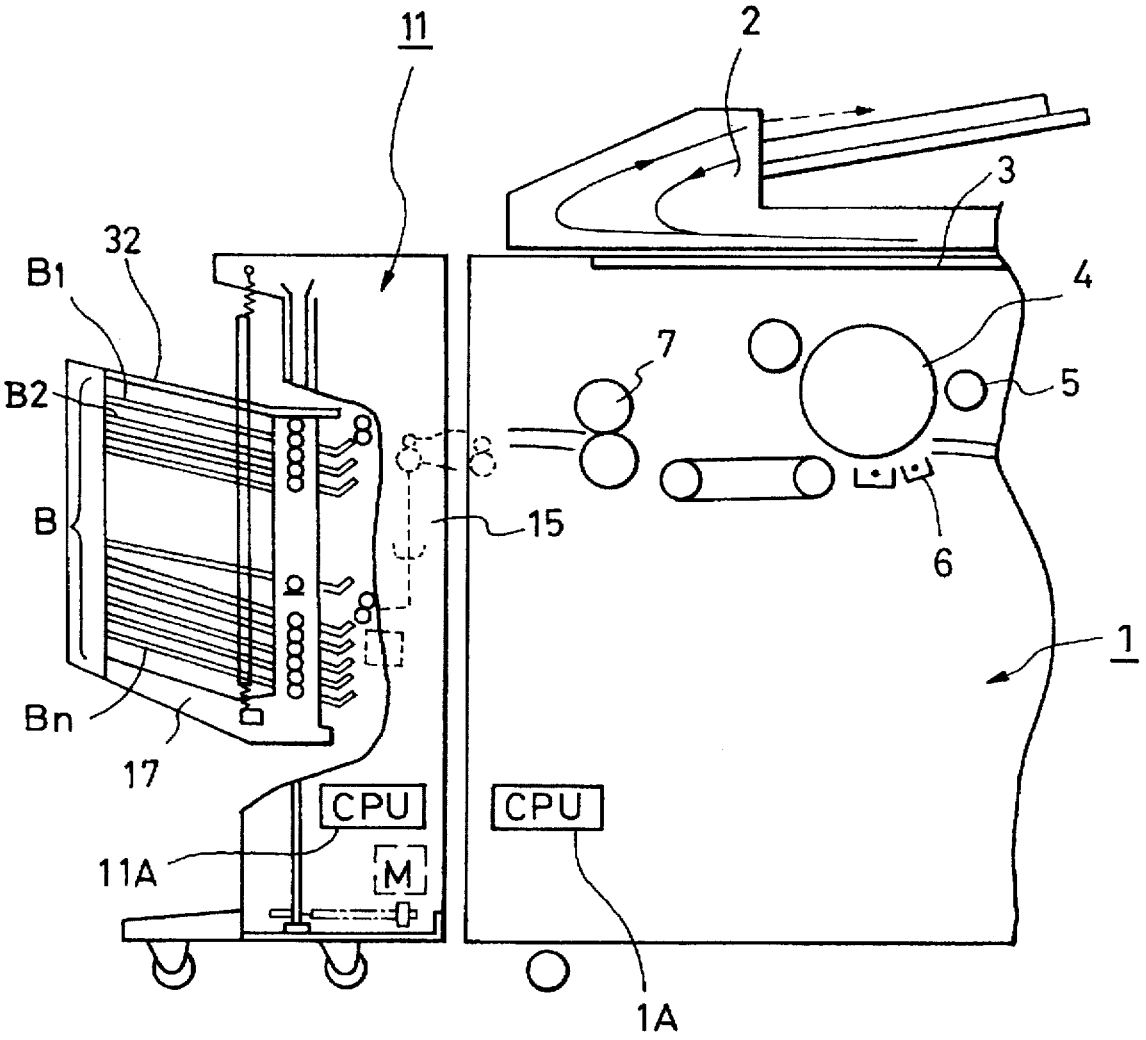
FIG. 1 is a vertical side cross sectional view showing a sheet processing apparatus and an image processing apparatus comprising the sheet processing apparatus according to the present invention.

The sheet processing apparatus according to the present invention will now be described with reference to the drawings. FIG. 1 is a schematic view showing the structure of a sheet processing apparatus according to the present invention. In this embodiment, a sheet processing apparatus provided for an image processing apparatus, such as a copying machine, will now be described.

As shown in FIG. 1, the image processing apparatus 1 has a top surface, on which an automatic original-document feeding apparatus 2 for automatically moving the original document is disposed. In the downstream (in the left portion of FIG. 1) of the image processing apparatus 1, a sheet processing apparatus (hereinafter called a "sorter") 11 having n bin trays B (B1, B2, . . . , Bn) is attached.

The image processing apparatus 1 is adapted to a known electrophotographic method, the detailed description of which is omitted here and in which the image of an original document located on a platen glass 3 is, by an optical system (not shown), formed on a photosensitive drum 4; and the image is transferred onto the sheet by a developing unit 5, a transferring electrode 6 and the like; and a fixing unit 7 permanently fixes the image on to the sheet.

Overall Structure of Sheet Processing Apparatus

Figure 2:
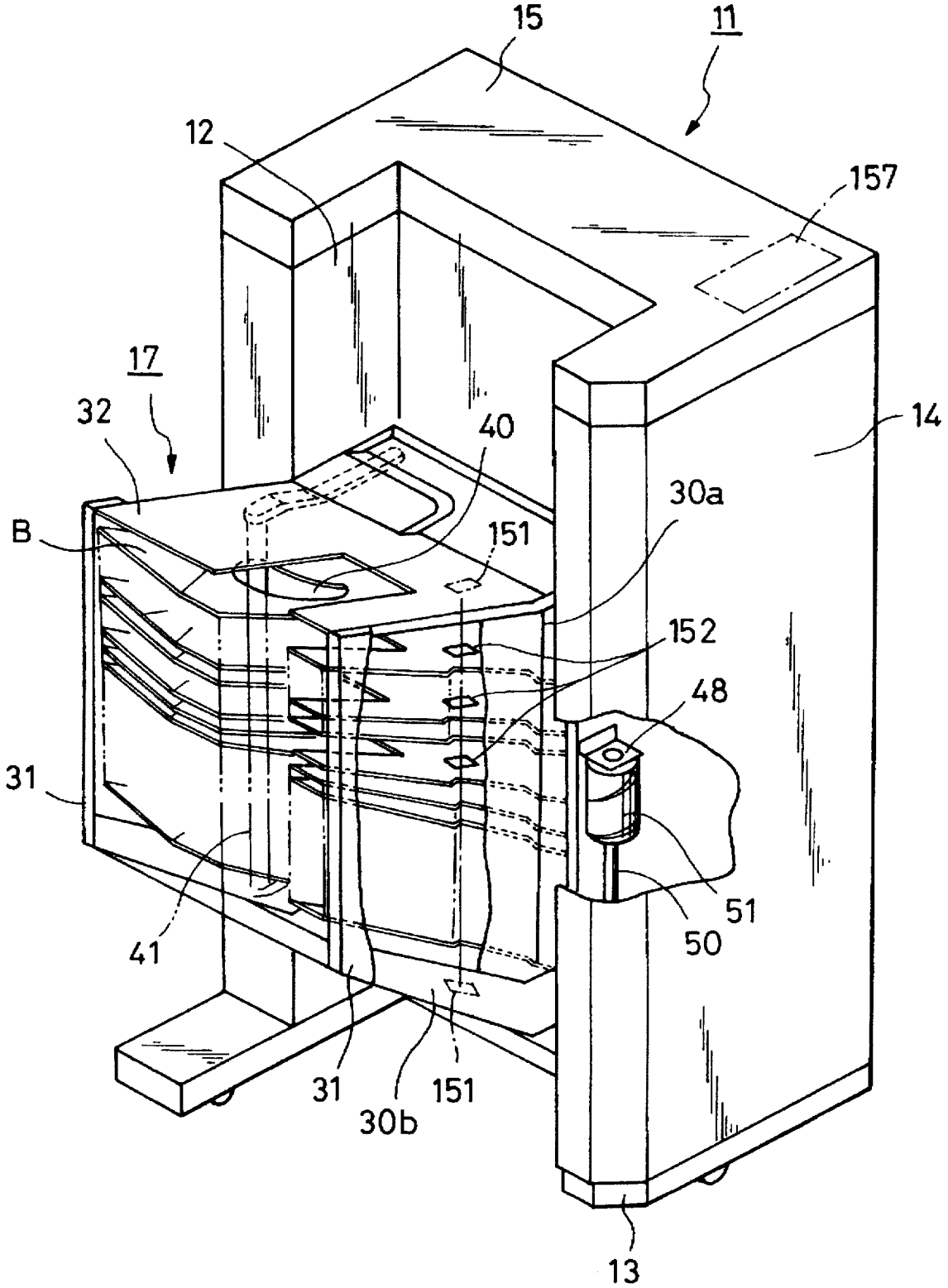
FIG. 2 is a partially-broken perspective view showing the sheet processing apparatus.
Figure 3:
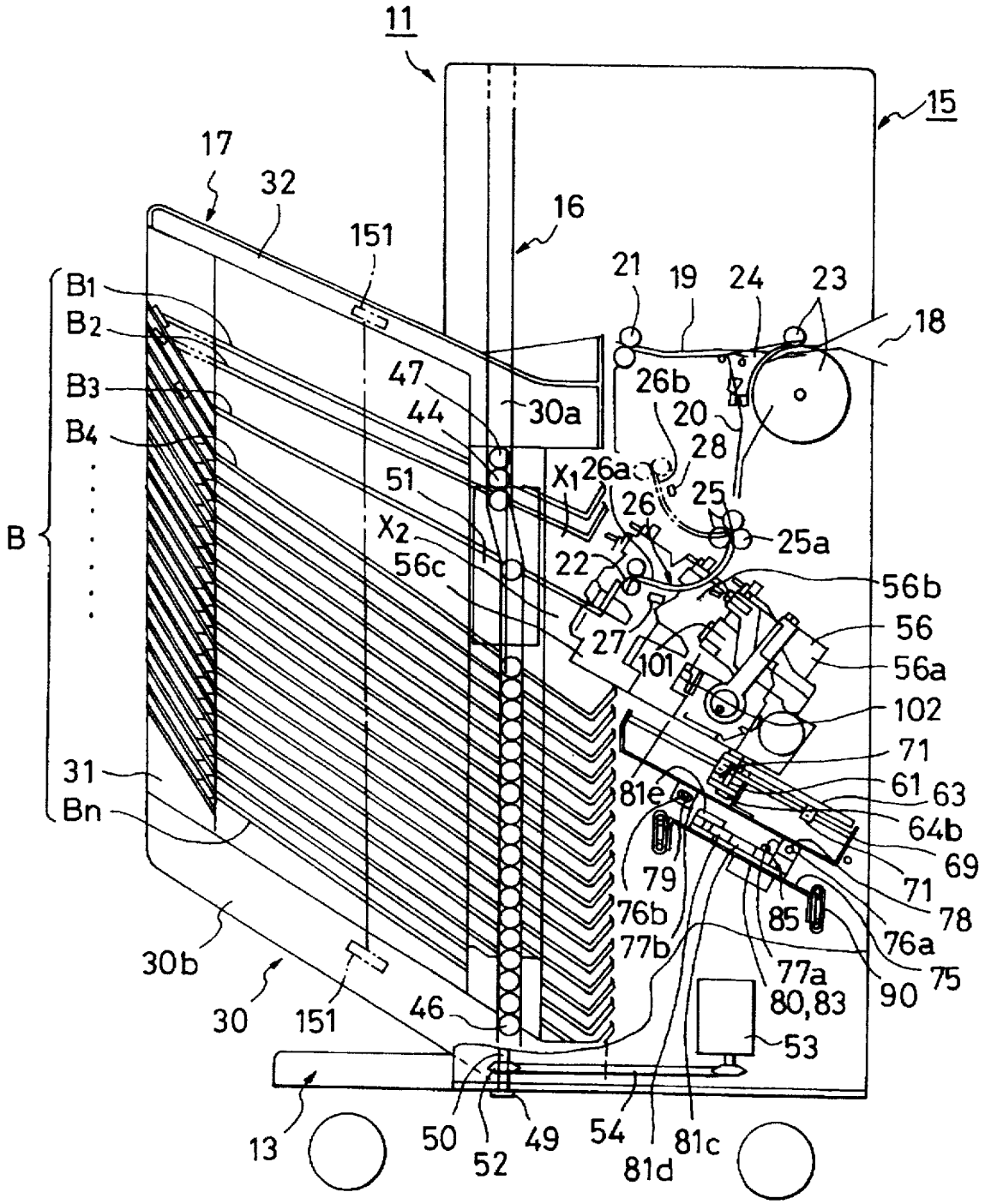
FIG. 3 is a vertical side cross sectional view showing the sheet processing apparatus.

The sorter 11, as shown in FIGS. 2 and 3, has a sorter body 15 including a pair of side plates 12, a base 13 and a cover 14, and further comprising a bin unit 17 accommodating a multiplicity of bins B and enabled to be moved vertically along guide rails 16 respectively attached to the sorter body 15.

The sorter body 15 has an introduction port 18 through which sheets S are introduced. A first sheet conveyance passage 19 is formed from the introduction port 18 toward the upper bin unit 17, while a second sheet conveyance passage 20 is branched from the first sheet conveyance passage 19. An upper discharge roller pair 21 for discharging non-sort sheets (sheets not to be classified) is disposed downstream from the first sheet conveyance passage 19. A lower discharge roller pair 22 for discharging sort sheets (sheets to be classified) is disposed downstream from the second sheet conveyance passage 20.

Shape of Discharge Roller

Figure 4:
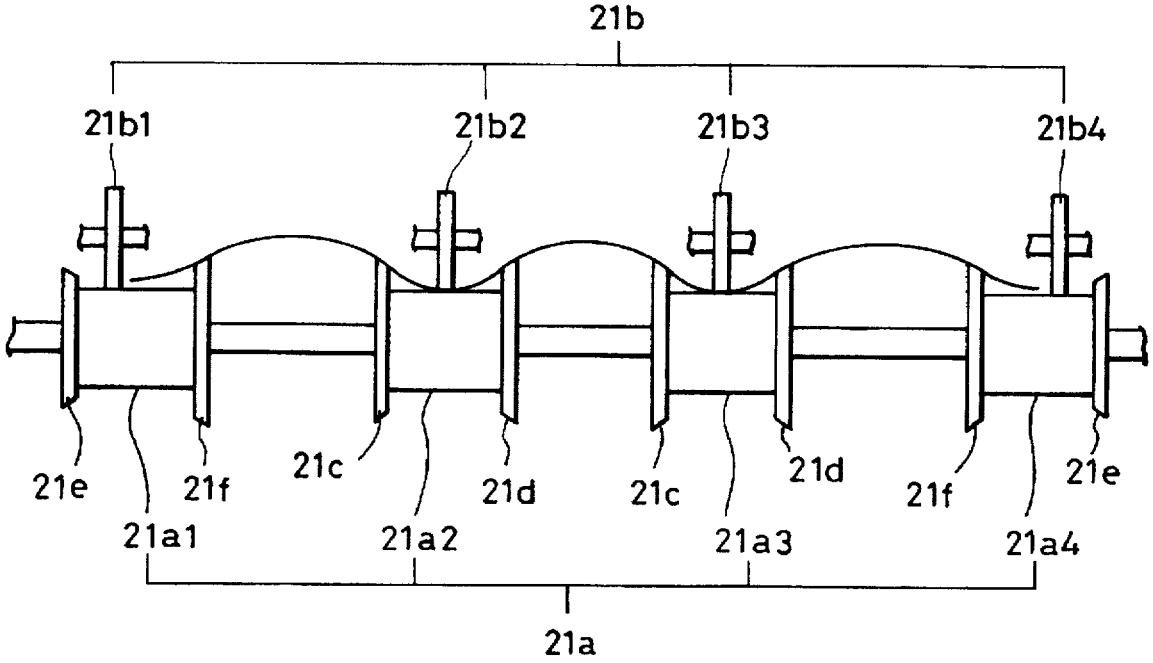
FIG. 4 is an explanatory view of a lower discharge roller pair of the sheet processing apparatus.

The upper discharge roller pair 21, as shown in FIG. 4, has a driving discharge roller 21*a* and a follower discharge roller 21*b* that presses the discharge roller 21*a*. The discharge roller 21*a* has four cylindrical rollers 21*a*1 through 21*a*4 disposed in the axial direction thereof. A pair of ribs 21*c* and 21*d*, or 21*e* and 21*f* are formed on the two end surfaces of each discharge roller 21*a*1 through 21*a*4.

The discharge roller 21*a* is so disposed that the sheet always comes in contact with the ribs 21*c* and 21*d* or 21*e* and 21*f* when the discharge roller 21*a* and the discharge roller 21*b* hold the sheet. The reason for this is that, when the sheet S is made to be rigid, a state where the sheet S comes in contact with only the internal rib 21*c* or 21*f* of the discharge roller 21*a* in the axial direction will cause the end of the sheet S to be gradually moved inwards, and thus the end of the sheet S is separated from the discharge roller 21*b*.

The discharge roller 21*b*, including rollers 21*b*1 through 21*b*4, presses each discharge roller 21*a*1 through 21*a*4 in such a manner that the discharge rollers 21*a*2 and 21*a*3 disposed in the central portion in the axial direction are pressed at their central portions; and the discharge rollers 21*a*1 and 21*a*4 disposed in the end portions in the axial direction are pressed at their positions dislocated outwards by about 3 mm from their central portions. The reason for this is that a gap must be maintained between the end of a sheet, which does not simultaneously come in contact with the two end rib portions of the discharge roller, and the nip between the discharge roller 21*a* and the discharge roller 21*b*. If a certain gap is not maintained between the end of the sheet and the nip, the end of the sheet and the discharge roller 21*b* interfere with each other in a case where the sheet S moves in a diagonal direction or the same is moved while being dislocated in the axial direction of the roller, thus damaging the sheet S or destabilizing the movement of the sheet S.

The right and left ribs 21c and 21d of the discharge rollers 21a2 and 21a3 disposed in the central portions have the same height, while the ribs 21e and 21f of the discharge rollers 21a1 and 21a4 disposed in the two end portions in the axial direction are formed such that the outer rib 21e is shorter than the internal rib 21f. Specifically, the ribs 21c and 21d have a height of about 2 mm, the rib 21f has a height of about 2.5 mm, and the rib 21e has a height of about 1.5 mm. The inner rib 21f is made taller than the outer rib 21e, and the ribs 21c and 21d to make the degree of rigidity of the sheet S uniform in the axial direction, at a degree similar to the central portion even if the position at which the discharge roller 21b presses the discharge roller 21a, is dislocated. If the rigidity of the sheet S is too strong, a trace is sometimes formed on the sheet S. If the rigidity is too weak, the sheet S cannot stably be discharged. Therefore, it is preferable that the state of the rigidity be uniform.

The discharge roller 21a may be made of ABS resin, hard rubber or the like, while the discharge roller 21b may be made of polyacetal resin or the like. Although four discharge rollers 21a and discharge rollers 21b are disposed in the axial direction, the number is not limited to this, and the number may be increased or decreased.

As a result of the foregoing structure, when the sheet S is discharged while being held by the upper discharge roller pair 21, the ribs 21c, 21d, 21e and 21f, which are formed on the discharge rollers 21a1 through 21a4, make the sheet S rigid in the discharge direction. To maintain a gap from the end of the sheet S, the heights of the ribs 21f and 21e formed on the discharge rollers 21a1 and 21a4 are arranged such that the inner rib 21f is taller than the outer rib 21e so that the rigidity of the sheet S is uniform in an axial direction even if the discharge rollers 21b1 and 21b4 press the discharge rollers 21a1 and 21a4 at the outer position from the central position. Therefore, the sheets S can be stacked accurately.

Since the discharge roller 21b presses only the sheet S that is brought into contact with the two end ribs of the discharge rollers 21a1 and 21a4, undesirable movement of the two ends of the sheet S toward the central portion causing dislocation of the sheet S from the nip between the discharge roller 21a and the discharge roller 21b can be prevented. Thus, problems experienced with the conventional structure such that the end of the sheet cannot be held between the discharge roller 21a and the discharge roller 21b, or the end of the sheet comes in contact with the side surface of the discharge roller 21b thereby destabilizing the movement of the sheet depending upon the size of the sheet, thus causing the diagonal discharge to take place can be prevented. As a result, the discharge operation can be made stable.

At the branched portion between the sheet conveyance passages 19 and 20, there are disposed an introduction roller pair 23 and a deflector 24. When a non-sort mode (a mode in which sheets are not classified) is selected, the deflector 24 is displaced to introduce the sheet S into the first sheet conveyance passage (hereinafter called a "non-sort passage") 19. When a sort mode (a mode in which sheets are classified) is selected, the deflector 24 is displaced to introduce the sheet S into the second sheet conveyance passage (hereinafter called a "sort passage") 20.

The sort passage 20 has a relay roller pair 25 between the introduction roller pair 23 and the discharge roller pair 22, the relay roller pair 25 being disposed at a position that enables conveyance of the minimum size sheet (the minimum size in the sheet feeding direction), that can be discharged from the main body of the apparatus.

The sort passage 20 has the leading portion (downstream from the relay roller pair 25) formed into a leading passage 26. The leading passage 26 can be rotated around a drive roller 25a of the relay roller pair 25.

Leading Passage

The leading passage 26 is located at an operating position 26a (the position indicated by a continuous line shown in FIG. 3) when the sheet S is conveyed in a usual manner. The lower portion of the leading passage 26 abuts against a pushing mechanism, to be described later, so as to be located. The position of the leading passage 26 can be detected by a detection means 27, such as a microswitch.

The leading passage 26 is pushed to a relief position 26b (a position indicated by an alternate long and two short dashes line shown in FIG. 3) by the pushing mechanism when the stapler, to be described later, is operated. A detection means 28, such as a microswitch, detects the leading passage 26 when positioned at the relief position.

Figure 5A:
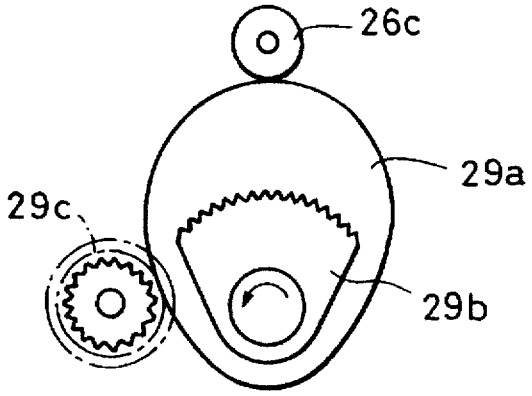
FIG. 5 is a schematic view showing the structure of an upward moving mechanism for swinging the leading passage of the sheet processing apparatus.
Figure 5B:
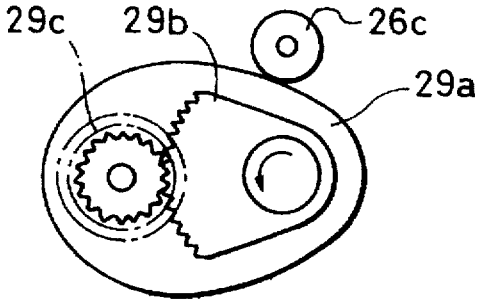
Figure 5C:
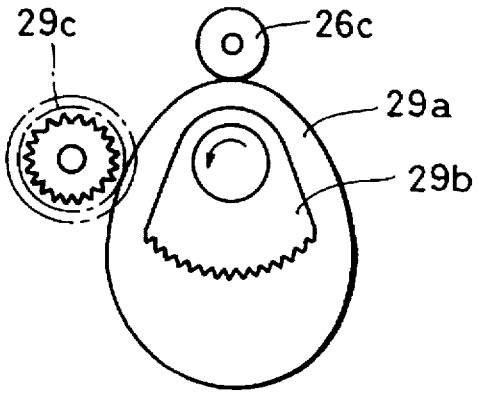

The pushing mechanism, as shown in FIG. 5, includes an eccentric cam 29a that is rotated by a rotational force transmitted from a drive motor of a sheet conveyance system (not shown) through a one-way clutch; and a rotary damper 29c that is engaged to a sector gear 29b integrally formed with the eccentric cam 29a to supply rotational load. The eccentric cam 29a is not rotated when the motor is rotated in the forward direction because the drive force is not transmitted through the one-way clutch (when the sheet S is conveyed). On the other hand, cam 29a is rotated when the motor is rotated in the reverse direction due to the action of the one-way clutch (when the conveyance of the sheet S is stopped).

Therefore, the rotation of the eccentric cam 29a, when the motor is rotated in the reverse direction, pushes a rotative roller 26c disposed in the lower portion of the leading passage 26 upwards to the relief position 26b (the position indicated by the alternate long and short dashed line shown in FIG. 3) (a state shown in FIG. 5 (*a*). When upward pushing by means of the eccentric cam 29a is suspended, the leading passage 26 tends to move downwards due to gravity. Since the sector gear 29b integrally formed with the eccentric cam 29a is engaged to the rotary damper 29c and thus the rotational load is applied to the eccentric cam 29a which is in contact with the rotative roller 26c (a state shown in FIG. 5 (*b*)), the leading passage 26 is slowly moved downward due to the rotational load of the rotary damper 29c so as to be rotated to the operating position 26a (the position indicated by the continuous line shown in FIG. 3) so that the leading passage 26 is located at the operating position (a state shown in FIG. 5 (*c*)).

Discharge Guide

Referring to FIGS. 48 (*a*), 48 (*b*), 48 (*c*) and 48 (*d*), a plurality of drive discharge rollers 22a and follower discharge rollers 22b forming the lower discharge roller pair 22 are disposed in the axial direction. Furthermore, discharge guides 170 (an upper discharge guide 170a and a lower discharge guide 170b) forming the sheet conveyance passage connected to the lower discharge roller pair 22 are disposed vertically. In the sort mode, the sheet S conveyed through the discharge guide 170 is, by the lower discharge roller pair 22, discharged and stacked on each bin tray B.

Among the discharge guides 170, in the portions of the lower discharge guide 170b corresponding to the end of the sheet (the two end positions of, for example, A4R-size sheet), there are formed guide portions 171 projecting upwards over the guide surface. The guide portions 171, as shown in FIG. 48 (*b*), project upwards to face the sheet discharge port so as to discharge the sheet S in such a manner that the end of the sheet S, which is discharged as indicated by an alternate long and two short dashed line, is raised. The amount the end of the sheet S is raised is selected to be somewhat larger than the usual quantity of warp of the ends of sheets S previously stacked on the bin tray B.

As a result, even if the end of the sheet S discharged to the bin tray B and aligned to the reference position is warped upwards, the end of the sheet S, to be discharged by the lower discharge roller pair 22, is raised upwards by the guide portion 171 when discharged. Therefore, the sheet S can be discharged without interference with the sheets already in bin tray B. Thus, undesirable movement of the upper most sheet among the sheets S stacked in the bin in the sheet discharge direction occurring due to the friction between the sheet being discharged, and the sheets S, which have been stacked in the bin, can be prevented. Therefore, the sheets S can be stacked accurately, and the subsequent processing operation can be performed smoothly. Since the sheet discharge direction is partially changed (into a direction g), and the overall sheet discharge direction (a direction h) is changed, the sheet S can be stacked stably.

The discharge guide 170 is made of a metal plate, such as a steel plate, while the guide portion 171 may be formed, as shown in FIGS. 48 (*c*) and 48 (*d*) by drawing, or in such a manner that a cut portion is formed in a portion of the lower discharge guide 170*b*, followed by being bent upwards. Although two guide portions 171 are formed in the lower discharge guide 170*b*, the number of the guide portions 171 may be increased to be adaptable to the size and the state of curl of the sheet S. In FIG. 48 (*c*), to enable the guide portion 171 to be brought into contact with only the left end curl portion (a portion i) of the stacked sheet bundle when the sheet S is discharged, the guide portion 171 may be formed only in one left portion 171*a* of the lower discharge guide 170*b*.

Bin Unit

As shown in FIGS. 2 and 3, the bin unit 17 has a pair of bin frames 30 which are disposed in the front portion and the inner portion and each of which consists of an erect portion 30*a* and a bottom portion 30*b*. A bin slider 31 is attached to the leading portion of the bottom portion 30*b* of the bin frame 30; and the erect portion 30*a* and the bin slider 31 of the bin frame 30 are respectively secured to the leading portion by a bin cover 32.

Penetration Sensor

As shown in FIG. 2, the bin unit 17 includes a penetration sensor 151 for detecting whether or not a sheet S exists on the bin tray in such a manner that the penetration sensor 151 vertically penetrates cut portions 152 of all bin trays formed in the same positions when viewed from a position above each bin tray, and it detects the closing/opening of the cut portion 152 by the sheet S so as to detect whether or not the sheet S exists. The penetration sensor 151 is disposed in the region corresponding to the minimum size of the sheet S that is discharged onto the bin tray as well as in an overlapped portion when the sheets S have been aligned and the same have been pushed forward for the purpose of taking the sheets S. Thus, the penetration sensor 151 is able to detect the sheet S regardless of the position of the sheet S on the bin tray.

Aligning Rod

Figure 50:
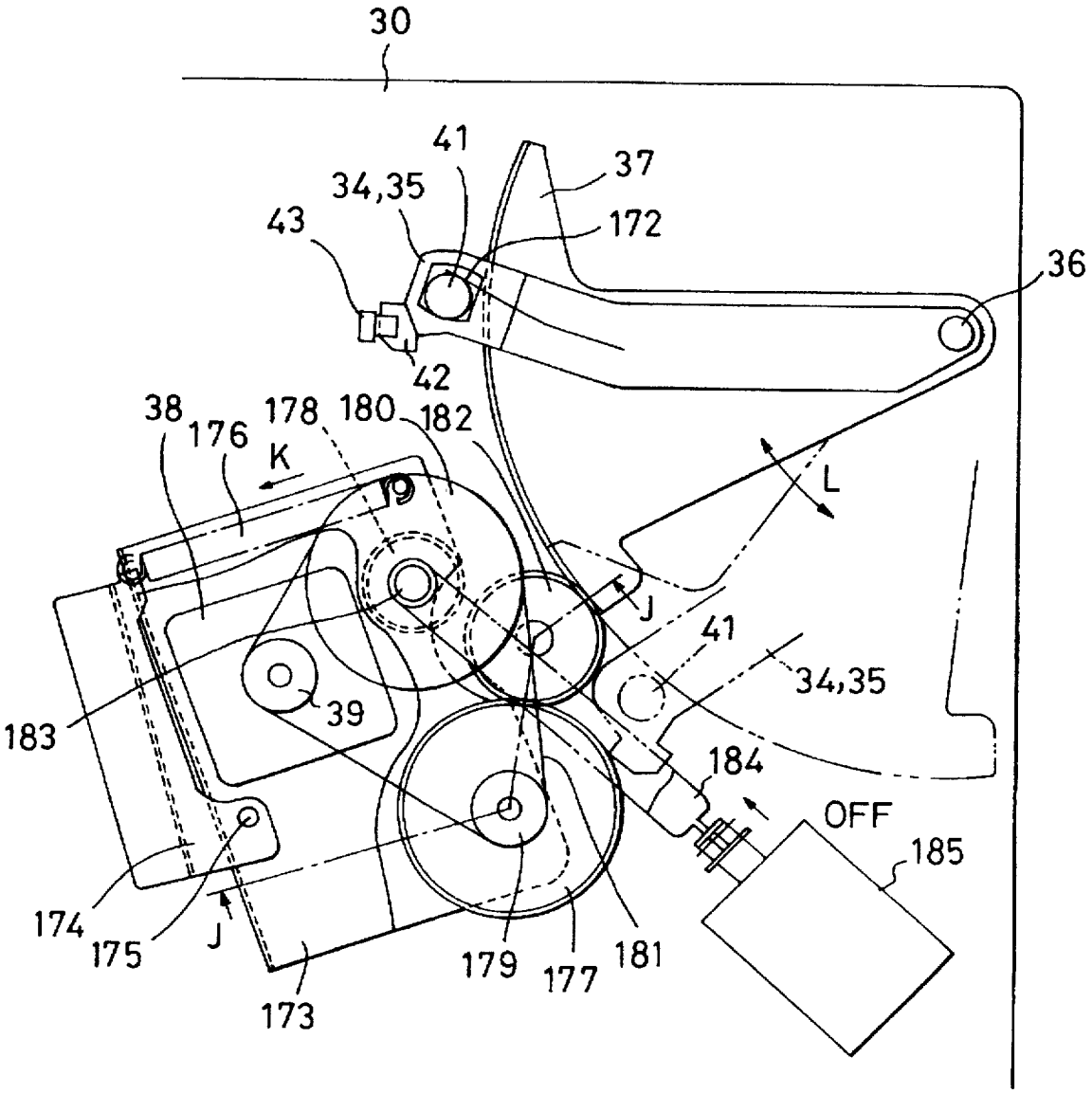
FIG. 50 is a top view showing the gear changing operation to be performed when the aligning operation is performed.
Figure 51A:
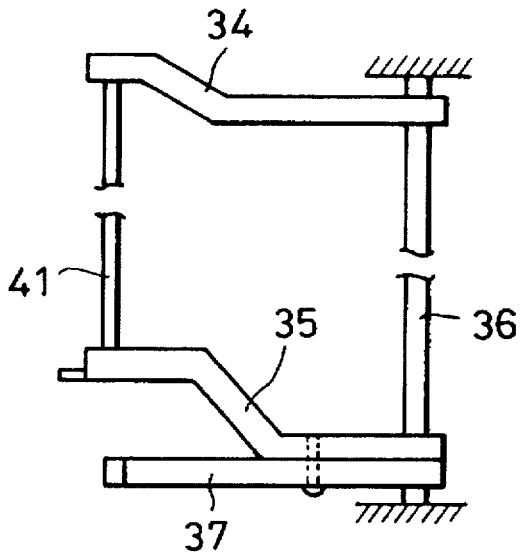
FIGS. 51 (*a*) and 51 (*b*) are cross sectional views taken along arrows J—J of FIG. 50.
Figure 51B:
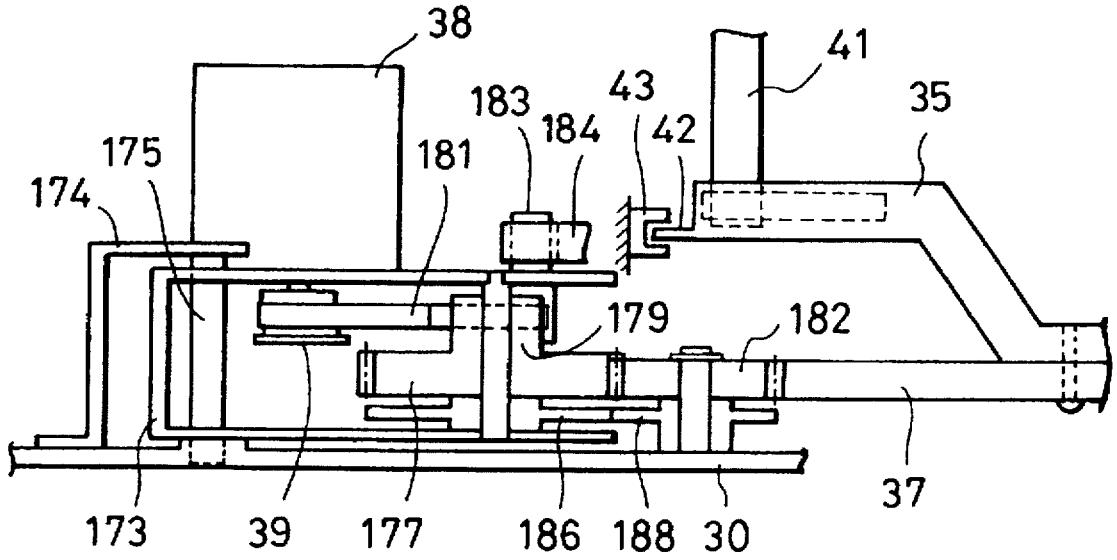
Figure 52:
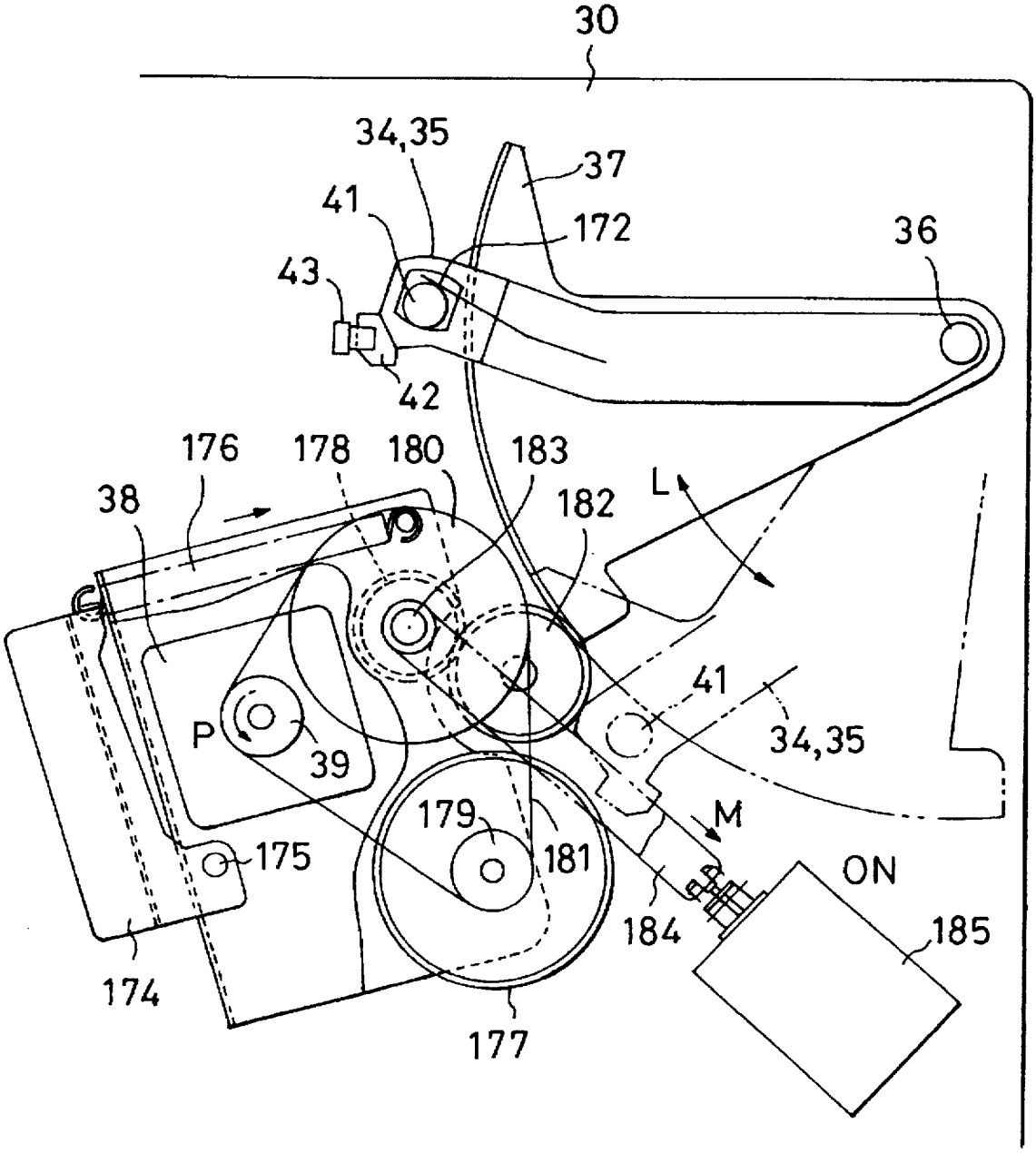
FIG. 52 is a top view showing the gear changing operation to be performed when the bundle is pushed.

Referring to FIGS. 50 through 52, in the inner portion of the base portion of the bin frame 30, there is rotatively supported a rotation central shaft 36 having the two vertical ends secured to the upper arm 34 and a lower arm 35, the rotation central shaft 36 being made rotative by a rotational shaft (not shown) provided for the bin frame 30 and a rotational shaft 32*a* provided for the bin cover 32. The bin frame 30 has a sector gear 37 that is made rotative around a rotational shaft provided for the bin frame 30. The lower arm 35 is secured to the sector gear 37. A pulse motor 38 is disposed on an alignment unit frame 173 at a position above the bin frame 30, as shown in FIG. 51 (*b*). The pulse motor 38 rotates the sector gear 37 through a gear train, to be described later. An aligning rod 41 penetrating all cut portions 40 formed in the bin trays B is disposed at the leading portion of the lower arm 35 and the leading portion of the upper arm 34. The aligning rod 41 (shown in FIG. 2 as well as FIGS. 51 (*a*), 51 (*b*) and 52) is so structured that it swings in the cut portion 40 when the sector gear 37 is rotated. Furthermore, the lower arm 35 has a light shield plate 42 so that rotation of the light shield plate 42 integrally with the lower arm 35 turns on or off a home position sensor 43 disposed in the inner portion of the bin frame 30.

Change in Speed of Aligning Rod between Alignment Mode and Bundle Pushing Mode

Referring to FIG. 51 (*b*) (FIG. 51 (*b*) is a cross section taken along line J—J shown in FIG. 50), the alignment unit frame 173 to which the pulse motor 38 is secured and which has a U-shape cross sectional shape facing side is rotatively supported around a support shaft 175 vertically supported by a support plate 174 and the bin frame 30. As shown in FIG. 50, the alignment unit frame 173 and the support plate 174 are connected to each other by a tension spring 176 so that the alignment unit frame 173 is urged in a direction indicated by an arrow K. On the alignment unit frame 173, there are rotatively supported an aligning gear 177 having a large diameter and a bundle-pushing gear 178 having a small diameter. The aligning gear 177 and the bundle-pushing gear 178 respectively have pulleys 179 and 180 formed integrally in the axial direction.

Referring to FIG. 50, the pulse motor 38 has an output shaft to which a pulley 39 is secured; and a timing belt 181 is arranged to the pulleys 39, 179 and 180 so that the rotation of the pulse motor 38 is transmitted to the aligning gear 177 and the bundle-pushing gear 178. The bin frame 30 has an idler gear 182 that is rotatively supported so that, when the alignment unit frame 173 is rotated, the aligning gear 177 or the bundle-pushing gear 178 is engaged to the idler gear 182. The idler gear 182 is engaged to the sector gear 37 so that the aligning rod 41 is moved in a direction indicated by an arrow L.

An end of a link 184 is connected to a rotation shaft 183 of the bundle-pushing gear 178 provided for the alignment unit frame 173, while another end of the same is connected to a solenoid 185. When the solenoid 185 is turned off, the alignment unit frame 173 is, as shown in FIG. 50, pulled in a direction indicated by an arrow K by a tension spring 176 so that the aligning gear 177 is engaged to the idler gear 182. In the foregoing state, the rotational speed of the pulse motor 38 is reduced to about ¼.

When the solenoid 185 is turned on, the alignment unit frame 173 is, as shown in FIG. 52, pulled in a direction indicated by an arrow M by the solenoid 185 against the tension spring 176 so that the bundle-pushing gear 178 is engaged to the idler gear 182. In the foregoing state, the rotational speed of the pulse motor 38 is decreased to about 1/30.

When the aligning gear 177, the bundle-pushing gear 178 and the idler gear 182 are changed, and when the solenoid 185 is turned on or off, the rotation of pulse motor 38 is controlled such that it is rotated forward or backward by a somewhat angular degree to prevent defective engagement due to the contact between the gear addendums in the engaged portion. Thus, the engaged gears are slightly rotated forward or backward so that the engagement is made reliable.

As shown in FIG. 51 (*b*), the rotational shafts of the aligning gear 177, the bundle-pushing gear 178 and the idler gear 182 respectively have abutment rollers 186, 187 (not shown) and 188 attached thereto in order to maintain the gear backlash of the aligning gear 177, the bundle-pushing gear 178 and the idler gear 182.

After the sheets S have been discharged to each bin tray, no large pushing force is required to move the aligning rod 41 to align the sheets S to the reference position. Furthermore, the aligning rod 41 must be moved at high speed to complete alignment and relieving of the sheets S in a short time during the discharge of the sheets S. Accordingly, the pulse motor 38 is rotated forwards and reversely in a state where the solenoid 185 is turned off and the aligning gear 177 having a large diameter is engaged to the idler gear 182. Thus, the rotational force is transmitted so that the sector gear 37 is operated to cause the aligning rod 41 to quickly perform the operation for aligning the sheets S with a small pushing force.

When the aligning rod 41 pushes the bundle to take the sheet bundle on each bin toward an operator after the sheet bundle discharged and aligned on each bin tray has been stapled, a large pushing force is required to move the aligning rod 41. To stably move the sheet bundle, it is preferable that the sheet bundle be pushed at relatively low speed. Accordingly, the solenoid 185 is, as shown in FIG. 52, turned on to rotate the pulse motor 38 in a direction indicated by an arrow P in a state where the bundle-pushing gear 178 having a small diameter is engaged to the idler gear 182 to operate the sector gear 37. Thus, the aligning rod 41, at low speed, pushes the bundle of the sheets S with a large pushing force.

As a result of the foregoing structure, the speed of the aligning rod 41 is changed between the operation for aligning the sheets S and the operation of pushing the bundle so that the pulse motor 38 is prevented from being overloaded. Therefore, the alignment and bundle pushing operations can be performed reliably. By slightly rotating the pulse motor 38 forward and backward when the aligning gear 177 and the bundle-pushing gear 178 are switched to be engaged to the idler gear 182, gear change can be performed smoothly. Although the speed of the aligning rod is, in this embodiment, changed by the gears, the speed may, of course, be changed by a pulse motor or a DC motor.

Reference Guide

Figure 9A:
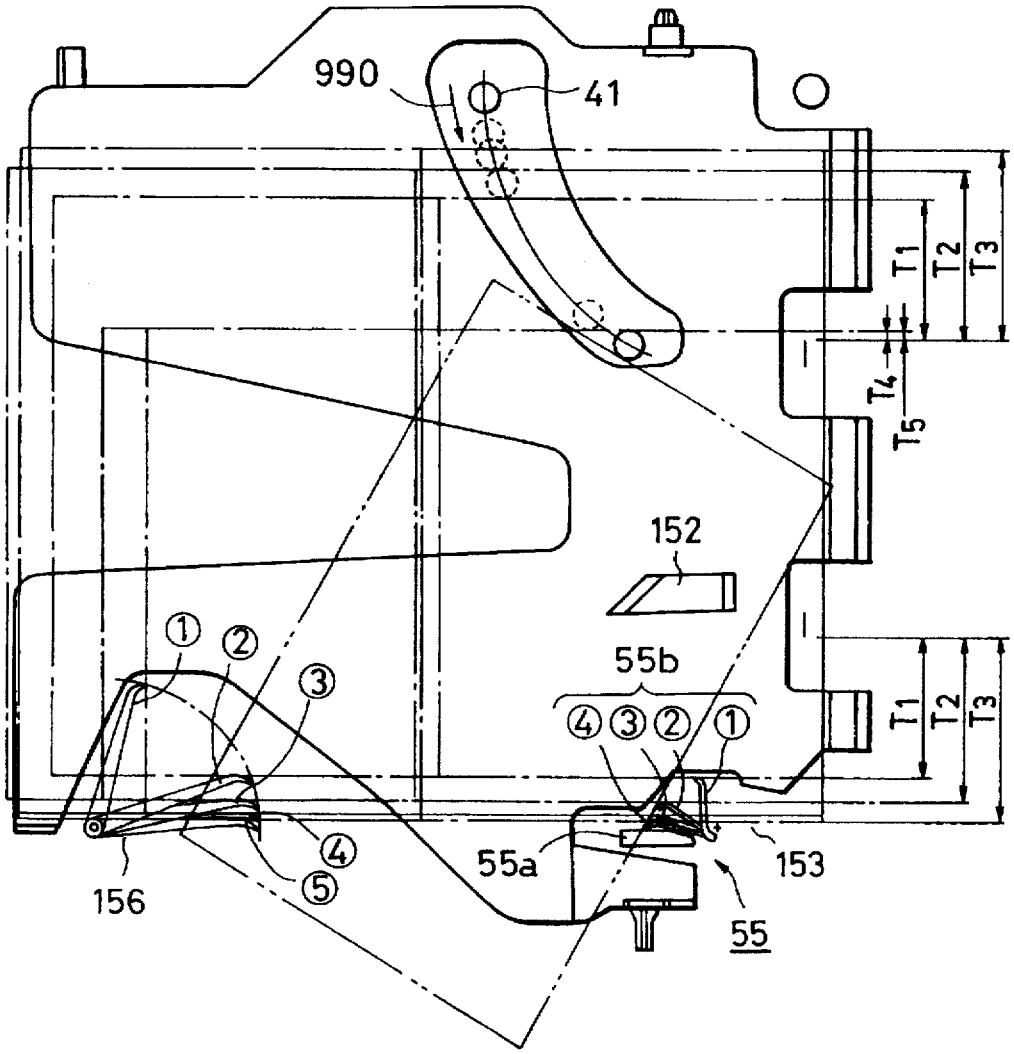
FIG. 9 (*a*) is a top view showing the operations of the reference guide, an aligning rod and a multiguide.
Figure 9B:
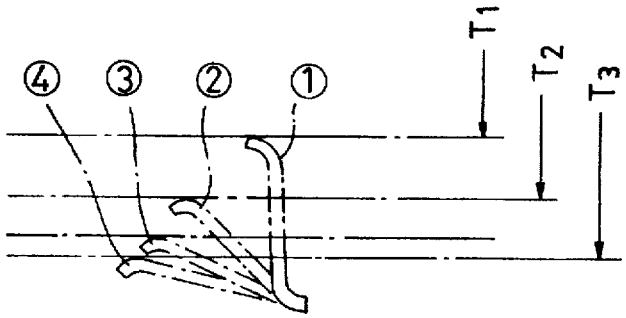
Figure 11A:
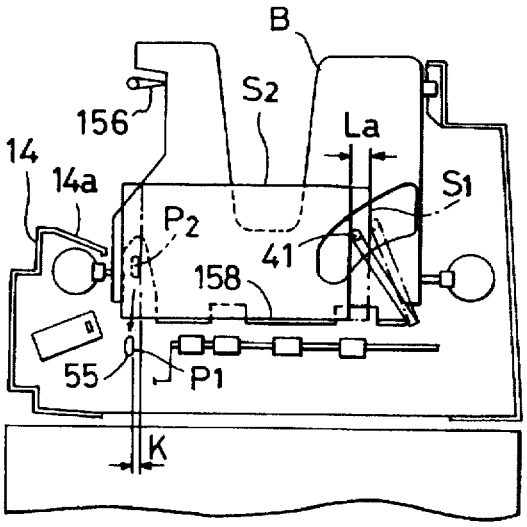
FIGS. 11 (*a*), 11 (*b*), 11 (*c*) and 11 (*d*) are top views showing states where the sheet is aligned and moved upwards on a bin tray.
Figure 11B:
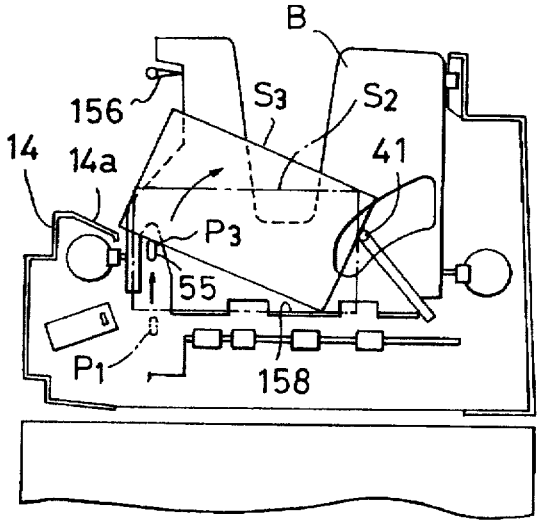
Figure 11C:
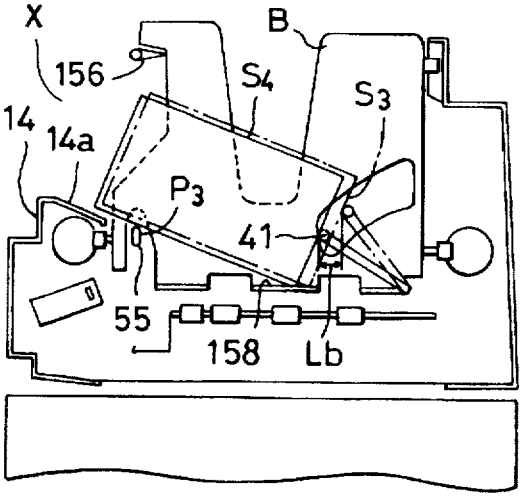
Figure 11D:
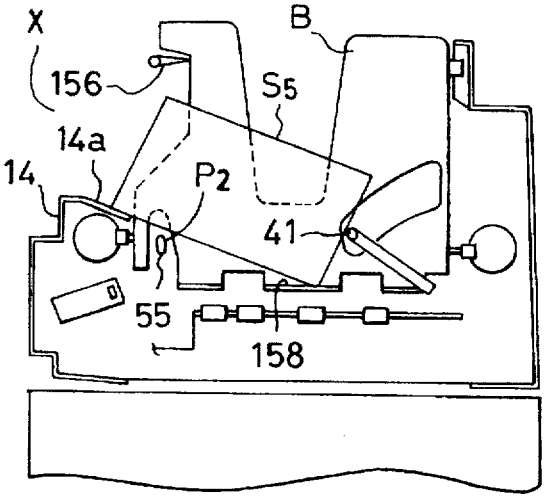
Figure 12A:
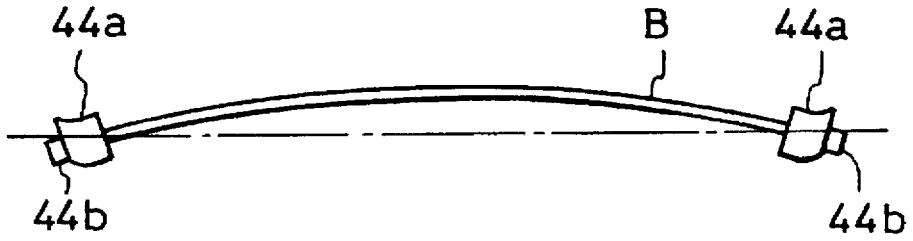
FIGS. 12 (*a*), 12 (*b*), 12 (*c*) and 12 (*d*) are schematic cross sectional views showing the bin tray.
Figure 12B:
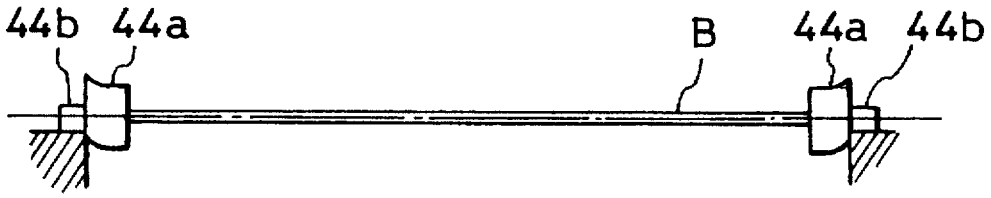
Figure 12C:
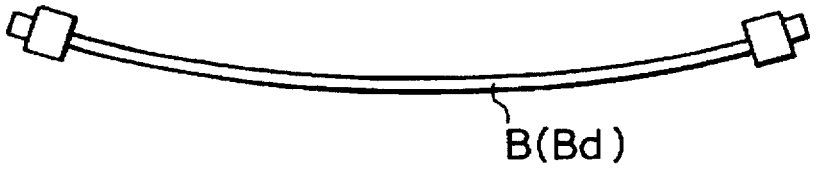
Figure 12D:
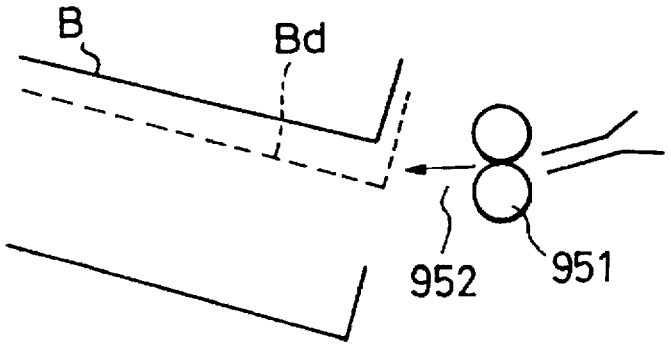

At a position facing the aligning rod 41, there is disposed a reference guide 55 through a cut portion 152 formed in each bin tray B. The reference guide 55, as shown in FIG. 9 (*a*), comprises a swing guide **55*a*, that swings in the direction along the sheet discharge direction; and a swing guide 55*b* that swings with reference to the swing guide 55*a*. Thus, the reference guide 55** is arranged to move and swing to be adaptable to various conditions (the side of the sheet S and the like) for aligning the sheets S.

In the reference guide 55, the swing guide **55*a* is secured to a belt 154*b* shown in FIG. 6 arranged in parallel to a guide rail 154*a* extending in the sheet discharge direction and supported below the bin cover 32. An end of the belt 154*b* is set to a motor pulley 154*d* of a pulse motor 154*c* secured below the bin cover 32 and another end of the same is set to an idler pulley 154*e*. Thus, the forward and the backward rotation of the motor 154*c*, as shown in FIG. 7, moves the reference guide 55 to a relief position $P_1$, at which the reference guide 55** is relieved to the outside of the bin tray region, a reference position $P_2$, which is used at the time of aligning the sheets S, and an upward pushing position $P_3$ which is used when the sheets S are pushed upwards.

Figure 6:
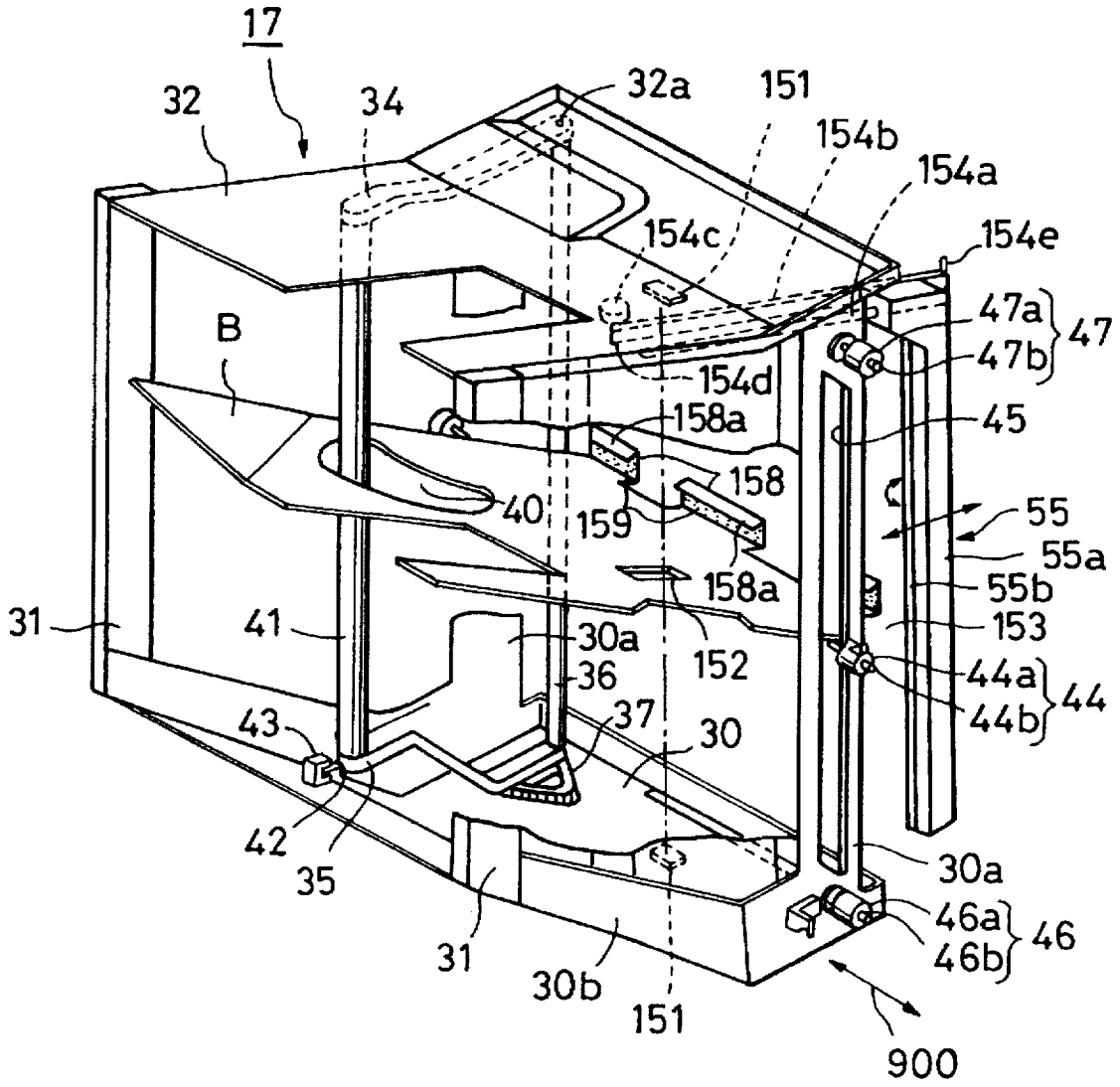
FIG. 6 is a perspective view showing a bin unit of the sheet processing apparatus.
Figure 7:
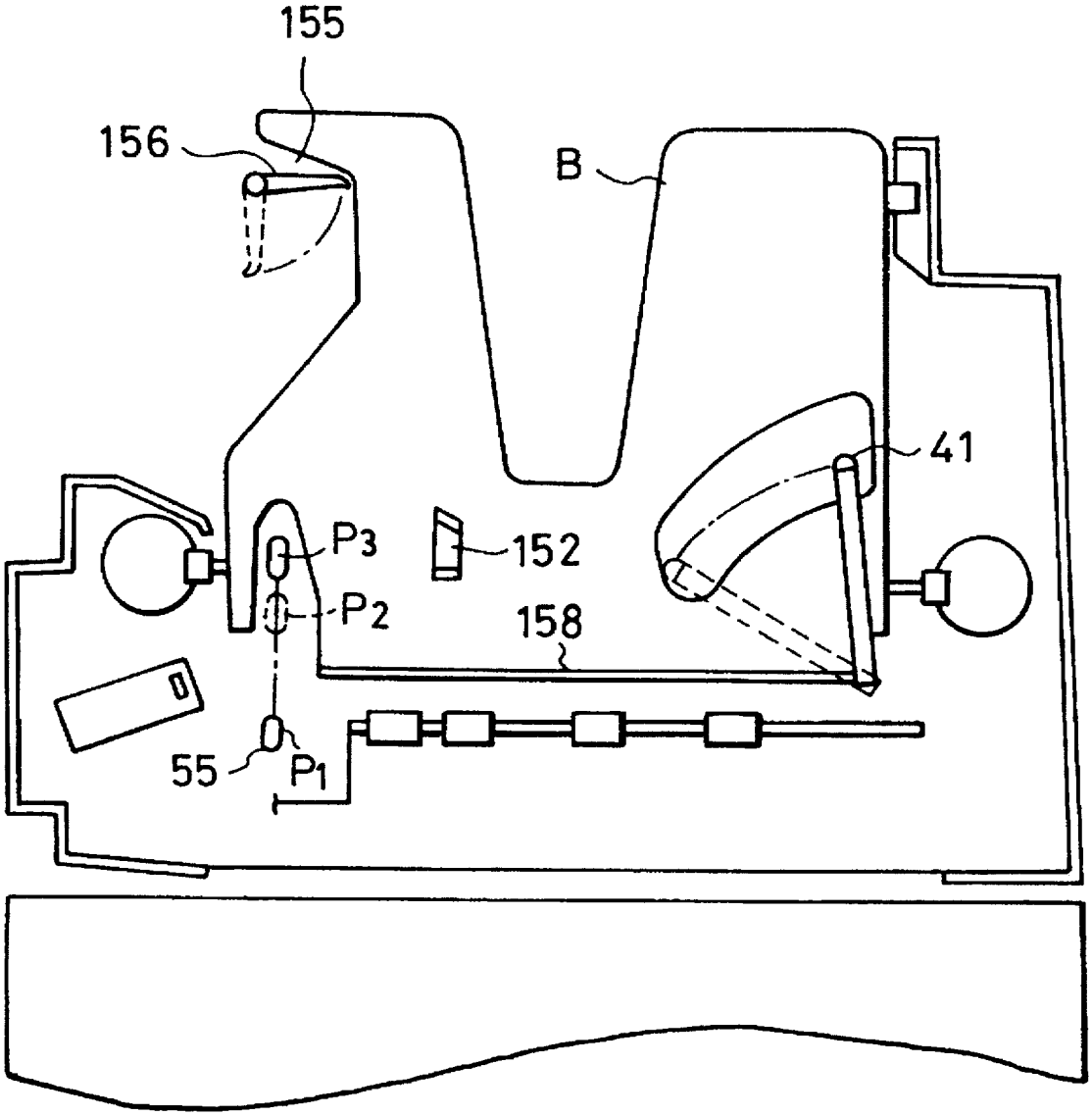
FIG. 7 is a top view of the bin unit of the sheet processing apparatus.

Referring to FIG. 6, the lower portion of the reference guide 55 is, by a rail member (not shown), enabled to be swung to prevent shakiness in a direction indicated by an arrow 900.

Shape of Knurled Molding Member

Figure 8A:
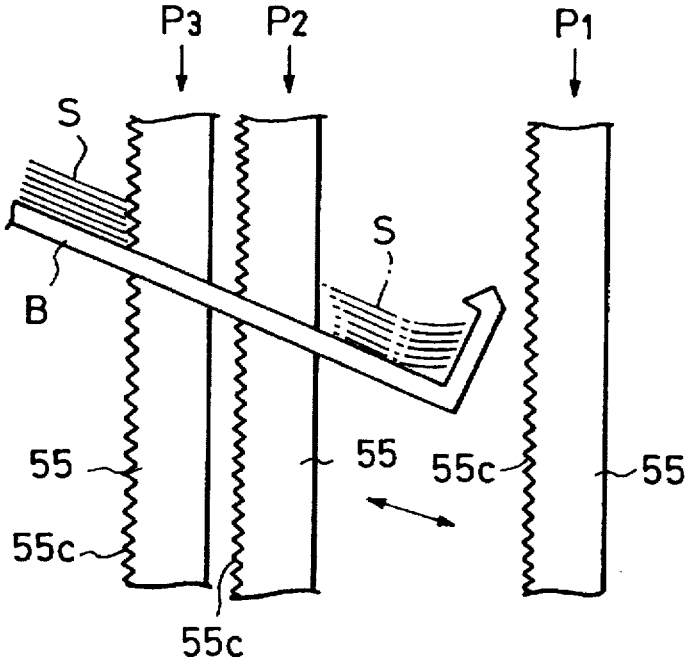
FIGS. 8 (*a*) and 8 (*b*) are schematic side views showing the movement position for a reference guide.
Figure 8B:
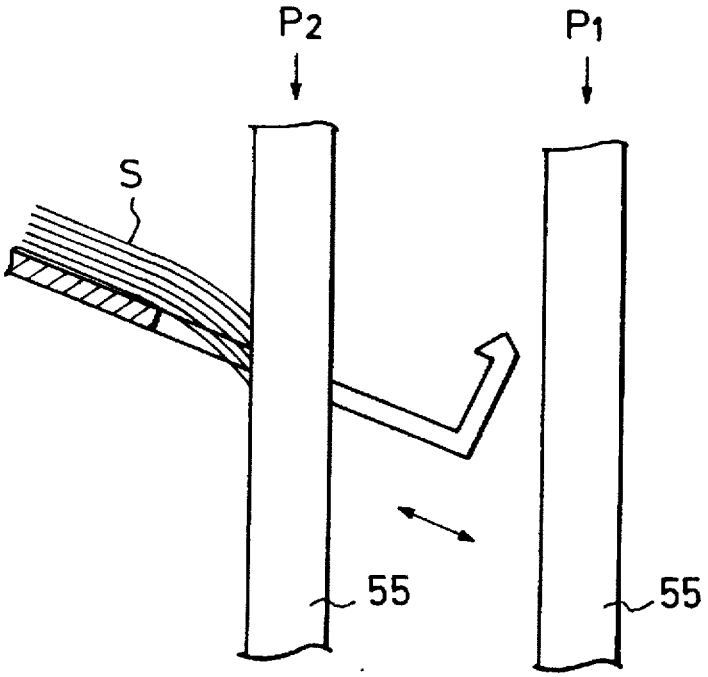

On the surface of the reference guide 55 that comes in contact with the sheet S, a knurled molding member **55*c* is attached as shown in FIG. 8** (*a*). Thus, when the reference guide 55 is moved from the relief position $P_1$ to the upward pushing position $P_3$, undesirable hanging of the rear end of the sheet S as shown in FIG. 8 (*b*) is prevented (FIG. 8 (*b*) shows the movement of the sheet S in a case where no knurled molding member is provided).

Figure 53:
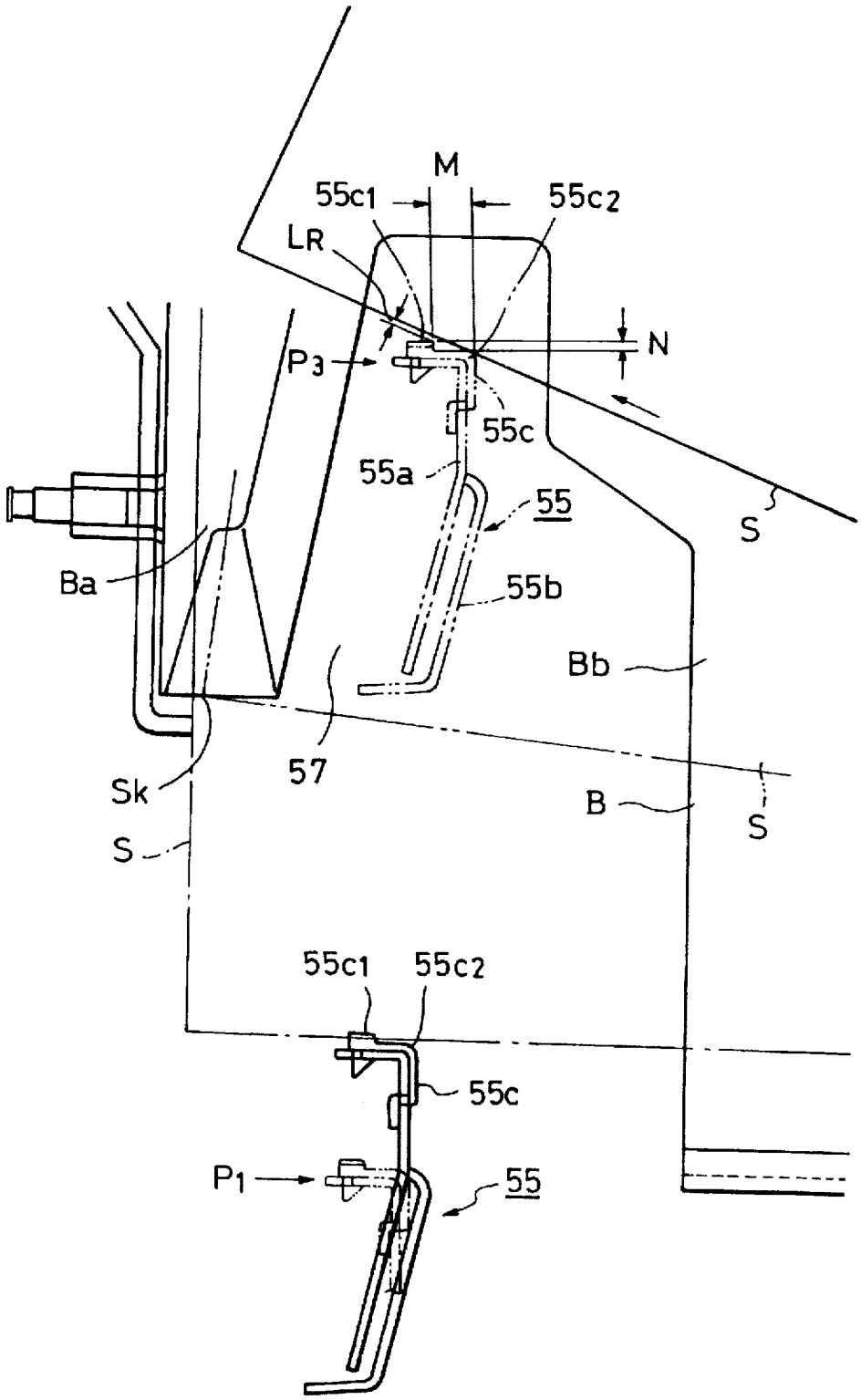
FIG. 53 is an enlarged top view showing a state where the rear end of a sheet and a reference guide (a knurled portion and a guide portion) are in contact when the bundle is pushed.
Figure 54:
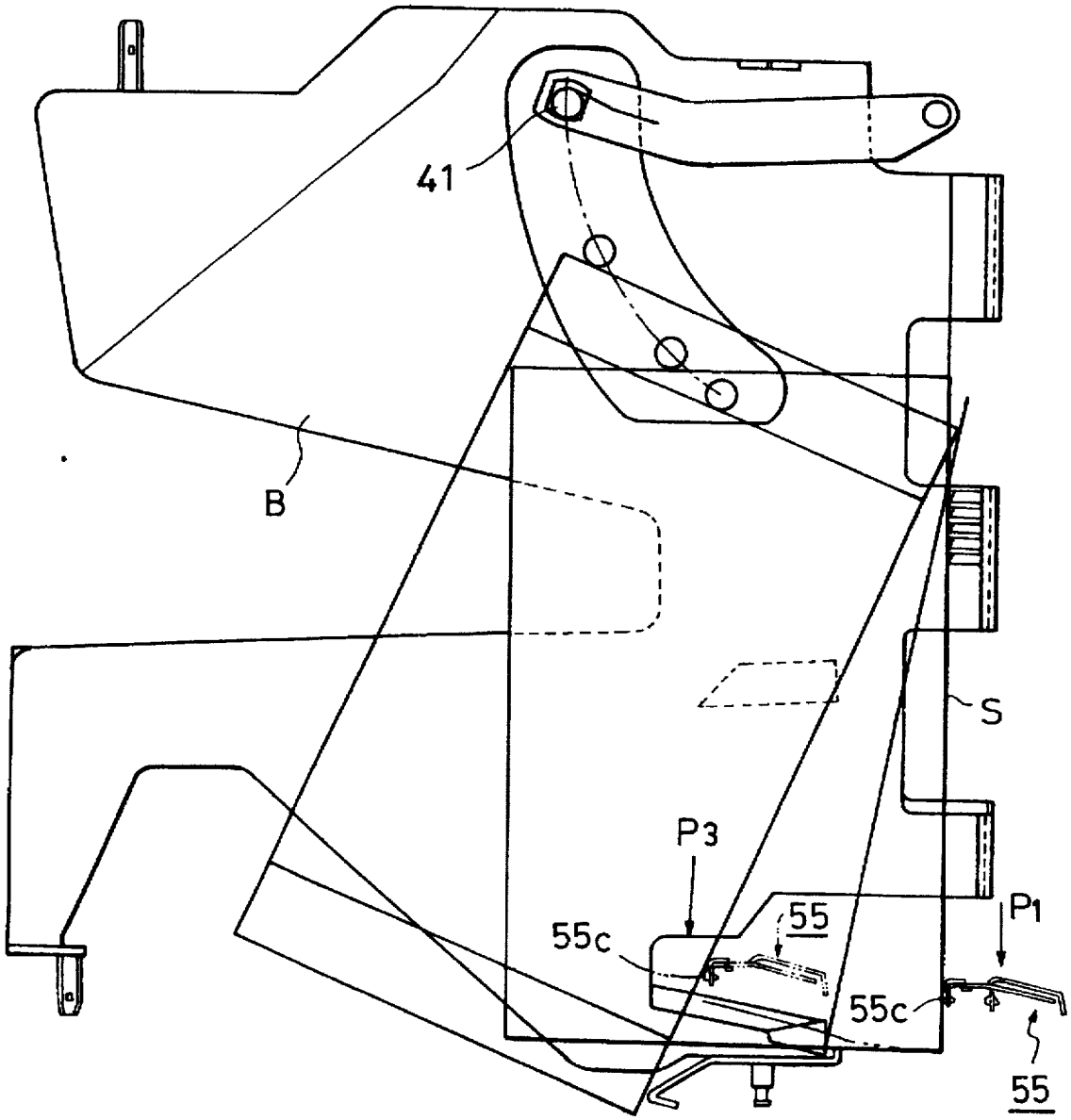
FIG. 54 is a schematic top view showing a state where the side end of a sheet and a reference guide (a knurled portion and a guide portion) are in contact when the bundle is pushed.

When the sheet S is pushed upwards by the reference guide 55 so as to be taken from a position near the operator, during an operation to push the sheet bundle, as will be described in more detail later, the knurled portion of the molding member **55*c* contacts the side portion of the sheet S. This contact will cause the side surface of the sheet S pushed by the aligning rod 41 to be caught by the knurled portion, potentially damaging the side surface of the sheet S. Accordingly, the molding member 55c according to this embodiment, as shown in FIG. 53, comprises a knurled portion 55*c*1 for guiding the side end of the sheet S when the sheet S is pushed upwards; and a guide portion 55*c*2 for guiding the side end of the sheet S when the sheet S is pushed outside. Thus, the side end of the sheet S is caused to come in contact with the guide portion 55*c*2 so as to be separated from the knurled portion 55*c*1 until the reference guide 55** reaches the upward pushing position $P_3$.

As a result, the guide portion **55*c*2 is in contact with the side end of the sheet S that is pushed outside in the direction indicated by the arrow by the aligning rod 41 to guide the sheet S and the sheet S is apart from the knurled portion 55*c*1 by distance $L_R$. Therefore, the knurled portion 55*c*1** is not caught by the side end of the sheet S so that the side end of the sheet S is prevented from being damaged.

Figure 63:
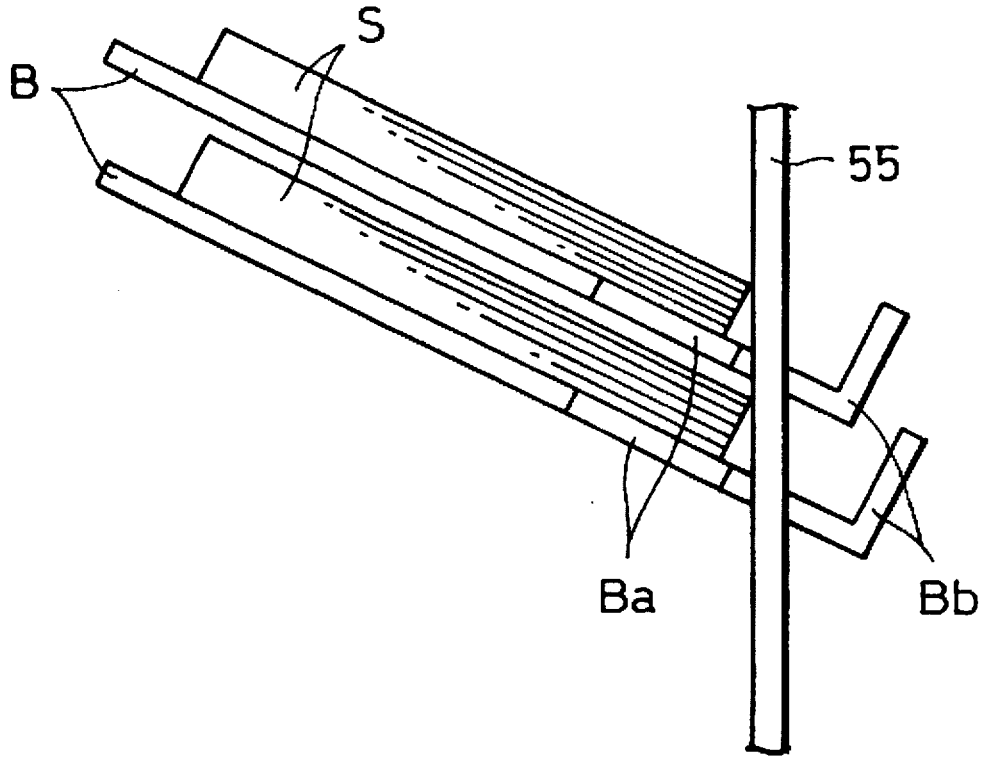
FIG. 63 is a schematic side view showing a state of a corner of a sheet that is restricted between the bin trays when the sheet is pushed upwards by the reference guide.
Figure 64:
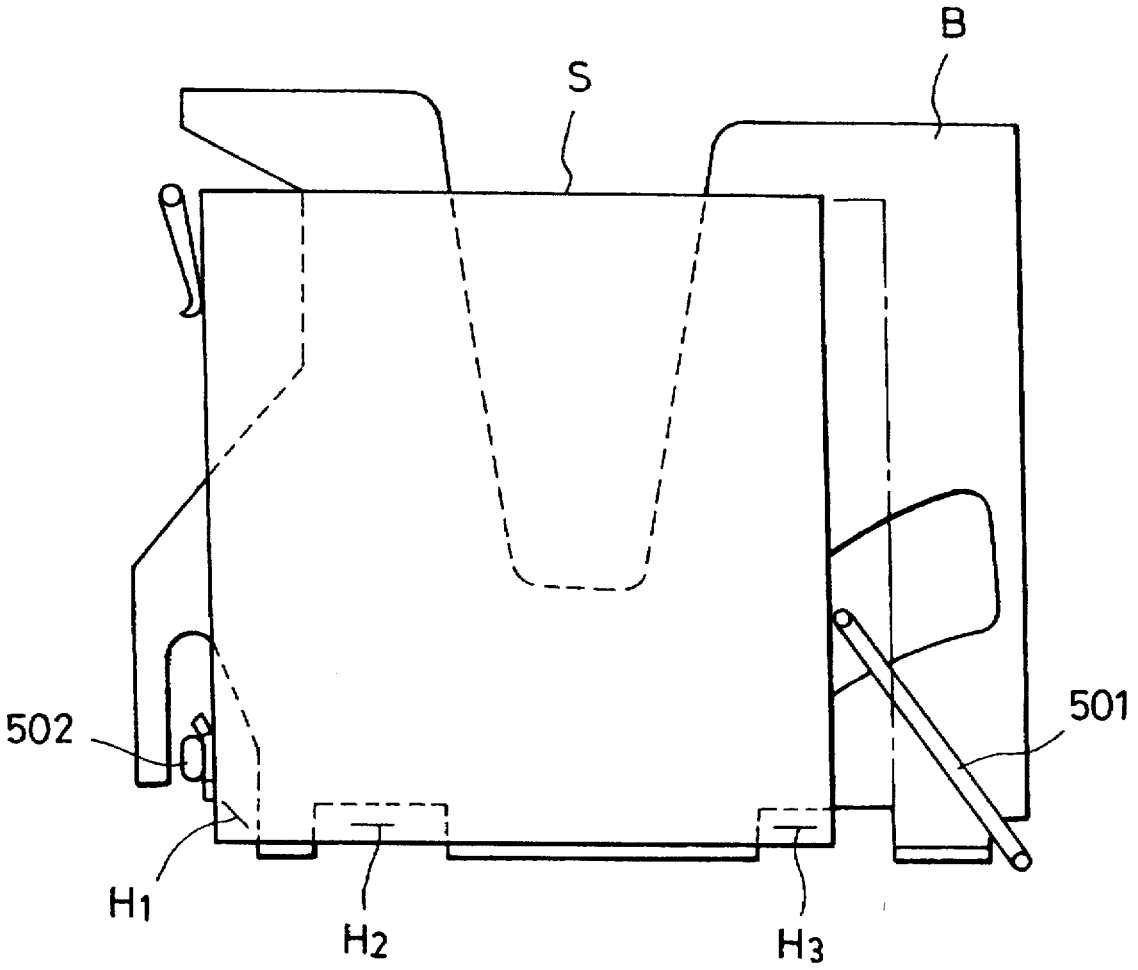
FIG. 64 PRIOR ART
FIG. 64 is an explanatory view showing a problem when the sheets are aligned by the conventional structure.
Figure 65:
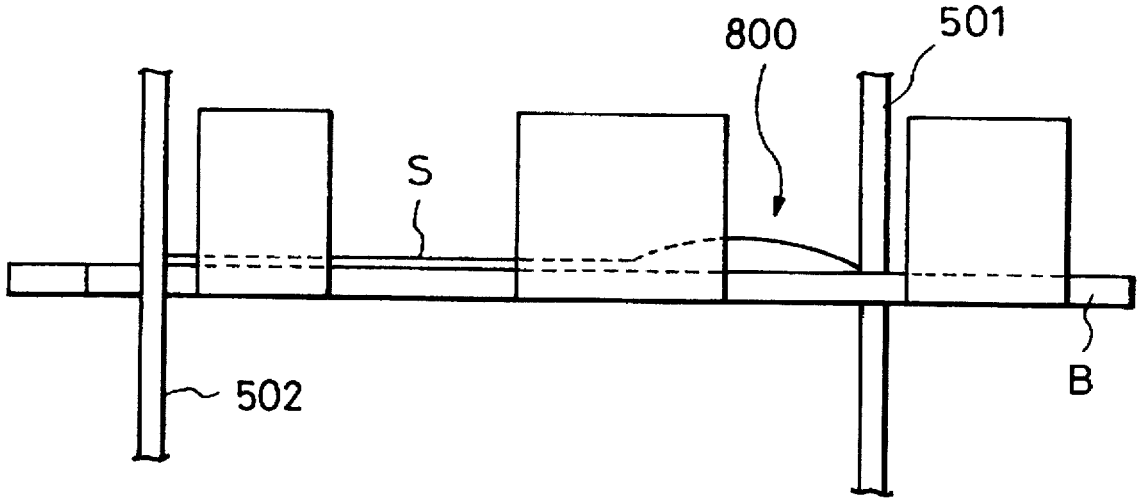
FIG. 65 PRIOR ART
FIG. 65 is an explanatory view showing a problem when the sheets are aligned by the conventional structure.
Figure 66:
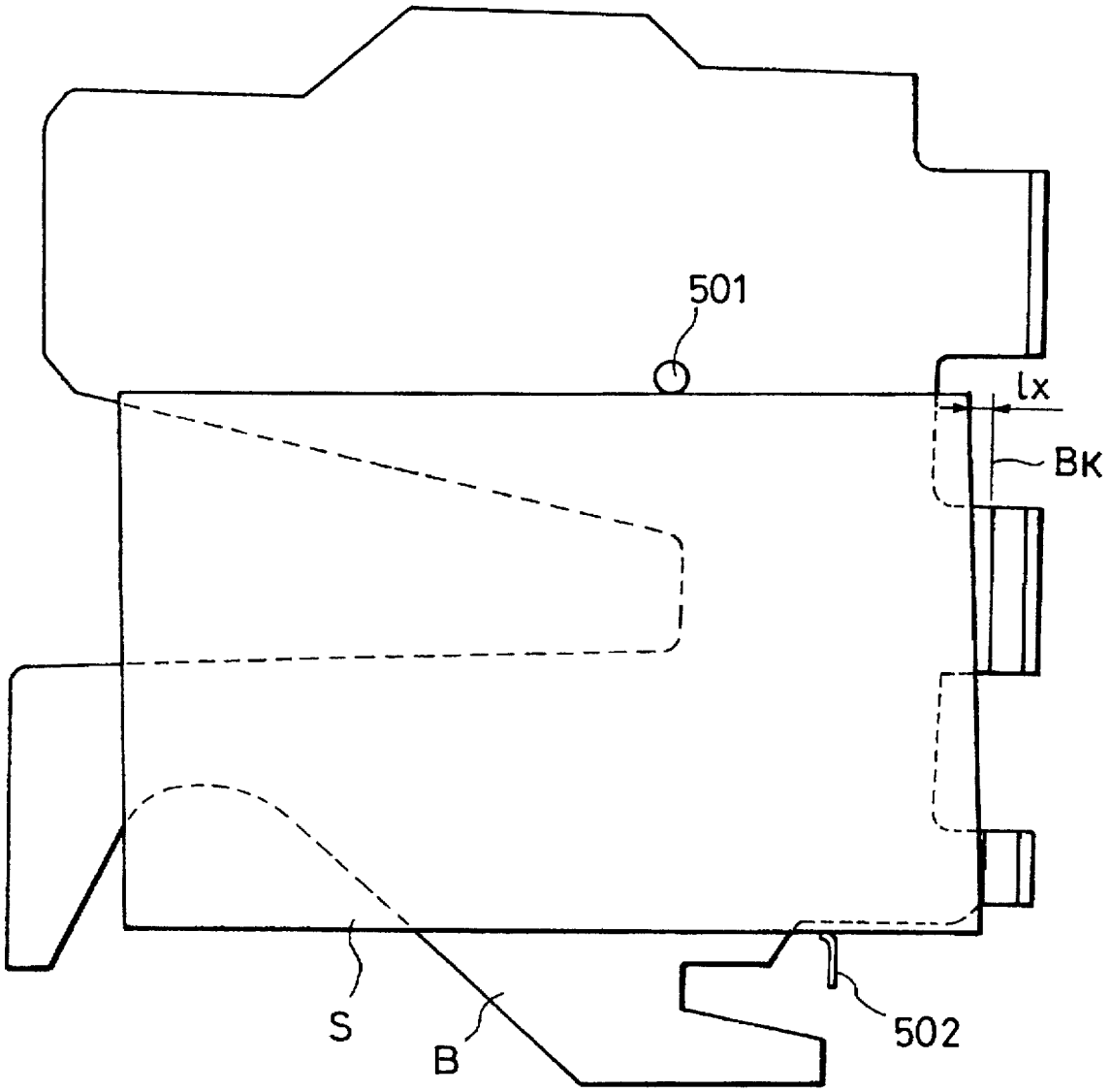
FIG. 66 PRIOR ART
FIG. 66 is an explanatory view showing a problem when the sheets are aligned by the conventional structure.

To cause the side end of the sheet S to be apart from the knurled portion **55*c*1 by the distance $L_R$ until the reference guide 55 reaches the upward pushing position $P_3$, the side end of the sheet S is pushed upwards by the guide portion 55*c*2 in a region that is required to be as follows (see FIG. 53). That is, in a portion of the surface of the bin tray B near a U-shape cut portion 57, if the knurled portion 55*c*1 guides to cover a portion, in which a corner $S_k$ of the sheet S is placed on the left stacking surface $B_a$ to the left of the U-shape cut portion 57 as shown in FIG. 53, a portion above the foregoing portion is brought to a state where the sheet bundle is restricted by the stacking surfaces Ba and Bb of the bin tray (see FIG. 63). Thus, it can be pushed upwards by the guide portion 55*c*2 so that hanging of the side end of the sheet S that is pushed upwards by the guide portion 55*c*2 as shown in FIG. 8** (*b*) can be prevented. That is, the dimensions of the knurled portion **55*c*1 and the guide portion 55*c*2 (M and N shown in FIG. 53) must be determined so as to cause the knurled portion 55*c*1** to be in contact with the side end of the sheet S to the foregoing position.

The knurled portion **55*c*1 and the guide portion 55*c*2 are formed into a molding member 55*c* formed integrally and enabled to be, by snap fitting, attached to the surface of the reference guide 55** that comes in contact with the sheet S. As a result, the assembling operation and changing operation can be completed easily.

Figure 55:
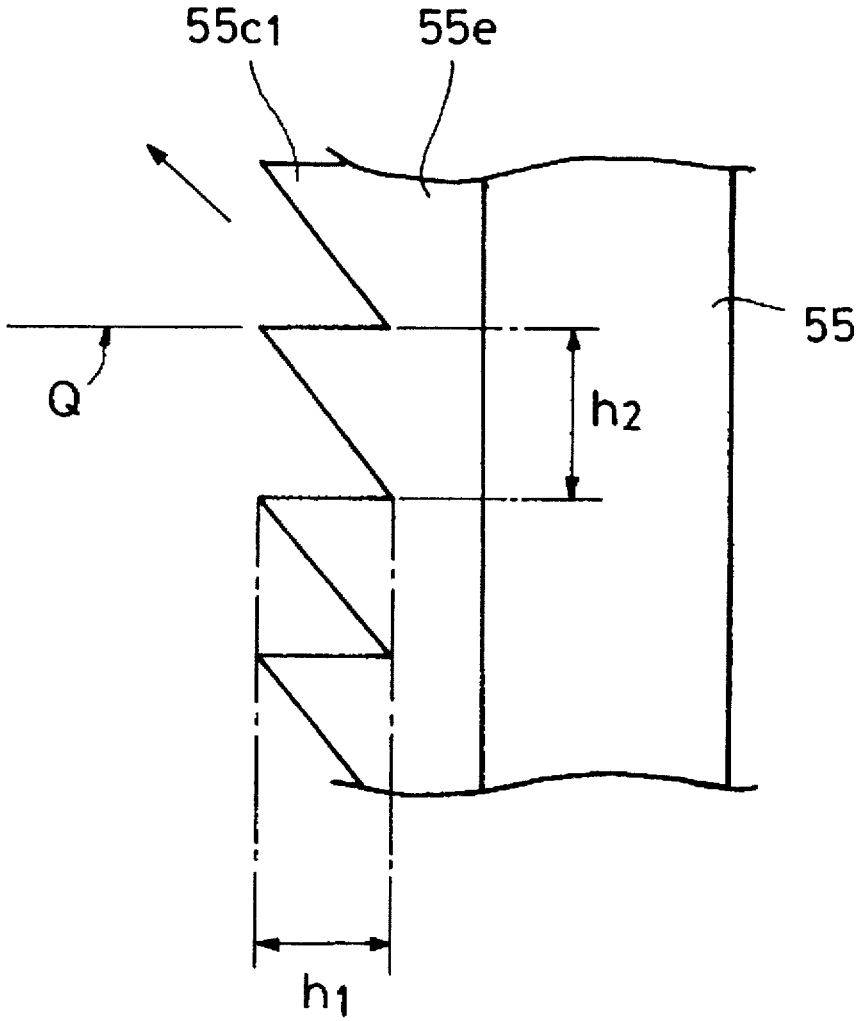
FIG. 55 is an enlarged cross sectional view of the knurled portion.

The knurled portion **55*c*1 has a cross sectional surface that comprises, as shown in FIG. 55, a multiplicity of sharp teeth formed in a direction (the direction indicated by an arrow shown in FIG. 55) in which the sheet S is pushed upwards to catch the end of the sheet S. It is preferable that the knurled portion 55c1** be formed in such a manner that the height $h_1$ of the tooth is about 0.1 mm to about 5.0 mm, the width $h_2$ of the tooth is about 0.1 mm to about 5.0 mm, and the angle of the top surface of the tooth is about 0°±40° with respect to the horizontal surface. As a result, when the sheet S is pushed upwards, the side end of the sheet S can be caught desirably so that upward pushing of the sheet S is performed reliably.

Although the knurled portion 55c1 and the guide portion 55c2 are formed into the molding member 55c formed integrally, the present invention is not limited to this. A similar effect can be obtained if the knurled portion and the guide portion are individually formed in the reference guide 55. Although the molding member 55c is attached to the surface of the reference guide 55 that comes in contact with the sheet S by snap fitting, the present invention is not limited to this. For example, it may be attached by an adhesive, such as an adhesive tape. Although the knurled portion 55c1 comprises a multiplicity of teeth to catch the side end of the sheet S, the present invention is not limited to this. For example, a frictional member having a friction resistance capable of catching the end of the sheet, specifically, a felt member or a rubber member may be employed to obtain a similar effect.

As shown in FIGS. 9 (*a*) and 9 (*b*), in the reference guide 55, the swing guide 55b is, while being allowed to swing, supported by the swing guide 55a so as to be swung to an alignment reference positions (① to ④) adaptable to the size of the sheet S by a drive mechanism (not shown). The drive mechanism comprises a rotary solenoid or the like that is operated in response to a pulse and that is controlled by a control means to be rotated for a predetermined angular degree in response to a sheet-size signal and a binding-type signal.

Multiguide

A multiguide 156, shown in FIG. 7, penetrates the cut portion 155 formed in each bin tray B and is disposed downstream of the discharge direction for the sheet S from the reference guide 55. The multiguide 156 is, while being allowed to swing, supported in the bin unit 17 so as to be swung to the alignment reference positions ① to ⑤ shown in FIG. 9 (*a*) corresponding to the size of the sheet S in synchronization with swinging of the swing guide 55b in the reference guide 55. The drive mechanism comprises a rotary solenoid or the like that is operated in response to a pulse and that is controlled by a control means to be rotated for a predetermined angular degree in response to a sheet-size signal and a binding-type signal.

Figure 39:
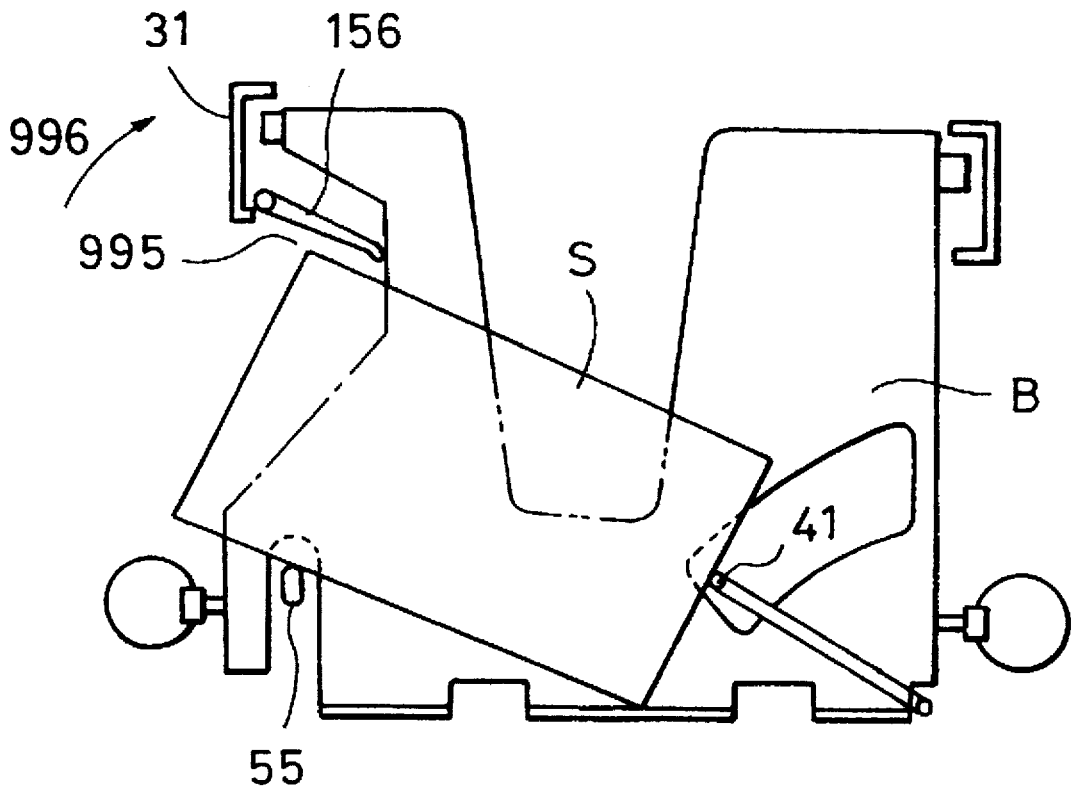
FIG. 39 is a top view showing the bin unit of the sheet processing apparatus.

The multiguide 156 is brought to positions ②, ③, ④ and ⑤ (see FIGS. 9 (*a*), 9 (*b*) and 10) to restrict dislocation of the leading portion of large size paper (LDR, A3, A4, A4R, LGL or the like). A case will now be described where it is brought to position ①. The multiguide 156 is brought to position ① when one or two front portions of small-size paper (A4R, LTR or B5) are bound. In this case, sheets S are aligned by displacing the swing guide 55b to the respective position and the aligning rod 41 is used to align the sheets S. After the sheets S have been aligned, the sheets S are bound as desired (a case where binding has not been performed is permitted) and the front portion of the sheet bundle S is pushed, as described later, in such a manner that guiding is performed to prevent the corner 995 of the sheet bundle S being caught by the bin slider 31 or the like (see FIG. 39). When the sheets S are again stacked on the bin B in the state shown in FIG. 39, rotation of the sheets S on the bin in a direction indicated by an arrow 996 due to vibration occurring when the bin is shifted causing undesirable movement toward the bin is prevented.

Alignment of Sheets

The reference guide 55 and the multiguide 156 change their alignment reference positions to be adaptable to the size of the sheets S when the stapler 56, to be described later, is used to bind two portions or one inner portion in order to maintain uniform or a predetermined length from each binding position to the side end of the sheet S as shown in FIGS. 9 and 10.

That is, two portions are bound, the sheet aligning operation is performed in such a manner that the reference guide 55 is moved to the reference position $P_2$ shown in FIG. 1; the swing guide 55b of the reference guide 55 is swung to the alignment reference position ①, ② and ③ corresponding to the size of the sheets S; and the multiguide 156 is moved to the alignment reference position ①, ②, ③ and ⑤ corresponding to the size of the sheets S in synchronization with the movement of the swing guide 55b. When the sheet S has been discharged onto each bin tray, the aligning rod 41 located to face the reference guide 55 is moved in a direction indicated by an arrow 990 so as to be swung to each alignment position that presses the inner end of the sheet S so that the sheets S are aligned. As a result, the distance from each binding position to the two side ends of the sheets S ($T_1$, $T_2$ and $T_3$ shown in FIGS. 9 (*a*) and (*b*)) can be maintained to be uniform for each size of the sheets S.

The sheet alignment operation in a case where one inner portion is bound is performed in such a manner that the sheets S are aligned to be made coincide with the inner binding positions in the case of where the two portions are bound. The reference guide 55 is moved to the reference position $P_2$; the swing guide 55b of the reference guide 55 is swung to the alignment reference positions (② and ④) corresponding to the size of the sheets S; and the multiguide 156 is swung to the alignment reference positions (③ and ④) corresponding to the size of the sheets S in synchronization with this. After the sheet S has been discharged onto each bin tray, the aligning rod 41 placed to face the reference guide 55 is swung to the alignment position so that the sheets S are aligned. As a result, the distance ($T_4$ and $T_5$ shown in FIG. 9 (*a*)) from the binding position to the side ends of the sheets S can be made to be uniform. Furthermore, one inner portion is bound at the inner position in the case where the two portions are bound so that the necessity of enlarging the cut portion (or individually forming the foregoing cut portion) in the bin tray for binding one inner portion is eliminated. Therefore, the sheets S can be stacked desirably in such a manner that the rigidity of the bin tray is maintained.

The binding position for aligning the sheets S is usually selected with a signal supplied from an operation panel (not shown) of an image processing apparatus before the image is formed. In a case where stapling is performed after the image has been formed and the sheets S have been sorted on to the bin tray, that is, after all operations have been completed, the binding position for the sheet alignment may be selected afterwards. The selection of a binding operation after copying and sorting is performed with a signal supplied from the operation panel of the image processing apparatus or a signal supplied from an operation panel 157 disposed near the operator above the sorter 11 (see FIG. 2). As a result, the operability of the apparatus can be improved and thus a variety of needs of the operator can be satisfied.

Pushing Force of Aligning Rod

The aligning rod 41 is swung to the alignment position after the sheets S have been discharged to each bin tray B to cause the sheet ends to abut against the reference guide 55. Furthermore, the aligning rod 41 is swung to the alignment position before the stapling operation using the stapler 56. At this time, the sheet ends have been pushed toward the reference position by the aligning rod 41 with a uniform force, the end of the sheet pushed by the aligning rod 41 is deflected if a small number of sheets are stacked, thus causing the stacking characteristic to deteriorate. The inner binding position can be dislocated when the one inner portion is bound or two portions are bound. Accordingly, this embodiment has a structure such that the pushing force against the sheet ends by the aligning rod 41 is changed to correspond to the binding mode using the stapler 56.

Figure 49A:
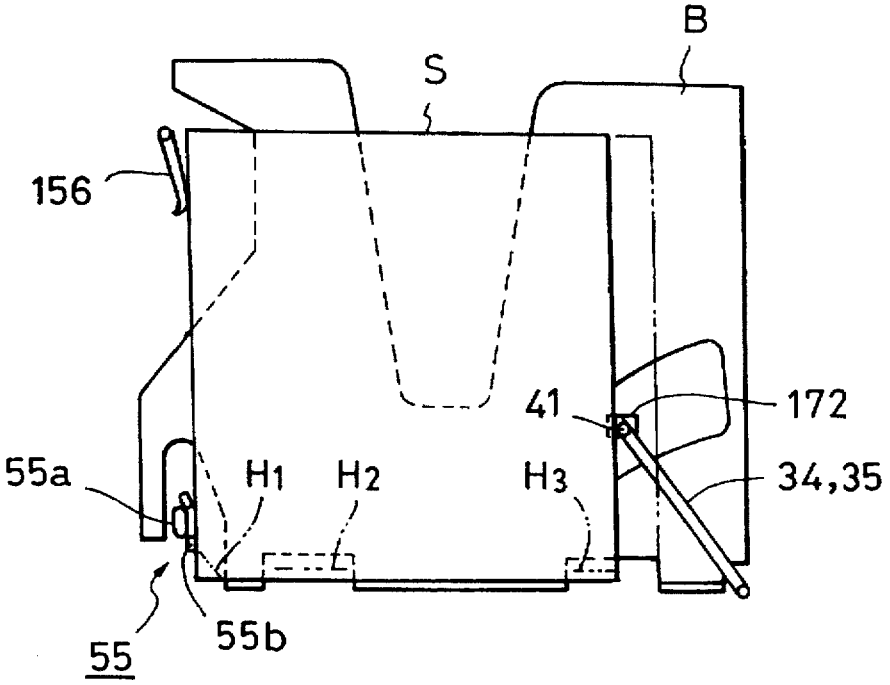
FIGS. 49 (*a*), 49 (*b*) and 49 (*c*) are diagrams showing the structure of the aligning rod and the quantity of pressing by the aligning rod.
Figure 49B:
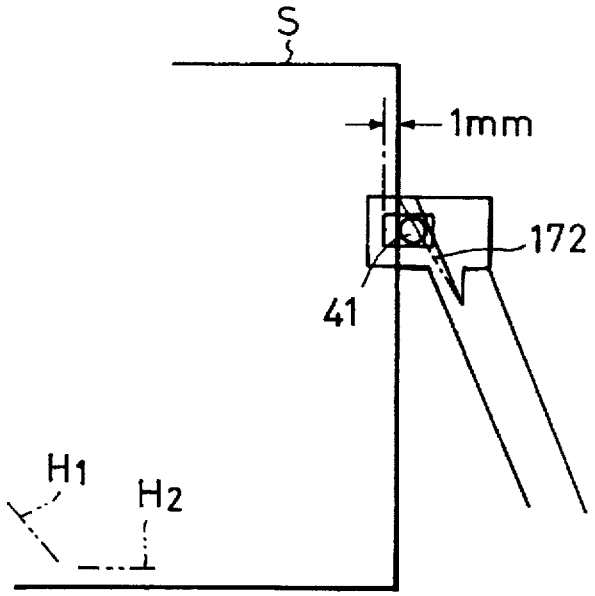
Figure 49C:
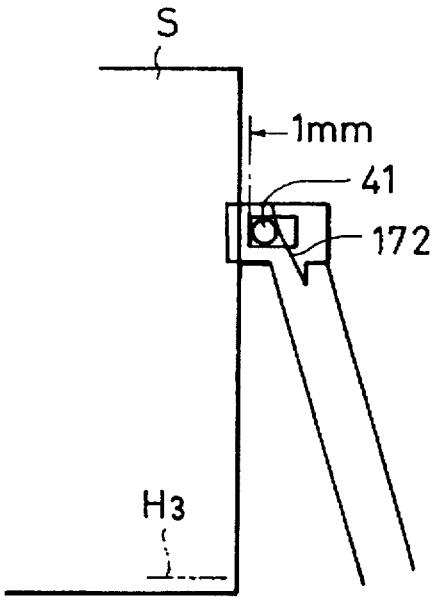

That is, referring to FIG. 49 (*a*), a leaf spring 172 is provided for the support portion for the upper and lower arms 34 and 35 for vertically supporting the aligning rod 41 to urge the aligning rod 41 toward the sheet ends. The sheet bundle discharged on to the bin tray B and caused to abut against the swing guide 55*b* of the reference guide 55 is aligned by again swinging the aligning rod 41 before stapling is performed. If the selected binding mode is either the one front binding (binding position: $H_1$) or the two-portion binding at the front binding (binding position: $H_2$), the aligning rod 41 is pushed toward the reference position by about 1 mm (+1 mm from the sheet ends), as shown in FIG. 49 (*b*). Even if the end of the sheet pushed by the aligning rod 41 is deflected at this time, the dislocation of the binding position by the staple 56 is not affected. Therefore, an excellent binding operation is performed.

If the selected binding mode is either one inner portion binding (binding position: $H_3$) or the inner-portion binding step during two-portion binding (also binding position: $H_3$) the aligning rod 41 is, as shown in FIG. 49 (*c*) stopped at a position of about 1 mm away from the sheet end position, and the pushing operation is not performed (−1 mm from the sheet end, the pushing force is zero). The foregoing value may be 0 mm to −1 mm. At this time, the aligning rod 41 does not come in contact with the sheet end and the same is not pushed from the sheet end to the reference position. The quantity of pushing of the aligning rod 41 is changed by controlling the quantity of rotation (the number of pulses) of the pulse motor 38. If the aligning rod 41 is not pushed from the sheet end in the front-portion binding mode among two-portion binding modes, no problem arises.

As a result, the binding position $H_3$ by means of the stapler 56 is not dislocated due to the alignment operation, stapling can be performed at an appropriate position to correspond to the binding mode, the reliability of the apparatus can be improved and the selection of a binding operation after copying and sorting can be performed effectively.

If the number of sheets to be stacked on each bin tray B is small, the stacking characteristic easily deteriorates due to deflection of the ends of the sheets S pushed by the alignment operation by the aligning rod 41. Therefore, the quantity of pushing of the aligning rod 41 may be changed to correspond to the number of sheets S to be stacked. That is, if the number of sheets S to be stacked on one bin is larger than 10, the aligning rod 41 is pushed toward the reference position by about 1 mm over the sheet end position. If the number is 10 or less, the aligning rod 41 is stopped at a position of about 0 mm to about 1 mm away from the sheet end position and no pushing is performed.

Although the alignment operation at the time of stacking sheets S has been described, the quantity of pushing of the aligning rod 41 before the stapling operation may be changed depending upon the number of sheets S to be stacked. The quantity of pushing of the aligning rod 41 may be changed between the operation where the discharged sheets S are aligned and the operation where the sheets S are aligned at the time of performing stapling.

The selection of a binding operation after copying and sorting will now be described. If the selection has been made before an image is formed, the swing guide 55*b* and multiguide 156 are moved to predetermined positions; the aligning rod 41 is used to align the sheets S; and the stapling operation is performed.

If the non-binding sorting is instructed from the image processing apparatus having the foregoing structure, for example, for example, an A4R-sheet is processed in such a manner that the positions of the swing guide 55*b* and the multiguide 156 are different between the one-front-portion binding and the one-inner-portion binding (the aligning positions are different). No problem arises in the case where the non-binding operation is performed regardless of the binding mode. However, if alignment is performed by, for example, one-inner-portion binding (the swing guide 55*b* is at position ② and the multiguide 156 is at position ③) and then one-front-portion binding is instructed afterwards, the front binding operation cannot be performed because the sheets S have been aligned in the inner portion.

Figure 45A:
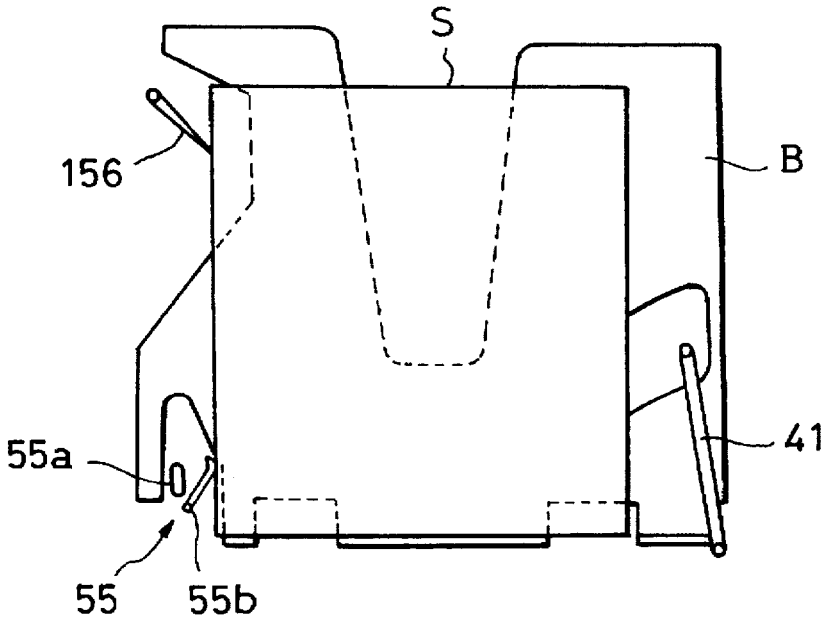
FIGS. 45 (*a*) and 45 (*b*) are diagrams showing the operational relationship among the reference guide, the aligning rod and the multiguide.
Figure 45B:
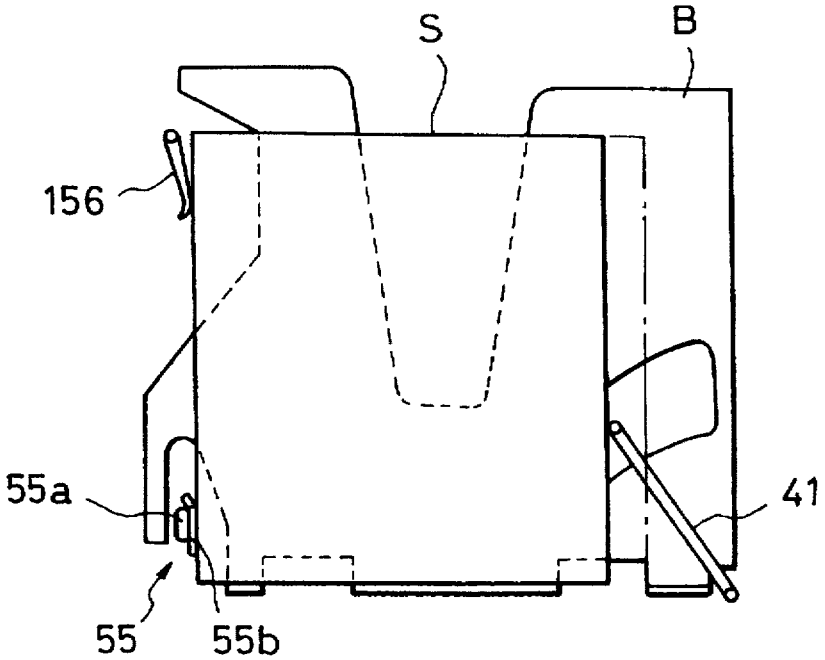

Accordingly, the sheet processing apparatus according to this embodiment of the present invention is arranged to align all sheets S at the position for the one-inner-portion binding mode or the two-portion binding mode as shown in FIG. 10 (FIG. 45 (*a*) shows the example of an A4R-sheet). If the foregoing binding mode (the one-inner-portion binding mode or the two-portion binding mode) is selected afterwards, the foregoing binding operation is performed at the foregoing positions. If the one-front-portion binding mode is selected afterwards, the swing guide 55*b* and the multiguide 156 at the foregoing alignment positions are changed to the positions corresponding to the one-front-portion binding mode. Then, the aligning rod 41 is used to push all sheet bundles in all bins so as to be swung until the sheet ends abut against the swing guide 55*b* and the multiguide 156 (FIG. 45 (*b*) shows the case of A4R-sheet). Then, the stapler 56 is used to perform the one-front-portion binding operation after the movement. As a result of the foregoing structure, stapling can be performed at an arbitrary position even if the binding operation is selected after the copying and sorting operations have been performed.

Although the foregoing structure is arranged such that the aligning rod 41 is used to move the sheets S to the position for the one-front-portion binding mode if the binding operation is selected after the sheets S have been aligned. If the sheets S have been aligned at the one-front-portion binding position and one-front-portion binding or two-portion binding is later selected, an arrangement may be employed in which the aligning rod 41 is moved to a predetermined aligning position; the sheet bundles in all bins are moved to the predetermined positions toward the aligning rod 41 by the multiguide 156 and the swing guide 55*b*; and the predetermined binding operation is performed. Since the foregoing structure is arranged in such a manner that the sheets are aligned at the stapling position, the cut portion in the bin for introducing the stapler can be minimized. Therefore, sheet stacking characteristics can be improved.

Pushing of Sheet Bundle

Small size sheets (B5 or A4 sheets) can be taken from the front portion of the apparatus after the sheets have been aligned by the structure in which the side ends of the sheets are pushed from the surface of the bin tray B. The sheet bundle is pushed by the aligning rod 41 and the reference guide 55.

The sheet bundle, which has been aligned (or stapled by the stapler to be described later), is pushed in such a manner that the reference guide 55, which is initially in contact with the side end of the sheet at the reference position $P_2$, as shown in FIG. 11 (*a*), is moved to the relief position $P_1$ by the pulse motor 154*c* shown in FIG. 6. At this time, the reference guide 55 is moved away from the side end of the sheet bundle by a distance K. Therefore, the sheet bundle is not dislocated due to the movement.

Then, the aligning rod 41 is moved from the alignment position by a predetermined distance La ($L_a$>K) by the pulse motor 38. The movement of the aligning rod 41 results in the sheets being pressed at the side end thereof. Thus, the sheet bundle is pushed in a direction toward the front portion of the apparatus along a stopper 158 by $L_a$ (position $S_1$ to position $S_2$).

Then, as shown in FIG. 11 (*b*), the reference guide 55 is moved from the relief position $P_1$ to the upward movement position $P_3$ while pushing upwards the rear end of the sheet bundle. At this time, the rear end of the sheet bundle is supported by the reference guide 55 and the stopper 158 and the side end is supported by the aligning rod 41 so that the positions of the sheets are changed to be inclined on each bin tray B (position $S_2$ to position $S_3$). The molding member 55*c* attached to the surface of the reference guide 55 comes in contact with the sheet bundle so that the rear end of the sheet bundle is caught by the knurled portion 55*c*1 to reliably push the sheet bundle upwards. The sheet bundle is then separated from the knurled portion 55*c*1 and contacts the guide portion 55*c*2 until the guide 55 reaches the upward movement position $P_3$.

In the foregoing state, the aligning rod 41 is, as shown in FIG. 11 (*c*), moved in a direction by a predetermined distance $L_b$. The cover 14 in front of the sorter 11 has a space X that is sufficiently large to allow the sheet to pass through, and the cover 14 has a guide member 14*a* for guiding and holding the pushed sheet bundle. Therefore, the side end of the sheet is completely pushed outside the apparatus by the movement of the aligning rod 41 by the quantity $L_b$ (position $S_3$ to position $S_4$). Since the guide portion 55*c*2 of the molding member 55*c* attached to the reference guide 55 is in contact with the rear end of the sheet and therefore guides the sheet at this time, the sheet can be discharge smoothly without the damage of the end surface of the sheet.

The reference guide 55 is then moved from the upward movement position $P_3$ is, as shown in FIG. 11 (*d*), to the reference position $P_2$, and the end of the sheet bundle comes in contact with the guide member 14*a* provided on the cover 14 in front of the sorter 11 so as to be held (position $S_4$ to position $S_5$). As a result, the reference guide 55 and the rear end of the sheet bundle are separated from each other. Therefore, if sheet bundles to be sorted are left after the sheet bundle have been pushed, the vertical movement of the bin tray does not cause contact between the sheet held at position $S_5$ and the molding member 55*c* provided on the surface of the reference guide 55 that contacts the sheet.

If a predetermined number of bundles have been sorted, the operation of the apparatus is completed here. If bundles to be sorted remaining, the residual bundles are sorted onto the sheet bundles (position $S_5$) placed on each bin tray, and the alignment and pushing are performed so that the operation of the apparatus is completed.

Figure 46:
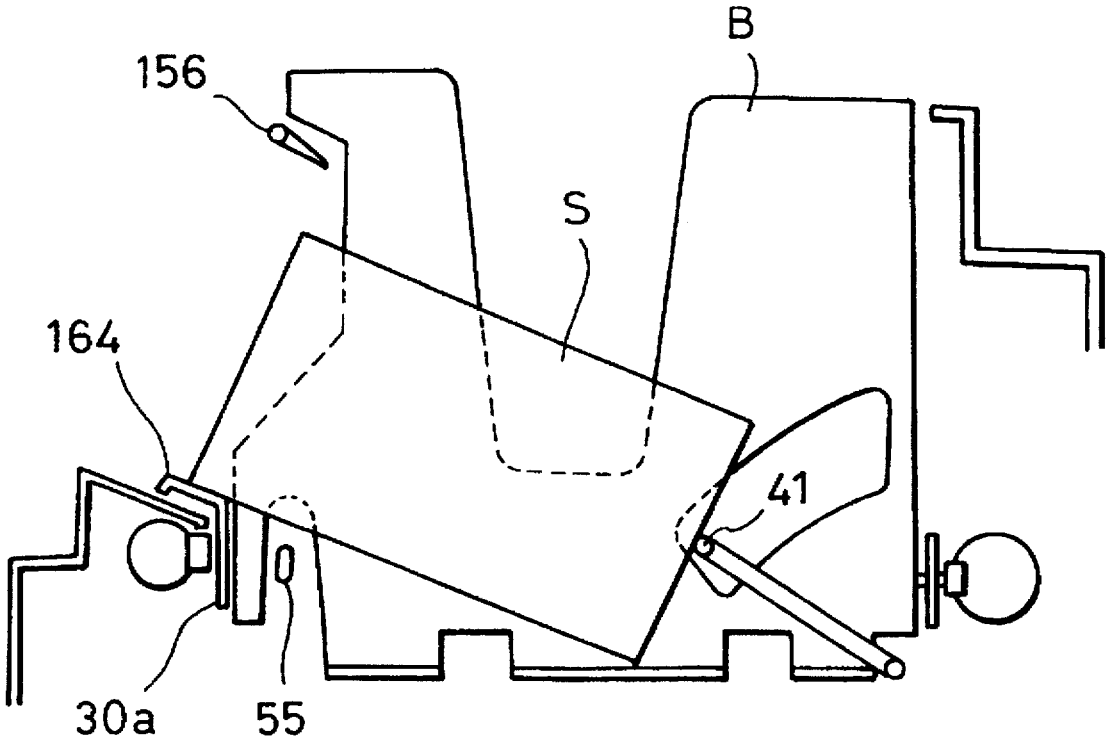
FIG. 46 is a top view showing a state where the sheet pushed on to the bin tray is maintained.
Figure 47:
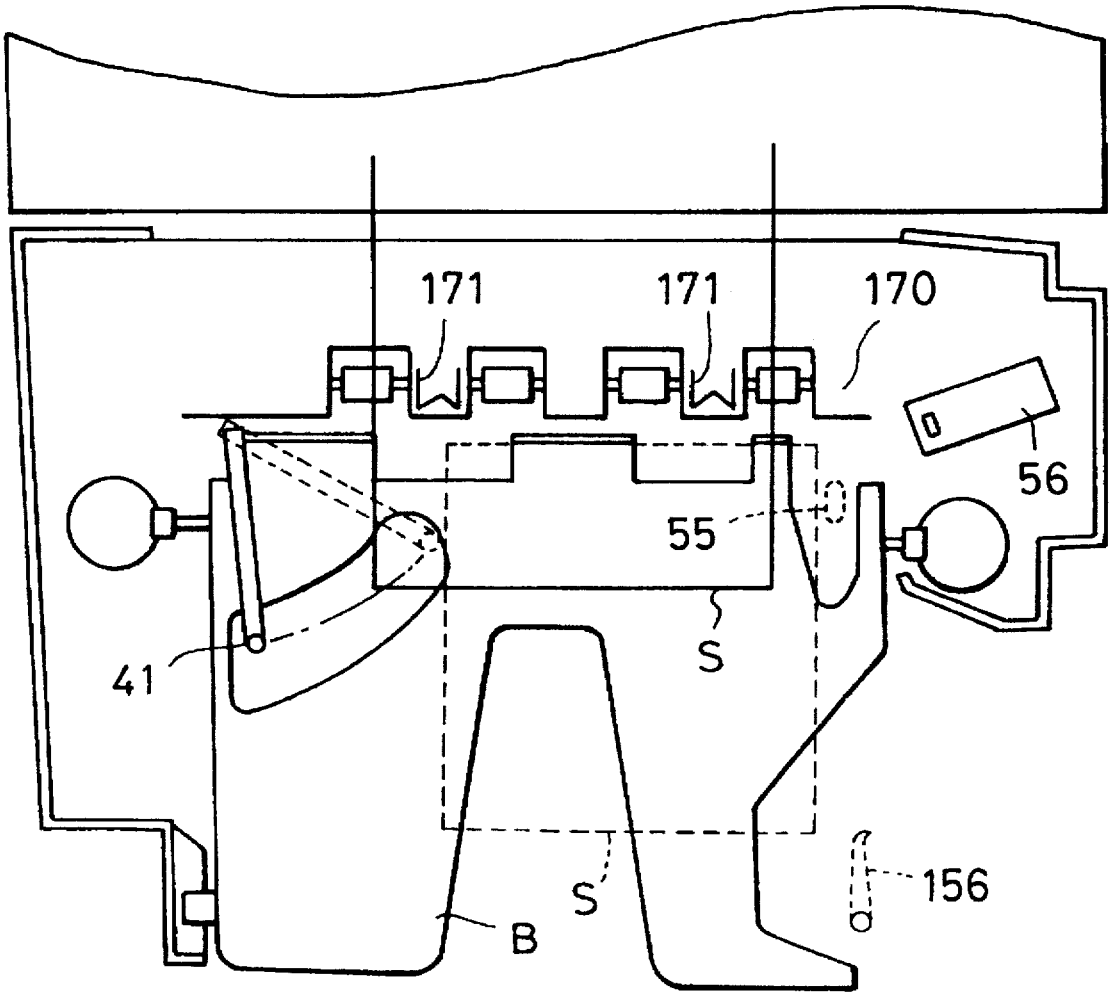
FIG. 47 is a top view of a discharge guide.
Figure 48A:
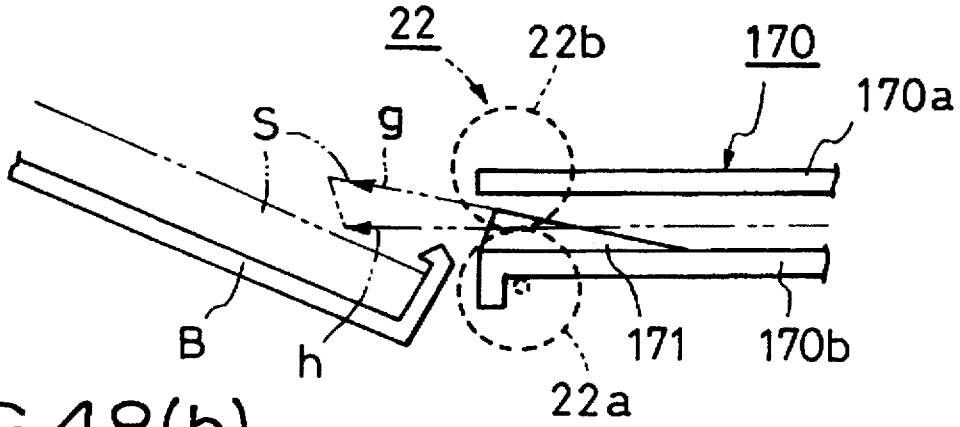
FIGS. 48 (*a*) and 48 (*b*) are cross sectional views and FIGS. 48 (*c*) and 48 (*d*) are front views showing the discharge guide.
Figure 48B:
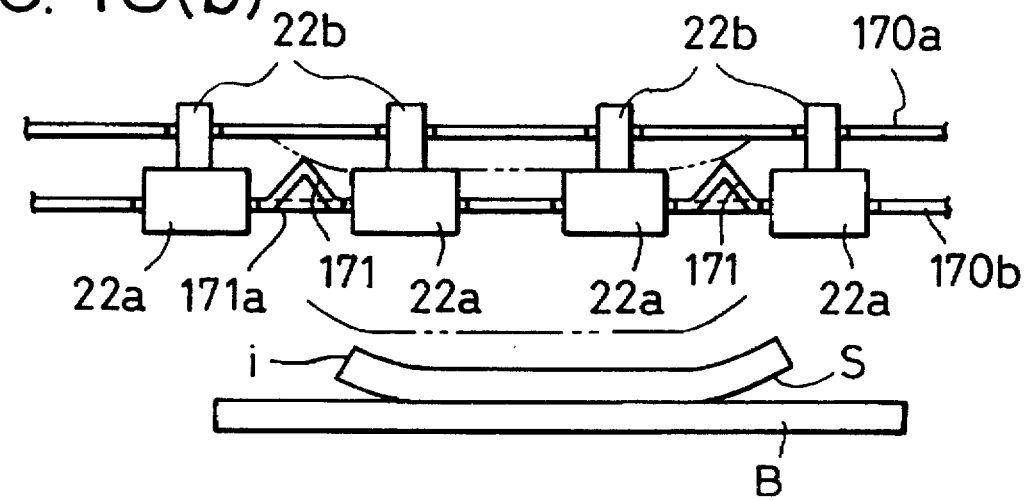
Figure 48C:
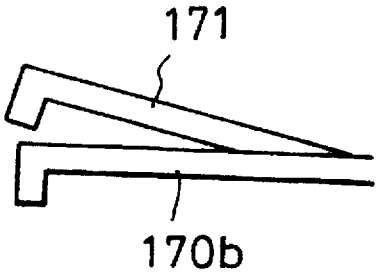
Figure 48D:
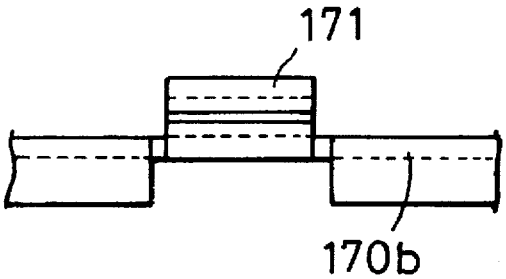

Although this embodiment has the structure such that the sheet bundle is brought into contact with the guide member 14*a* provided on the front cover 14 so as to be held (see FIG. 11 (*d*)), a similar effect may be achieved using a support portion 164, as shown in FIG. 46, provided on the erect portion 30*a* in front of the bin unit for contacting the end of the sheet bundle.

After the foregoing operations have been completed, if a detection signal supplied from the penetration sensor 151 identifies that a sheet exists, the aligning rod 41 maintains the position for holding the sheet bundle shown in FIG. 11 (*d*). As a result, when an operator takes out the sheet bundle from the bin tray, undesirable introduction of the sheet bundle between the bin trays can be prevented. After the sheet bundle has been removed by the operator, the detection signal supplied from the penetration sensor 151 identifies that no sheet exists. Thus, the aligning rod 41 is moved from the position for holding the sheet bundle to the home position (the relief position).

Condition for Relief Position for Aligning Rod

Figure 56:
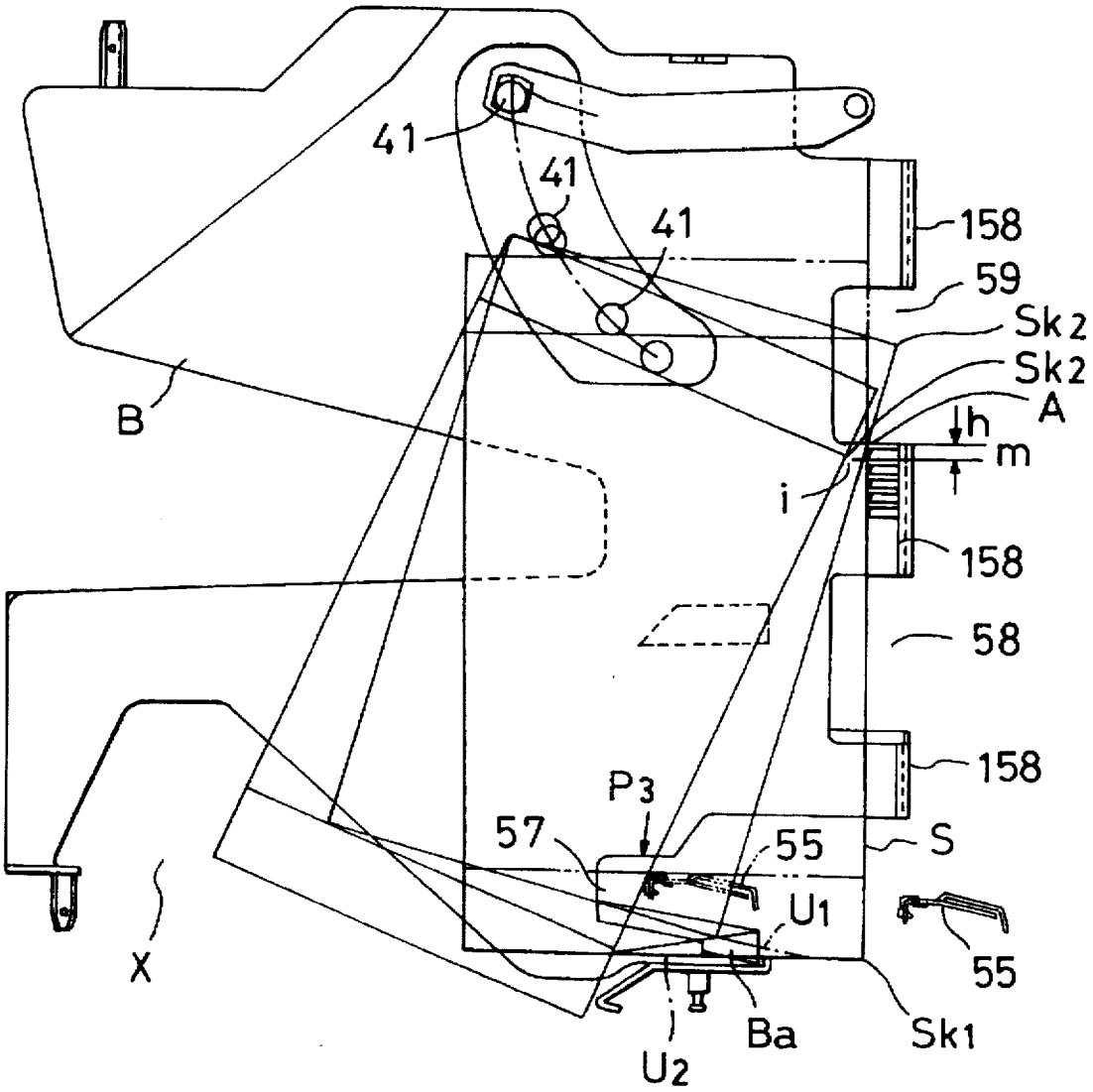
FIG. 56 is a top view showing a state (the locus) of the corner of a sheet when the sheet is pushed upwards.

To prevent introduction of the corner of the sheet in the front portion of the apparatus into the cut portion of the bin tray when the position of the sheet is changed to the inclined state by the reference guide 55 during the sheet-bundle pushing operation, the present invention has a structure such that the corner of the sheet is pushed upwards while being restricted between the bin trays. The structure will now be described with reference to the drawings. FIG. 56 shows a state where a small-size sheet bundle is pushed, and FIG. 57 shows a state where a large-size sheet bundle is pushed.

Figure 57:
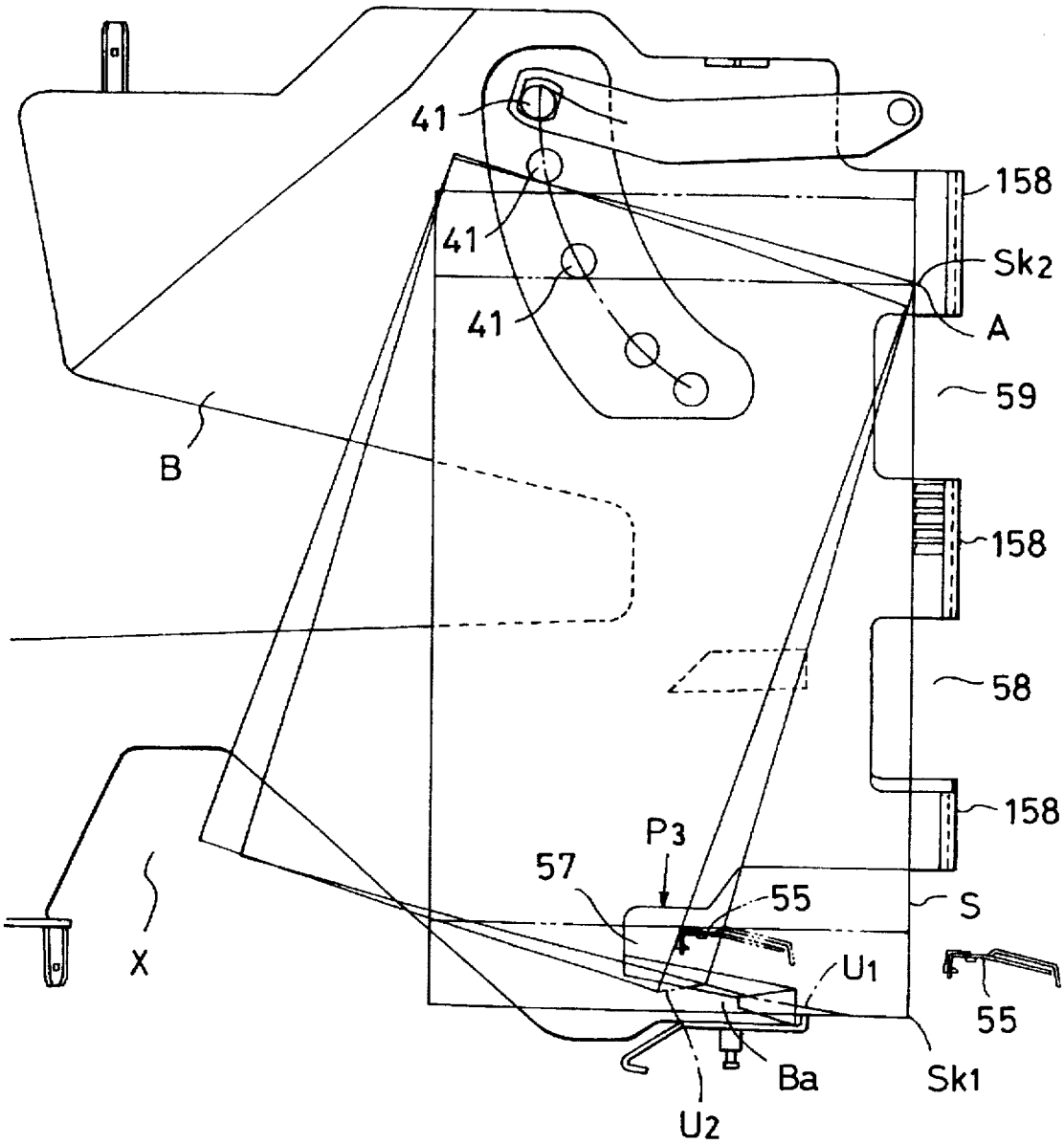
FIG. 57 is a top view showing a state (the locus) of the corner of a sheet when the sheet is pushed upwards.

As shown in FIGS. 56 and 57, the aligning rod 41 pushes inwards the sheet S to the front portion of the apparatus before it moves the sheet S upward. The sheet is pushed inwards to a position (the position out of the cut portion 57 in the bin tray B) where the sheet is pushed upwards in such a manner that the corner of the sheet is restricted between the bin trays when the sheet is pushed upwards. After the inward pushing operation has been completed, the aligning rod 41 is relieved to a predetermined relief position. The relief position for the aligning rod 41 is determined to a position at which the sheet is pushed upwards in such a manner that the corner $S_{K1}$ is restricted between the bin trays. Note that the quantity of pushing of the aligning rod 41 and the relief position for the same are determined appropriately to correspond to the size of the sheet intended to be discharged from the space X in the front portion of the apparatus.

Since the aligning rod 41 is moved as described above, the corner $S_{K1}$ of the sheet S pushed inwards to the front portion of the apparatus is, by the reference guide 55, pushed upwards through a first locus $U_1$, the first support point for rotation of which is position A of the stopper 158 on the bin tray B. Then, it is pushed upwards to the upward movement position $P_3$ through a second locus $U_2$, the second support point for rotation of which is the aligning rod 41 relieved to the foregoing position. As a result, as can be understood from the figure, the corner $S_{K1}$ of the sheet S does not pass through the cut portion 57 in the bin tray B but the same is moved on the surface Ba of the bin for stacking sheets S. Thus, the corner $S_{K1}$ of the sheet S is pushed upwards while being restricted between the bin trays. This prevents sheet S from entering into the cut portion 57 where bending or breakage of the sheet might otherwise occur.

Large-size sheets (for example, A4-sheets) among sheets (that can be taken from the front portion) that are pushed upwards by the reference guide 55 are, as shown in FIG. 57, pushed upwards in such a manner that the position A of the inner stopper 158 that comes in contact with the inner corner $S_{K2}$ of the sheet S is the first support point for the rotation; and the aligning rod 41 moved to the predetermined relief position is the second support point for the rotation. Accordingly, the corner $S_{K1}$ of the sheet S is restricted between the bin trays when the sheets S are pushed upwards. Small-size sheets (for example, B5-sheets) are, as shown in FIG. 56, pushed upwards in such a manner that the position A of the central stopper 158 that comes in contact with a portion of the rear end of the sheet serves as a first support point for the rotation and the aligning rod 41, moved to the predetermined relief position, serves as a second support point for the rotation. Thus, the sheets are pushed upwards similarly in such a manner that the corner $S_{K1}$ of the sheet S is restricted between the bin trays. Since the inner corner $S_{K2}$ of the sheets (regardless of the size) is positioned at the inner cut portion 59 for stapling or above the same when viewed in FIG. 56, the corner $S_{K2}$ of the sheet is pushed inwards to an inner position i by a distance h (>0) over a line m of the central stopper 158 when the sheets are discharged to the discharge position in the front portion of the apparatus by the aligning rod 41. As a result, even if the aligning rod 41 is relieved to the home position for the following process, undesirable introduction of the corner $S_{K2}$ of the sheet into the cut portion 59 can be prevented.

Figure 58:
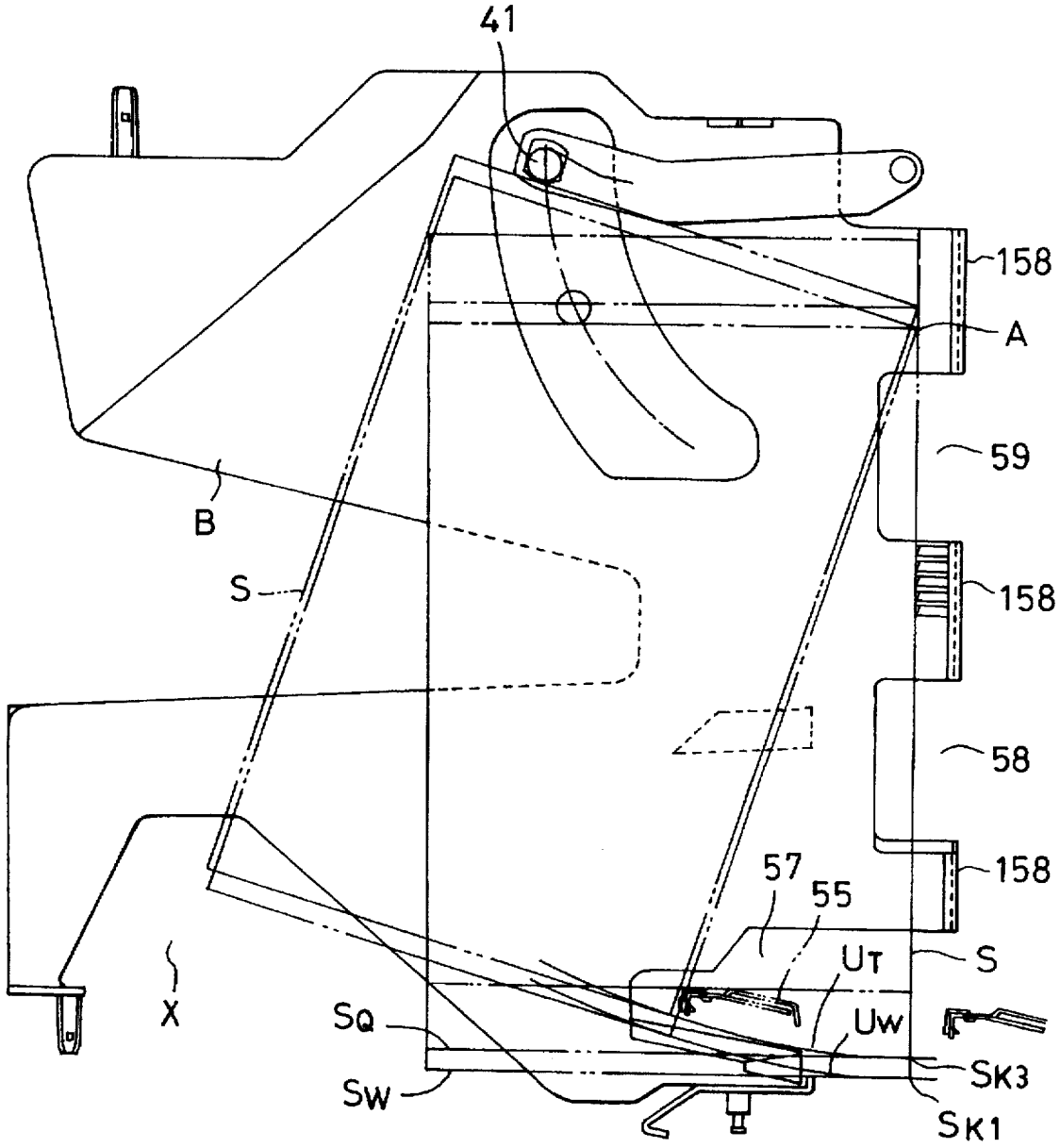
FIG. 58 is a top view showing a state (the locus) of the corner of a sheet when the sheet is pushed upwards.

A method will now be described with reference to FIG. 58 in which the aligning rod 41 is not used as the second support point for the rotation to prevent the introduction of the corner $S_{K1}$ of the sheet S into the cut portion 57. After the sheets S have been aligned, the reference guide 55 is relieved to allow aligning rod 41 to push the sheets S inwards. Since the pushing force is small at this time, and the locus $U_T$ of the corner $S_{K3}$ of the sheet S passes through position $S_Q$, that is, the cut portion 57, a similar problem arises.

Accordingly, sufficient inward pushing of the side end of the sheet to position Sw will cause the locus Uw of the corner $S_{K1}$ of the sheet S to move across the stacking surface $B_a$ of the bin tray. Thus, the foregoing problem can be overcome and the sheet bundle can be removed.

Inhibition Control of the Sheet-bundle Pushing Operation

As described above, the operation for pushing the sheet bundle is performed after the sorting and sheet aligning operations, as well as after the stapling operation if performed. If a sheet bundle having a thick paper cover (a cover mode) is sorted, the cover is initially sorted. If the cover is counted as one bundle when the foregoing operation for pushing the sheet bundle is performed, alignment with the sheet (copied sheet) to be discharged onto the cover cannot be established and stapling cannot be performed properly.

If the number of sheets of the sheet bundle discharged onto each bin tray exceeds a predetermined number of sheets after the sheets have been aligned and before the operation for pushing the sheet bundle is performed, the load acting on the aligning rod is enlarged excessively when the foregoing pushing operation is performed even if each bin tray has a sufficient stacking capacity. Thus, there arises a risk that the operation for pushing the sheet bundle cannot be performed smoothly and thus malfunction takes place.

Accordingly, the operation of pushing the sheet bundle by the aligning rod 41 to the front portion of the apparatus (the position at which the sheet bundle is taken) is inhibited by a control means (not shown), when one sheet is sorted (in a cover mode) or more than a predetermined number of sheets are sorted. The control for inhibiting the operation for pushing the sheet bundle will now be described with reference to flow charts shown in FIGS. 59 and 60.

One-Sheet-Sorting Mode (Cover Mode)

Figure 59:
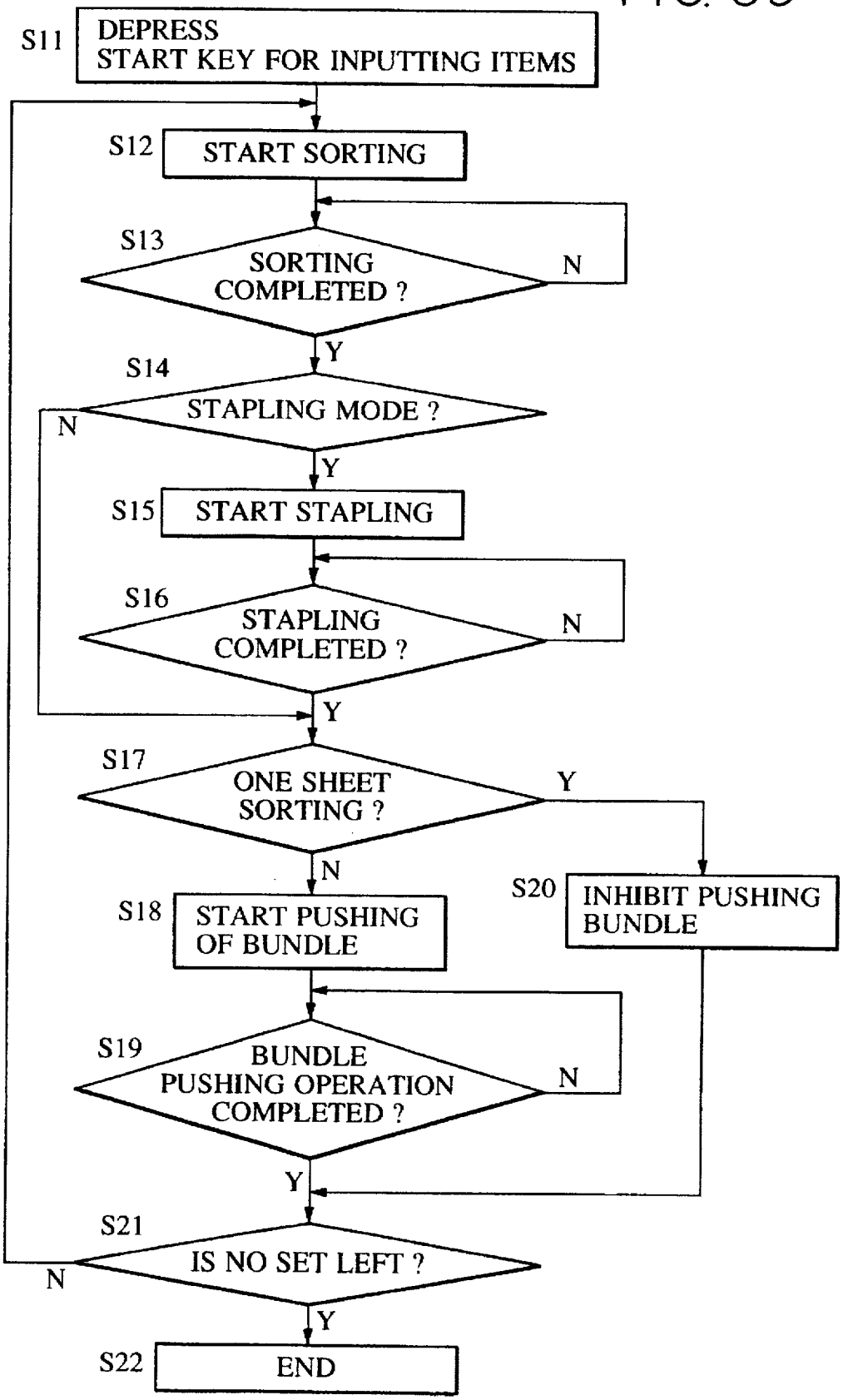
FIG. 59 is a flow chart showing a control operation for inhibiting pushing a bundle when one sheet sorting is performed.

As shown in FIG. 59, in step S11 the operator initially sets an original document on the apparatus for automatically feeding the original document shown in FIG. 1, inputs the number of sheets of the original document, the desired number of copies, and the modes through the operation portion (not shown) of the image processing apparatus, and then depresses the copy-start key. Note that the number of the sheets of the original document may also be determined by a control circuit in the image processing apparatus by idly circulating the original document by the apparatus for automatically feeding the original document.

In steps S12 and S13 sheets discharged from the body of the image processing apparatus are sorted. If the selected number of bundles is larger than the number of bin trays, the bundles are initially sorted by the number which is the same as the number of the bin trays. If the number is smaller the number of the bin trays, all of the bundles are sorted. Whenever the first sheet is sorted on each bin tray, the foregoing alignment of the sheet is performed.

In step S14 whether the set mode is the staple mode is discriminated. If the stapling mode is set, the operation proceeds to steps S15 and S16 in which the stapling operation, to be described later, is performed. If the stapling mode is not selected, the operation proceeds to step S17.

In step S17 whether one sheet sorting has been performed is discriminated. If the one sheet sorting operation has not been performed, the operation proceeds to steps S18 and S19 in which the reference guide 55 and the aligning rod 41 push the sheet bundle to the front portion of the apparatus where the sheet bundle is removed. If one-sheet sorting is performed, the foregoing operation for pushing the sheet bundle is inhibited (step S20) and the operation proceeds to step S21. As a result, even if the cover is sorted in the cover mode, the operation for pushing the sheet bundle is not performed. Even if a sheet on which an image has been copied is sorted, alignment with the cover can be performed.

In step S21 whether or not a predetermined number of bundles have been sorted is discriminated. If a predetermined number of bundles has been sorted, the operation of the apparatus is completed (step S22). If bundles to be sorted remain, the operation returns to step S12 in which the foregoing operation is repeated until all of the bundles are sorted.

Sorting of Sheets Larger than Predetermined Number

Figure 60:
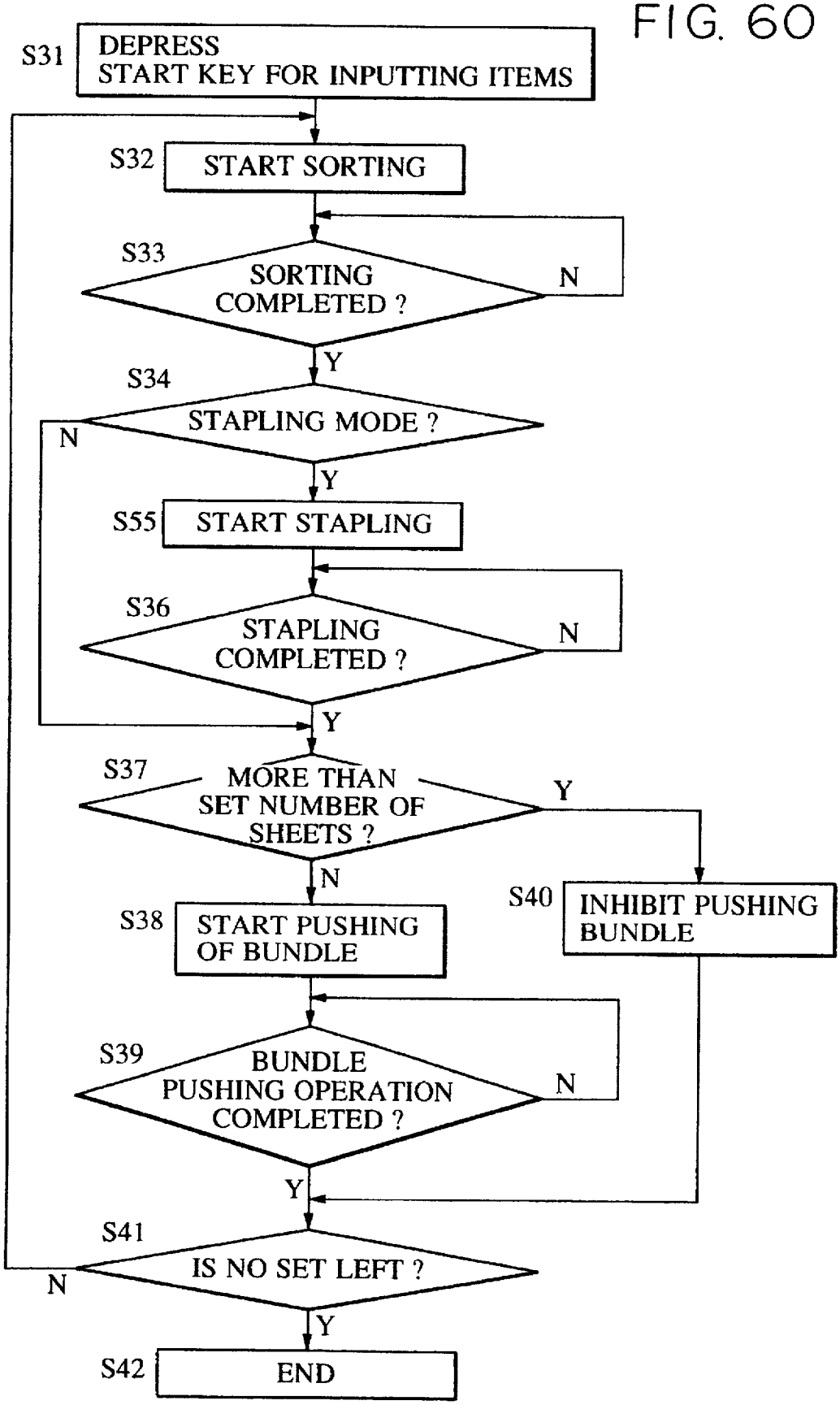
FIG. 60 is a flow chart showing a control operation for inhibiting pushing the bundle when sheets by a number larger than a predetermined number are sorted.

As shown in FIG. 60, in step S31 the operator initially sets an original document on the apparatus for automatically feeding the original document shown in FIG. 1, and inputs the number of sheets of the original document, the desired number of copies, and the modes using the operation portion (not shown) of the image processing apparatus, and then depresses the copy-start key. Note that the number of the sheets of the original document may also be determined by the control circuit in the image processing apparatus by idly circulating the original document by the apparatus for automatically feeding the original document.

In steps S32 and S33 sheets discharged from the body of the image processing apparatus are sorted. If the selected number of bundles is larger than the number of bin trays, the bundles are initially sorted by the number which is the same as the number of the bin trays. If the number is smaller the number of the bin trays, all of the bundles are sorted. Whenever the first sheet is sorted on each bin tray, the foregoing alignment of the sheet is performed.

In step S34 whether the set mode is the staple mode is determined. If the stapling mode is set, the operation proceeds to steps S35 and S36 in which the stapling operation, to be described later, is performed. If stapling has not been selected, the operation proceeds to step S37.

In step S37 whether or not a predetermined number of sheets have been sorted is discriminated (the number of sheets that can be pushed by the aligning rod). If the number of the sheets is smaller than the set number, the operation proceeds to steps S38 and S39 in which the reference guide 55 and the aligning rod 41 push the sheet bundle to the front portion of the apparatus where the sheet bundle is removed. If the number of sheets is larger than the set number, the foregoing pushing operation is inhibited (step S40), and operation proceeds to step S41. As a result, if the number of the sheets discharged onto each bin tray is larger than a predetermined number, the foregoing operation for pushing the sheet bundle is inhibited even if each bin tray has a stacking capacity. Thus, malfunction can be prevented.

The number of the sheets is the number of sheets instructed from the operation portion (not shown); the number of sheets calculated by multiplying the number of sheets of the original document and the number of copies (the maximum number is the number of the bin trays); or the number (counted number) of sheets detected by a sheet detection sensor provided for the sheet passage. In step S37 whether or not the number of the sheets is larger than a set number is determined.

In step S41 whether or not a predetermined number of bundles has been sorted is discriminated. If the predetermined number of bundles has been sorted, the operation of the apparatus is completed (step S42). If bundles to be sorted exist, the operation returns to step S32 in which the foregoing operation is repeated until no bundles remain.

Although the foregoing control operation is arranged in such a manner that the operation for pushing the sheet bundle is automatically inhibited under a certain condition, the present invention is not limited to this. For example, another structure may be employed in which an operation portion (not shown) for inputting a signal for inhibiting the operation for pushing the sheet bundle is provided; and a user inputs the signal from the operation portion to inhibit the operation for pushing the sheet bundle. Thus, the user is able to arbitrarily inhibit the operation for pushing the sheet bundle.

Non-Binding Sorting Mode

If non-binding sorting is performed except the foregoing operation, there is sometimes a case where binding is desired by an operator after sorting has been completed. If afterward binding is performed, it can be instructed by a setting means (not shown). If the operation for pushing the sheet bundle is automatically performed after the non-binding sorting operation has been completed when afterward binding is required, there arises a problem in that the operator cannot select binding.

Figure 61:
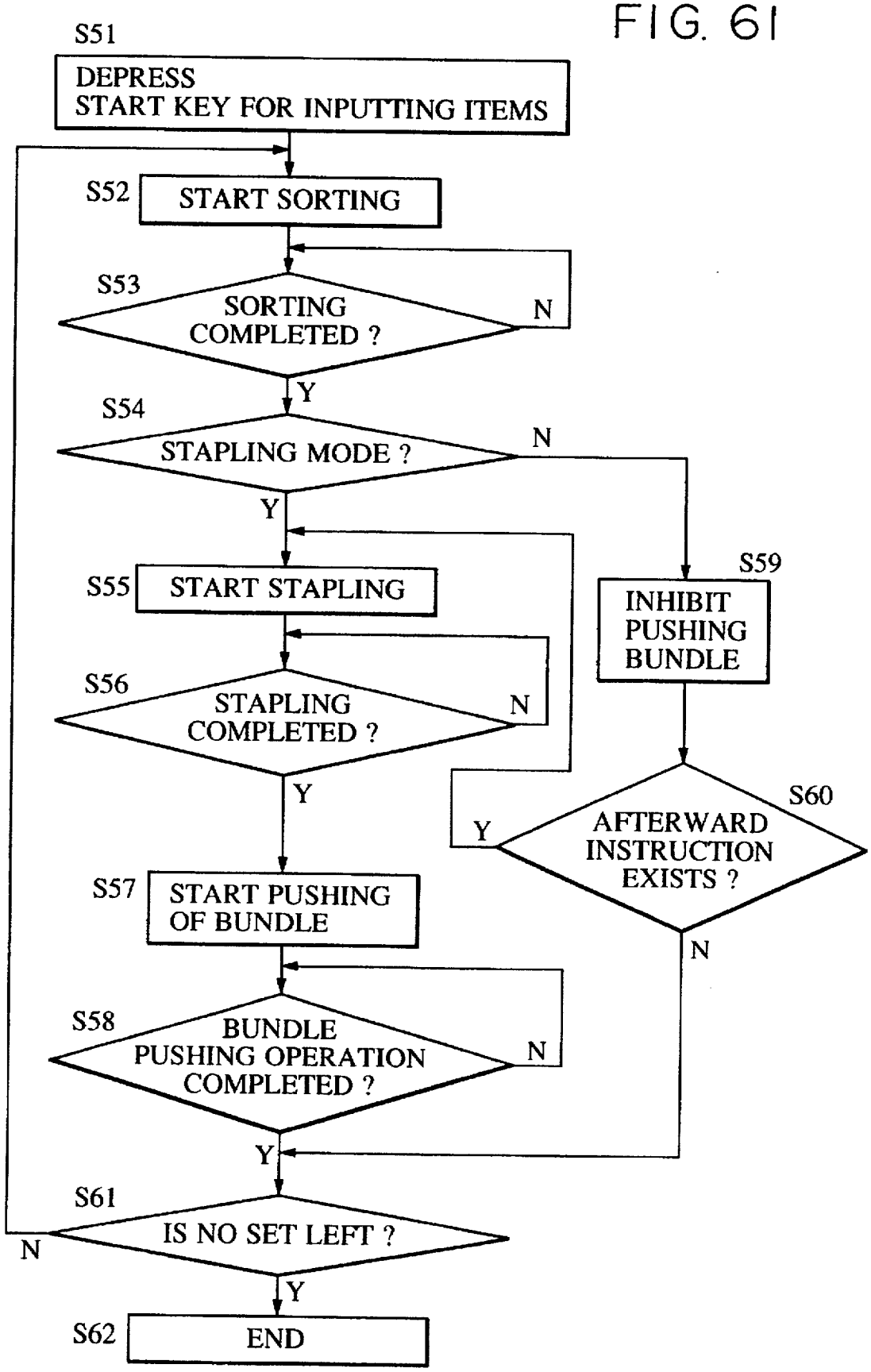
FIG. 61 is a flow chart showing a control operation for inhibiting pushing the bundle in a non-binding sorting mode.

Accordingly, it is effective to inhibit operation for pushing the sheet bundle under the foregoing condition. The foregoing case will now be described with reference to a flow chart shown in FIG. 61. As shown in FIG. 61, in step S51 the operator initially sets an original document on the apparatus for automatically feeding the original document shown in FIG. 1, inputs the number of sheets of the original document, the desired number of copies, and the modes using the operation portion (not shown) of the image processing apparatus, and then depresses the copy-start key. Note that the number of the sheets of the original document may also be determined by a control circuit in the image processing apparatus by idly circulating the original document by the apparatus for automatically feeding the original document.

In steps S52 and S53 sheets discharged from the body of the image processing apparatus are sorted. If the selected number of bundles is larger than the number of bin trays, the bundles are initially sorted by the number which is the same as the number of the bin trays. If the number is smaller than the number of the bin trays, all of the bundles are sorted. Whenever the first sheet is sorted on each bin tray, the foregoing alignment of the sheet is performed.

In step S54 whether the set mode is the staple mode is determined. If the stapling mode is set, the operation proceeds to steps S55 and S56 in which the stapling operation, to be described later, is performed. Then, the operation proceeds to steps S57 and S58 in which the reference guide 55 and the aligning rod 41 push the sheet bundle to the front portion of the apparatus, where the sheet bundle is removed. If the stapling mode has not been set, the operation for pushing the sheet bundle is inhibited (step S59) and the operation proceeds to step S60. As a result, the problem can be prevented that takes place in a case where stapling is intended to be performed by the afterward instruction after the non-bound sheet bundle has been sorted.

In step S60 whether or not the afterward instruction of the staple mode has been performed is discriminated. If the afterward instruction has been performed, the operation returns to step S55 in which the foregoing operation is repeated. If the afterward instruction has not been performed, the operation proceeds to step S61.

In step S61, whether the predetermined number of sheet bundles have been sorted is discriminated. If so, the operation of the apparatus is completed (step S62). If bundles to be sorted remains, the operation returns to step S51 in which the foregoing operation is repeated until the bundles are sorted.

Sorting of Plural Sheets (Front Cover and Rear Cover Mode

The foregoing control operation is arranged in such a manner that the operation for pushing the sheet bundle is inhibited when a cover is sorted. However, in a case where a rear cover is intended to be provided, if the operation for pushing the sheet bundle is performed before the rear cover is sorted onto the plurality of copied sheets sorted on the front covers though the operation for pushing the sheet bundle is inhibited, defective alignment of the sheets and malfunction may take place.

Figure 62:
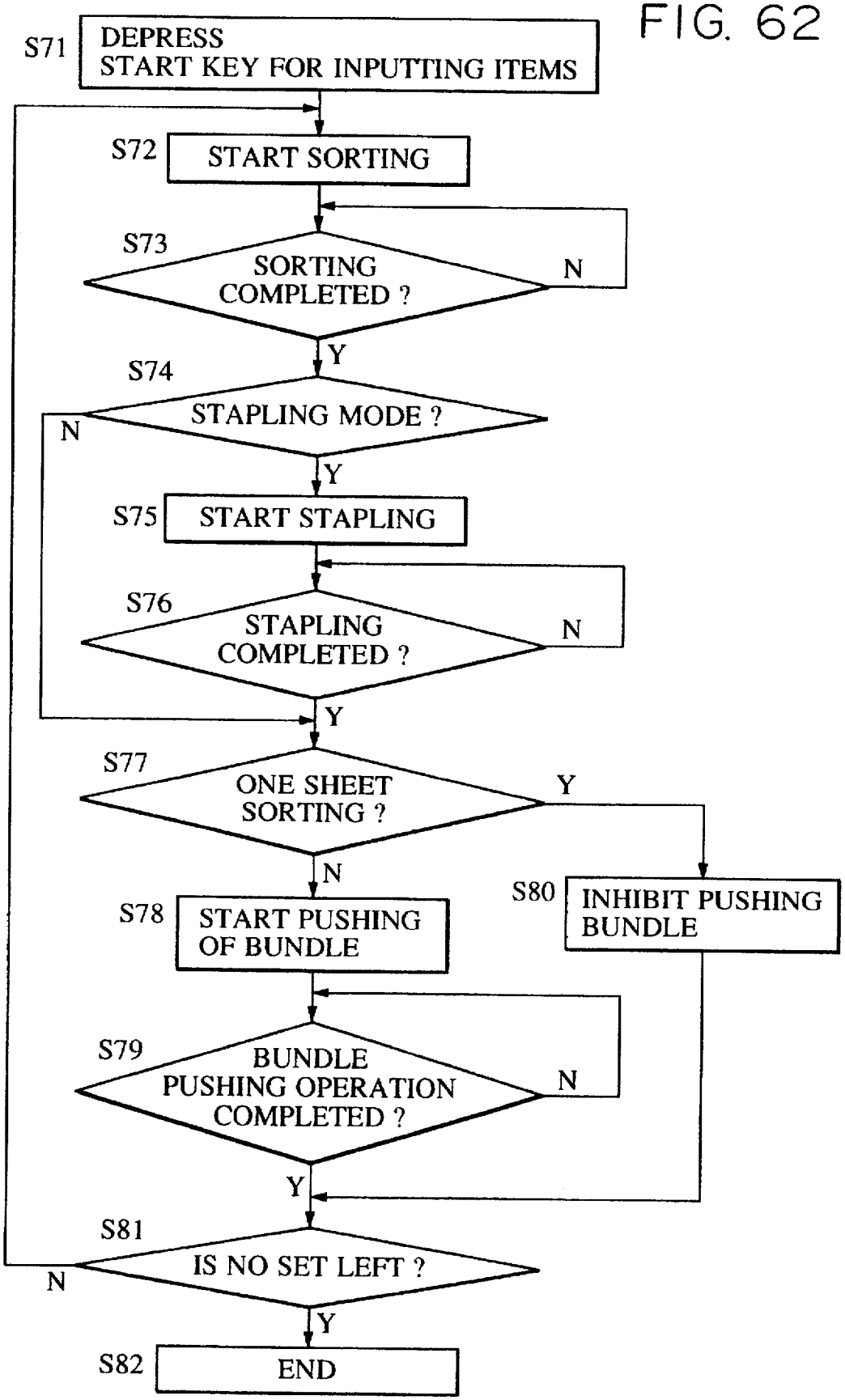
FIG. 62 is a flow chart showing a control operation for inhibiting pushing the bundle when one sheet is sorted after a plurality of sheets have been sorted.

Accordingly, it is effective to inhibit the operation for pushing the sheet bundle under the foregoing condition. The foregoing operation will now be described with reference to a flow chart shown in FIG. 62. As shown in FIG. 62, in step S71 the operator initially sets an original document to the apparatus for automatically feeding the original document shown in FIG. 1, and inputs the number of sheets of the original document, the desired number of copies, and the modes using the operation portion (not shown) of the image processing apparatus, and then depresses the copy-start key. Note that the number of sheets of the original document may be determined by the control circuit in the image processing apparatus by idly circulating the original document by the apparatus for automatically feeding the original document.

In steps S72 and S73 sheets discharged from the body of the image processing apparatus are sorted. If the number of bundles is larger than the number of bin trays, the bundles are initially sorted by the number which is the same as the number of the bin trays. If the number is smaller the number of the bin trays, all of the bundles are sorted. Whenever the first sheet is sorted on each bin tray, the foregoing alignment of the sheet is performed.

In step S74 whether the set mode is the staple mode is determined. If the stapling mode is set, the operation proceeds to steps S75 and S76 in which the stapling operation, to be described later, is performed. If the stapling mode has not been selected, the operation proceeds to step S77.

In step S77 whether or not one sheet is sorted on to the sorted sheet bundle (the front cover and rear cover mode) is discriminated. If the one-sheet sorting is not performed, the operation proceeds to steps S78 and S79 in which the reference guide 55 and the aligning rod 41 push the sheet bundle to the front portion of the apparatus where the sheet bundle is removed. If one-sheet sorting is performed, the operation for pushing the sheet bundle is inhibited (step S80) and the operation proceeds to step S81. As a result, even if a front cover is sorted in the front cover and rear cover mode and then a plurality of sheets are sorted, the operation for pushing the sheet bundle is not performed. Therefore, even if the rear cover is sorted after the sorting operation has been performed, alignment with the sheet bundle can be performed.

In step S81 whether or not a predetermined number of bundles has been sorted is discriminated. If the predetermined number of bundles has been sorted, the operation of the apparatus is completed (step S82). If bundles to be sorted exist, the operation returns to step S71 in which the foregoing operations are repeated until no residual bundle remains.

In a case where one sheet is sorted after a plurality of sheets have been sorted and then a plurality of sheets are sorted in order to provide a guard sheet, it is effective to inhibit the operation for pushing the sheet bundle. As a result, defective alignment of the sheets and malfunction can be prevented.

Bin Tray

Forming of Bin Tray into Warped Shape

Referring now to FIGS. 12 (*a*) through 12 (*d*), the rigidity of the bin tray B to be accommodated in the bin unit 17 deteriorates due to the cut portion and the like, and therefore it is deflected due to the weight of the stacked sheets and the like. Thus, there arises a risk that the surface for stacking the sheets cannot be maintained to be horizontal. If the bin is warped downwards, the sheets S discharged through a discharge roller pair 951, as shown in FIG. 12 (*d*) in a direction indicated by an arrow 952, are brought into contact with a bin warped downwards (alternate long and one short dash line Bd), thus causing a defect to take place in the discharge operation. Accordingly, some bins have somewhat upward warped portions to prevent the same being warped downwards. However, the bin tray B according to the present invention is intended to prevent its deflection due to the deterioration in the rigidity thereof by compensating the degree of deflection (downward warp) due to the deadweight of the stacked sheets by previously upwards warping (upward warp) the shape thereof before it is installed in the bin unit 17, as shown in FIG. 12 (*a*). As a result, when the bin tray B is accommodated in the bin unit 17, the surface for stacking the sheets is made to be horizontal as shown in FIG. 12 (*b*). Therefore, an excellent sheet stacking characteristic can be obtained.

Sharp Form of Stopper

Figure 13:
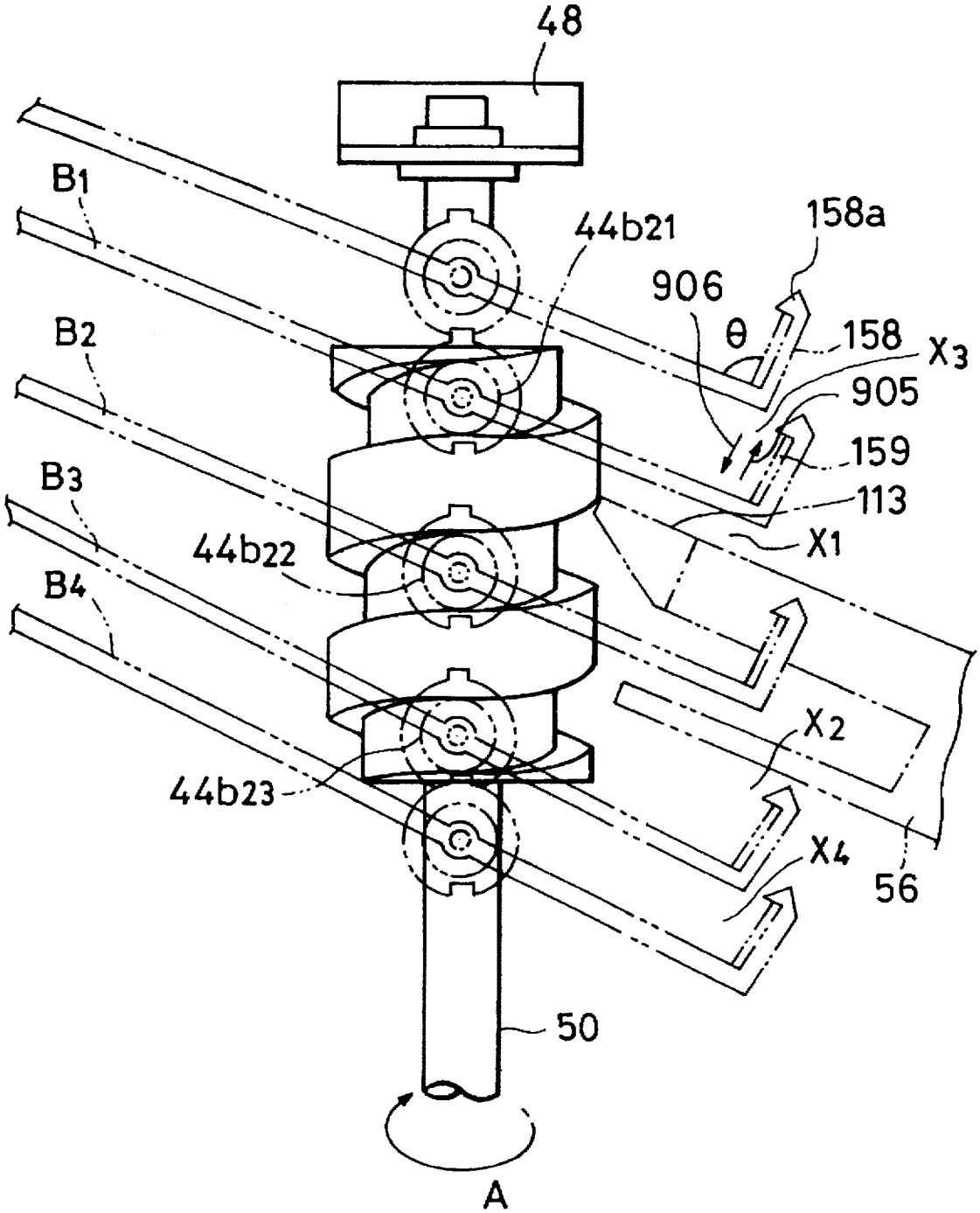
FIG. 13 is a side view showing an operation of opening the bin tray by a lead cam of the sheet processing apparatus.
Figure 41A:
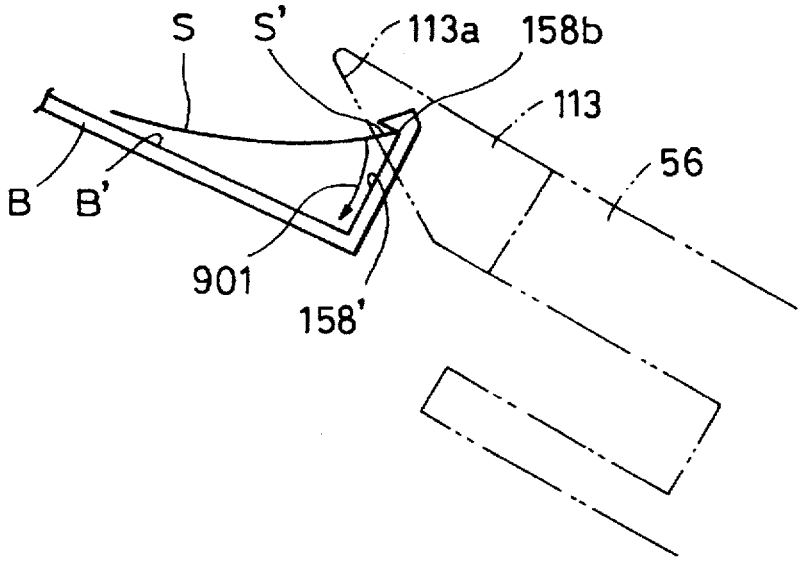
FIGS. 41 (*a*), 41 (*b*) and 41 (*c*) are schematic views showing a portion near the stopper of the bin tray.
Figure 41B:
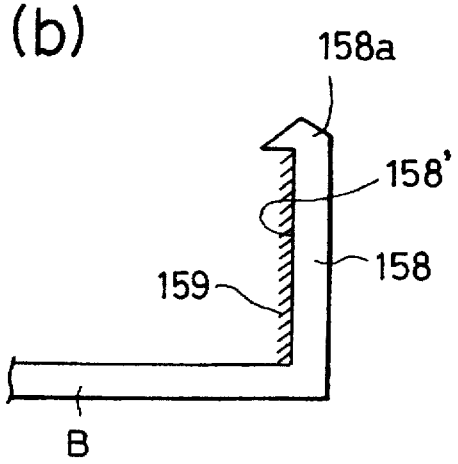
Figure 41C:
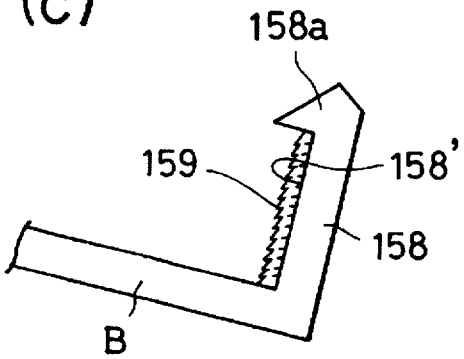

Referring now to FIGS. 13 and 41 (*a*), since the bin tray B is set while being inclined in such a manner that the upstream portion thereof is made lower than the downstream portion thereof in the sheet discharge direction when it is accommodated in the bin unit 17, a stopper 158 is provided in the most upstream position for the purpose of maintaining the end of the sheet. The stopper 158 forms a sharp angle θ with the sheet stacking surface (see FIG. 13). As a result, upward projection of the end of the sheet warped after the discharge can be prevented. In a case where the sheet bundle is stapled by the stapler 56 and in a case where a guide surface 113*a* (see FIG. 41 (*a*)) of an upper guide member 113 provided on the upper portion of the stapler 56 is used to push raised point S' at the rear end of the sheet S toward the stacking surface B' of the bin B, the point S' tends to be moved in a direction indicated by an arrow 901. Since the surface 158' of the stopper 158 is formed into a shape that is widened in the downward direction as compared with the right angle stopper, the rear end S' of the raised sheet S can be smoothly pushed and the sheets S can be stapled without disorder of the sheet bundle (see FIGS. 13 and 41 (*a*)). It is preferable that the angle θ be 90° or smaller, more preferably about 80°.

Friction Member Provided for Stopper

On the surface of the stopper 158 that contacts the sheet, a friction member 159 is bonded in order to prevent the end of the sheet from being moved upwards. The friction member 159, as shown in FIG. 13, comprises a felt-like member that restricts the movement in the direction indicated by an arrow 905 with respect to the upward movement of the sheet. Specifically, the friction member 159 may be made of suede or sponge having a high coefficient of friction. The friction member 159 bonded to the surface of the stopper 158 is provided in such a manner that it is continuously attached to the surface of the stopper 158 over the widthwise direction of the sheet or it is divided into sections to be bonded. Note that it is preferable that the friction member 159 be a one-way restriction member that can be moved in a direction indicated by an arrow 906 and that cannot be moved in a direction indicated by an arrow 905. For example, it may be a hair-transplant member having downward hairs (see FIG. 41 (*b*) or a ratchet-shape member (see FIG. 41 (*c*)).

Hooked Portion of Upper Portion Stopper

Figure 40A:
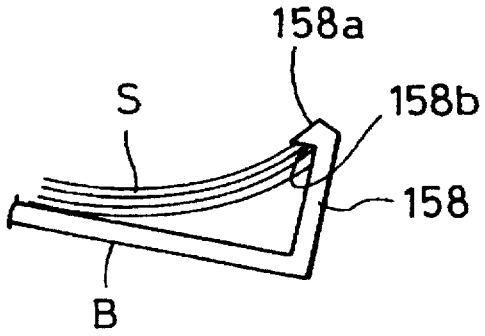
FIGS. 40 (*a*) and 40 (*b*) are diagrams showing a hooked portion of a stopper of the bin tray.
Figure 40B:
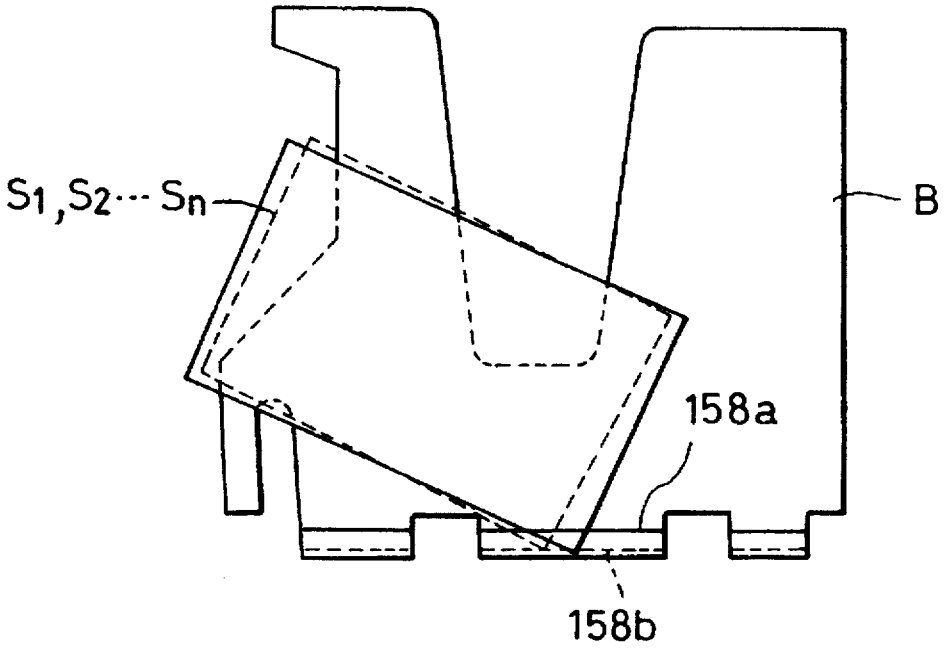

A hooked portion 158*a* for restricting the end of the sheet warped upwards after it has been discharged is formed in the upper portion of the stopper 158. The hooked portion 158*a* according to this embodiment is, as shown in FIG. 6, formed in substantially the central portion of the bin tray B in the direction (a direction perpendicular to the sheet discharge direction) of the width of the sheet or formed continuously to cover the overall surface. As a result, the hooked portion 158*a* is able to correspond to sheets having a variety of sizes. The hooked portion 158*a* includes a corner 158*b* for preventing the sheet adjacent to the stopper, as shown in FIG. 11 (*d*), from being placed on the upper surface of the stopper (see FIG. 40 (*a*). Thus, it is effective to stack a plurality of portions S1, S2, . . . , Sn on the bin (see FIG. 40 (*b*)).

Shape of Bin Roller

Figure 14:
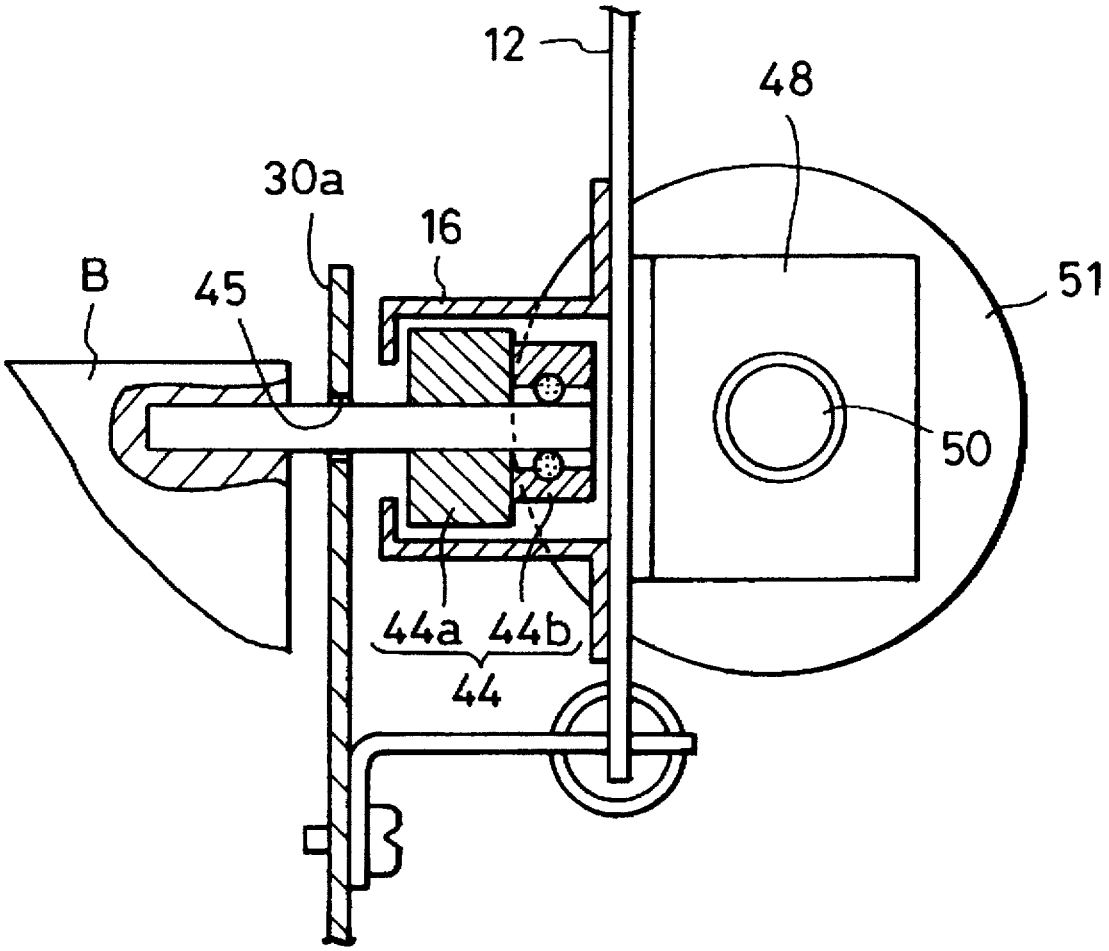
FIG. 14 is a horizontal plan view showing a bin roller attached to the bin tray, a trunnion and a lead cam for rotating the bin roller.

Each bin tray B accommodated in the bin unit 17 has, at the two ends of the base portion thereof, bin rollers 44*a*, as shown in FIG. 6. Furthermore, trunnions 44*b* each having a diameter smaller than that of the bin roller 44*a* are rotatively disposed on the outside of the bin rollers 44*a*. The bin rollers 44*a* and the trunnions 44*b* project over a slit 45 formed in an erected portion 30*a* of the bin frame 30, and the bin rollers 44*a* are introduced in such a manner that they are stacked on the guide rail 16 (see FIGS. 13 and 14).

Figure 15A:
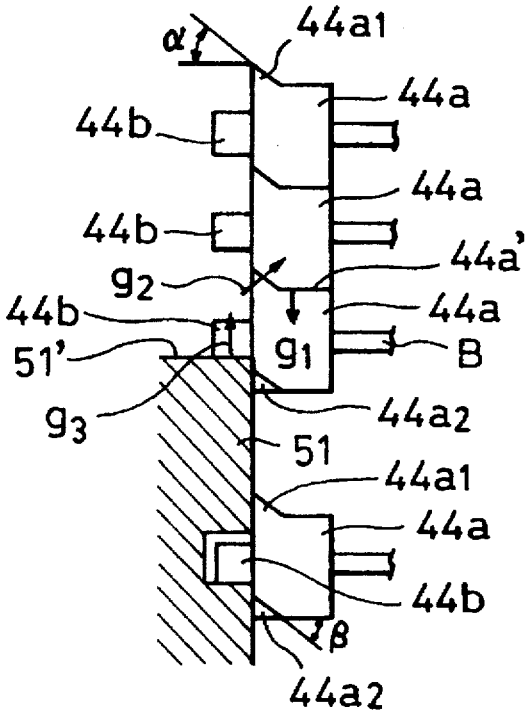
FIGS. 15 (*a*), 15 (*b*) and 15 (*c*) are schematic side views showing the relationship between bin rollers attached to the bin tray.
Figure 15B:
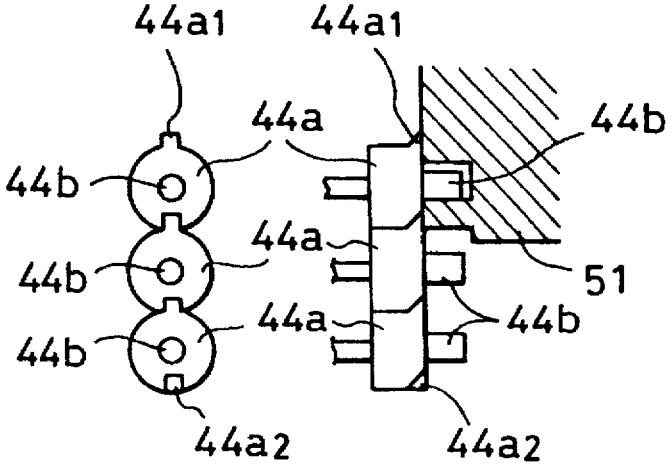
Figure 15C:
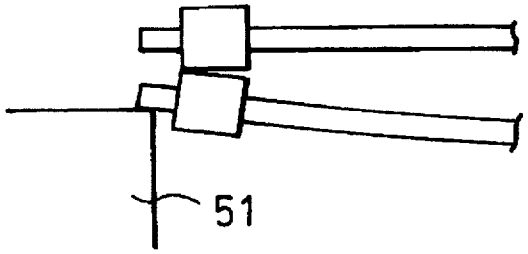

As shown in FIGS. 15 (*a*) and 15 (*b*), each bin roller 44*a* has, on the outer surface thereof, a projection 44*a*1 in the upper portion; and a recess 44*a*2 formed in the lower portion thereof so that the projection and the recess of the upper and lower bin rollers 44*a* are engaged to each other so as to be secured. The bin roller 44*a* has a member (not shown) for restricting the rotation in the circumferential direction so that the position in the circumferential direction is maintained as illustrated. As a result, the bin roller 44*a* is stacked on the guide rail 16 so that the bin B supported by a lead cam surface 51' of a lead cam 51 receives the load (arrow g1) of all upper bins by an upper surface 44*a*' of the bin roller, as shown in FIG. 15 (*a*). If the projections and recess are not provided, the lowermost bin B is deflected, as shown in FIG. 15 (*c*). However, the engaged portion realized by the projection and the recess receives (arrow g2) the force of deflecting as shown in FIG. 15 (*a*) so that deflection (downward warp) of the bin tray due to the weight is prevented.

Figure 42A:
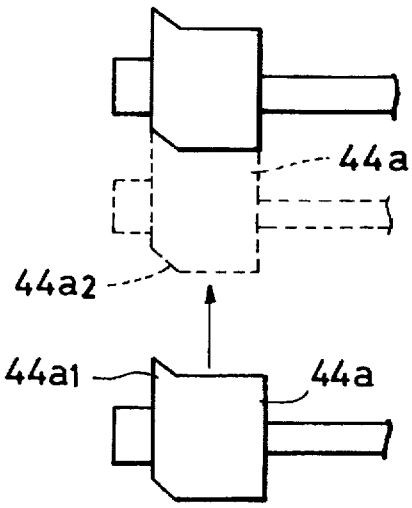
FIGS. 42 (*a*), and 42 (*b*) are schematic views showing a state where the projections and recesses of the bin rollers approach and move apart from each other.
Figure 42B:
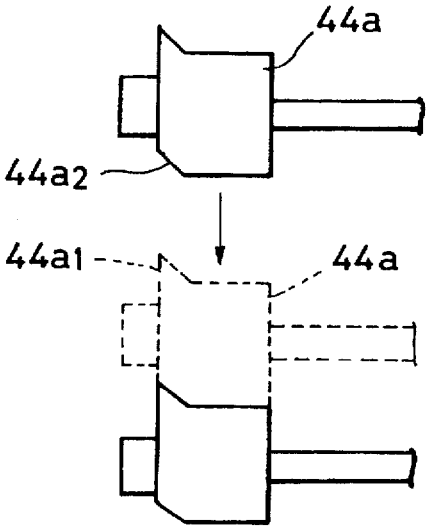

Angles α and β made between the projection 44a1 and the recess 44a2 are determined to be substantially 45° to easily introduce the projection 44a1 and the recess 44a2 when the separated bin roller 44a is brought to the contact state (see FIGS. 42 (*a*) and (*b*). It is preferable that the angles be 45°±30°.

Figure 43A:
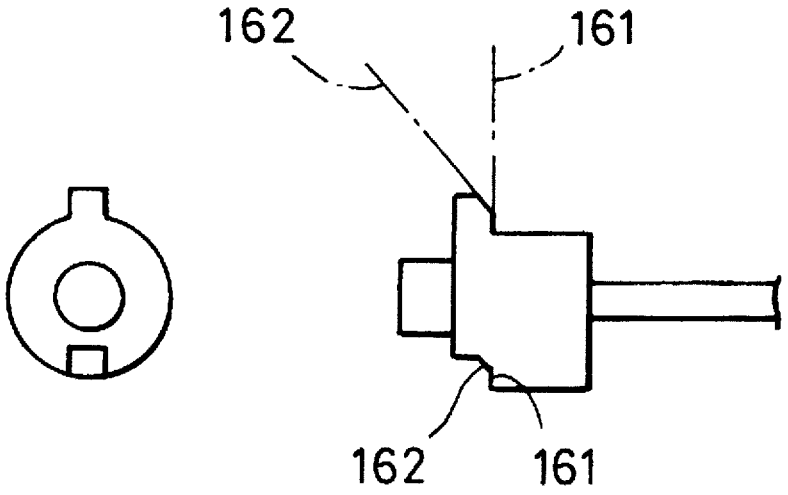
FIGS. 43 (*a*) and 43 (*b*) are diagrams showing the other shapes of the projections and recesses of the bin rollers.
Figure 43B:
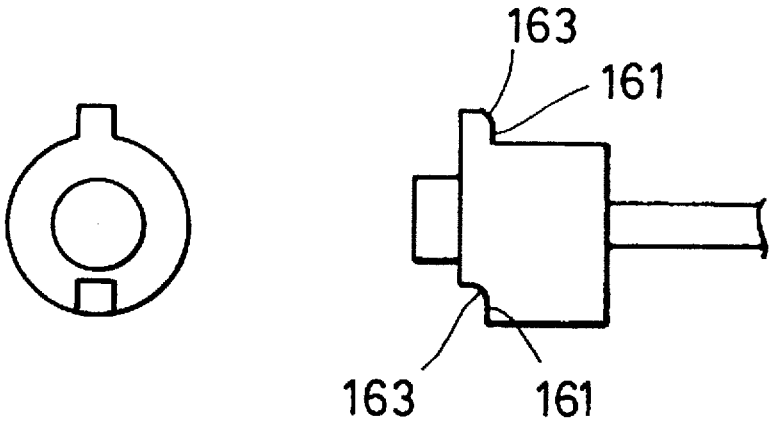

Although the foregoing embodiment according to the present invention has the structure such that the substantially 45° projections and recesses on the outer surface of the bin roller 44a, the projection and the recess may be formed to comprise a substantially right-angle portion 161 and an inclined portion 162, as shown in FIG. 43 (*a*). As a matter of course, a projection and a recess having the substantially right-angle portion 161 and an rounded portion 163 may be employed to obtain a similar effect.

The lowermost bin roller 44a is brought into contact with the lower guide roller 46a (shown in FIG. 6) supported by the erected portion 30a of the bin frame 30, while the uppermost bin roller 44a is brought into contact with the upper guide roller 47a supported by the erected portion 30a of the bin frame 30. Thus, each bin tray B is supported by the bin unit 17 in such a manner that the bin intervals are the same as the diameter of the bin roller 44a.

Thus, the upper guide roller 47a and the lower guide roller 46a are introduced into the guide rail 16 so that the bin unit 17 is able to move vertically along the guide rail 16. Furthermore, trunnions 46b and 47b each having a diameter smaller than that of each guide rollers 46a and 47a are rotatively disposed on the outsides of the guide rollers 46a and 47a. The trunnions 46b and 47b are guided by a lead cam 50 to enable the bin unit 17 to be moved vertically.

By making the diameter of the trunnion 44b (and trunnions 46b and 47b) to be smaller than the diameter of the bin roller 44a (and guide rollers 46a and 47a), when the lead cam 51 is used to vertically move each bin tray B maintained at predetermined intervals, that are the same as the diameter of the bin roller 44a, the operation of scooping the trunnion 44b by a spiral cam surface of the lead cam 51 can be performed smoothly (or easily introduced). That is, the vertical movement of the bin tray B by the lead cam can be performed smoothly.

At positions of the front and rear side plates 12 that faces the lower discharge roller pair 22, there are disposed cam shaft holders 48, as shown in FIGS. 2 and 3. Between the cam shaft holder 48 and the base 13, there is rotatively disposed each lead cam shaft 50 through a bearing 49 that bears the thrust load. Above the lead cam shafts 50, there are disposed lead cams 51 each having a spiral cam surface, while a sprocket 52 is secured below the same. Between the sprocket 52 and a shift motor 53, a chain 54 is arranged so that the lead cam 51 is rotated forwards or backwards by the shift motor 53 that is selectively rotated forwards or backwards.

The lead cam 51 is so disposed as to face the lower discharge roller pair 22 disposed in substantially the central portion of the sorter body 15. The lead cam 51 places, on the spiral cam surface thereof, the trunnion 44b of each bin tray B, that is moved to a position to oppose the lower discharge roller pair 22, to guide the trunnion 44b. Thus, the bin roller 44a disposed coaxial with the trunnion 44b is moved vertically along the guide rail 16 (see FIGS. 13 and 14). For example as shown in FIG. 13, one rotation of the lead cam 51 in a direction indicated by an arrow A moves the trunnion $44_{23}$ to an intermediate position of the lead cam 51 (the position $44_{22}$). A further rotation moves the same to a position (position $44_{21}$) that passes the lead cam 51. Between the bin tray $B_2$, that has received the sheet from the lower discharge roller pair 22 at a position that faces the lower discharge roller pair 22 and the bin trays $B_1$ and $B_3$ disposed above and below the bin tray $B_2$, opening portions $X_1$ and $X_2$, each of which is wider than the interval of the other bin trays B, are formed.

Paper Retaining Means

After the sheet has been discharged onto the bin tray $B_2$ that has the opening $X_1$, the bin tray is usually moved upwards or downwards. In a case where the bin tray is moved upwards, the bin tray $B_2$ is moved upwards to the position of the bin tray $B_1$ shown in FIG. 13 so that a narrow opening $X_3$ is formed. In a case where the bin tray is moved downwards, the bin tray $B_2$ is moved downwards to the positions $B_3$ and $B_4$. When the bin tray has been moved downwards to the position $B_4$, the bin tray forms a narrow opening $X_4$. If a sheet is discharged in such a manner that the end is projected upwards, this sheet blocks the discharge of the next sheet. Therefore, sheets cannot accurately be discharged and stacked. If the bin tray once forms the narrow opening $X_3$ and $X_4$, the projecting end of the sheet is pressed. Thus, the sheet does not block the sheet to be discharged next. When moving direction of bin trays $B_1$, $B_2$, . . . , $B_n$ is switched, that is, wide opening portions temporarily form. Thus, the sheet S is undesirably discharged before a narrow opening is formed after the sheet has been discharged.

Figure 16:
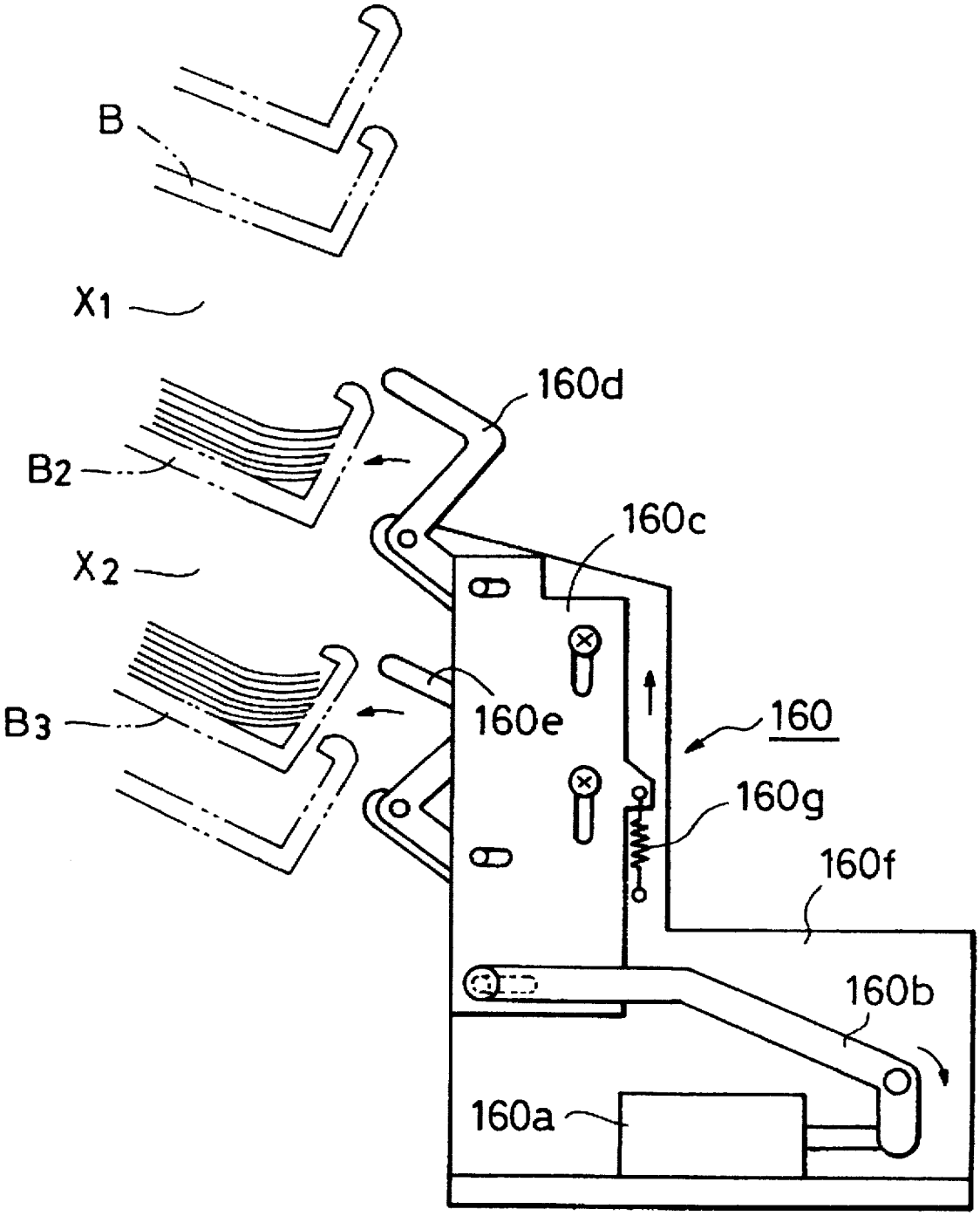
FIG. 16 is a diagram showing the structure of a sheet retaining mechanism.
Figure 17:
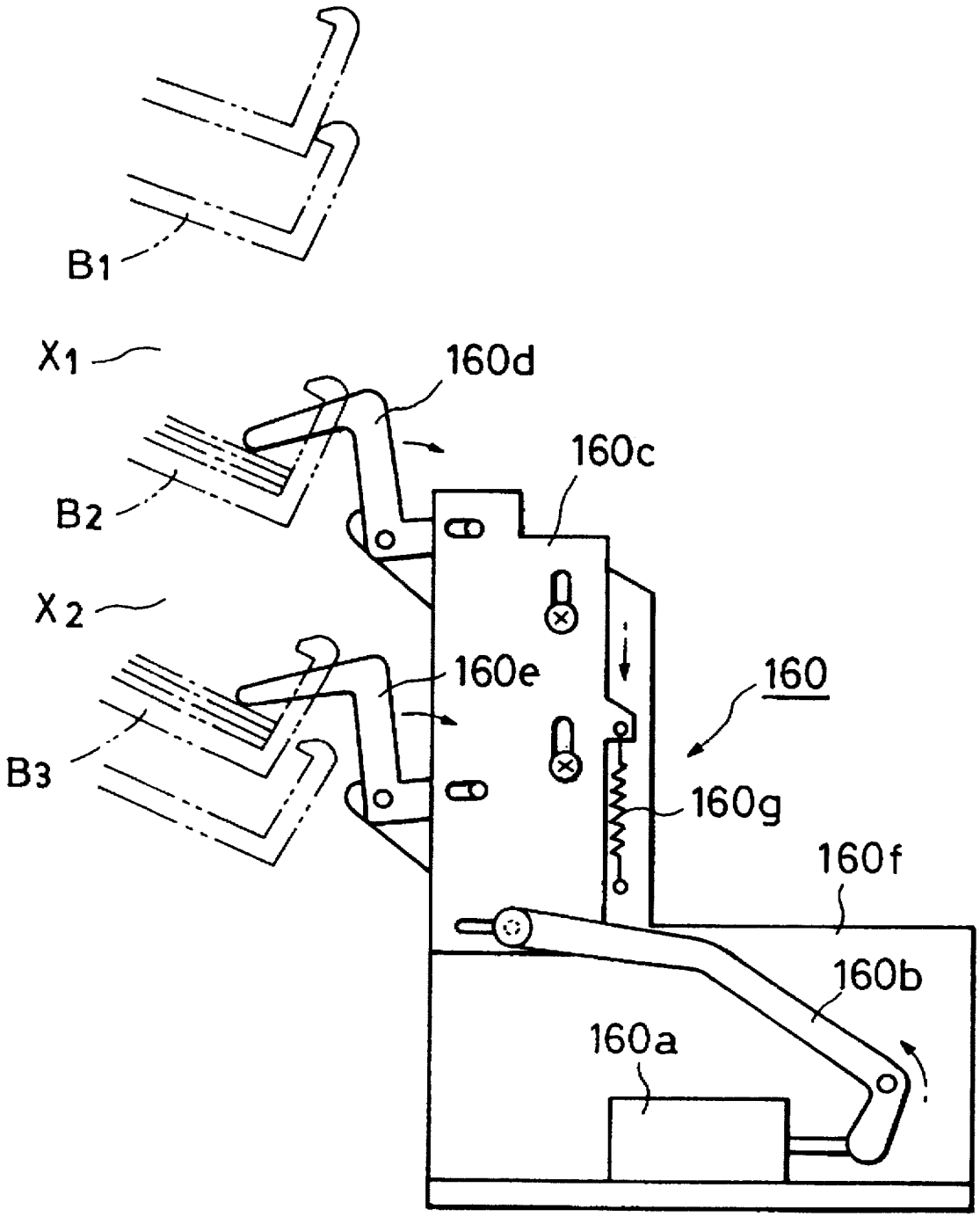
FIG. 17 is a diagram showing the structure of the sheet retaining mechanism.

Accordingly, as shown in FIGS. 16 and 17, the present invention comprises a paper retaining means 160 for pressing the sheet on the bin tray in the openings $X_1$ and $X_2$. Thus, even if the direction in which the bin tray is moved is changed, the end of the sheet can be held.

In a so-called group mode, in which a plurality of sheets are continuously discharged on to one bin tray, the opening in the bin tray is not narrowed and therefore the next sheet can be discharged. Therefore, the paper retaining means 160 is operated whenever the sheet is discharged so as to hold the end of the sheet.

In a case where a sorter is connected to an image processing apparatus in which is sheet is curled considerably, if the end of the sheet is temporarily held by the narrow opening, the end of the sheet is sometimes moved upwards due to vibrations occurring when the bin tray is moved. Accordingly, the present invention has a structure such that, if a sheet that is curled considerably, is used, the bin tray is moved to operate the paper retaining means 160 before the next sheet is discharged so as to hold the end of the sheet.

As for the sheet in the opening $X_1$ (between the bin trays $B_1$ and $B_2$) of the bin tray $B_2$, and the sheet in the opening $X_2$ (between the bin trays $B_2$ and $B_3$) of the bin tray $B_3$, if the end of the sheet is warped and moved upwards after the sheet has been discharged, the upper and lower jaws of the stapler 56 (shown in FIG. 13), that is introduced into the openings $X_1$ and $X_2$, undesirably outwards pushes the sheets on the bin trays $B_2$ and $B_3$. In this embodiment, the paper retaining means 160 holds the end of the sheet between the stapler 56 is introduced into the openings $X_1$ and $X_2$.

The paper retaining means 160, as shown in FIG. 16, comprises a solenoid 160a, an arm 160b that is rotated when the solenoid 160a is turned on/off, a sliding member 160c that is moved vertically when the arm 160b is rotated, an upper retaining member 160d and a lower retaining member 160e that are rotated when the sliding member 160c is moved vertically.

Referring to FIG. 16, reference numeral 160f represents a support frame that has a bottom to which the solenoid 160a is secured and which rotatively supports the arm 160b.

Furthermore, the support frame 160f has, in the side portion thereof, the retaining members 160d and 160e that are rotatively supported; and the sliding member 160c that is slidably supported by a screw. A portion of the support frame 160f and a portion of the sliding member 160c are connected to each other by a spring 160g so that the sliding member 160c is pulled downwards.

In the paper retaining means 160, when the solenoid 160a is turned on, the sliding member 160c in the state shown in FIG. 16 is moved upwards against the force of the spring 160g and the retaining members 160d and 160e are rotated to the retaining positions. Thus, as shown in FIG. 17, the ends of the sheet bundles on the bin trays $B_2$ and $B_3$ are held. If the solenoid 160a is turned off, from the state shown in FIG. 17, the restoring force of the spring 160g moves downwards the sliding member 160c so that the retaining members 160d and 160e are rotated to the relief positions. Thus, as shown in FIG. 16, holding of the end of the sheet bundles on the bin trays $B_2$ and $B_3$ is again suspended.

Since the paper retaining means 160 holds the sheets in the openings $X_1$ and $X_2$ on the bin trays $B_2$ and $B_3$, sheet jamming occurring due to the end of the sheet moved upwards on the bin tray, and undesirable outward pushing of the sheets on the bin trays $B_2$ and $B_3$ by the upper and lower jaws of the stapler 56, that is introduced into the openings $X_1$ and $X_2$, can be prevented so that the sheet discharge conveyance operation and the stapling operation are performed smoothly.

Figure 20:
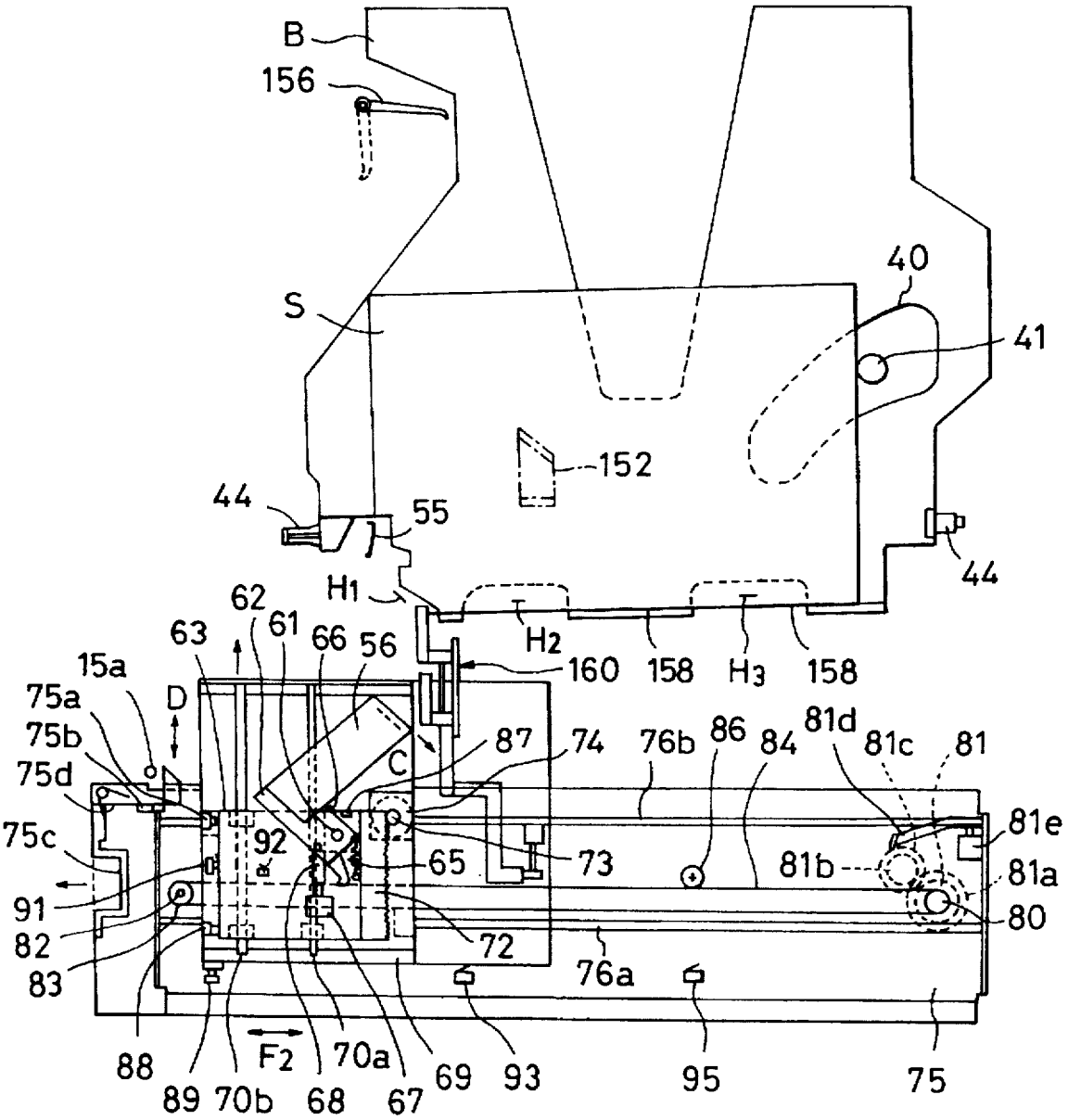
FIG. 20 is a plan view showing the stapler portion and the bin tray portion.

The paper retaining means 160 having the foregoing structure is disposed adjacent to the stapler 56 so as to be moved in the direction of the width of the sheet (in a direction perpendicular to the sheet discharge direction) together with the stapler 56 (see FIG. 20). As a result, the end of the sheet is always held at a position near the stapling position. Therefore, the pushing outwards of the sheet by the stapler 56 can be further reduced.

In this embodiment, the paper retaining means is used to improve the conveying and stacking characteristics and to prevent outward pushing by the stapler 56. Alternatively, individual paper retaining means may be provided for each purpose.

Stapler

Figure 18:
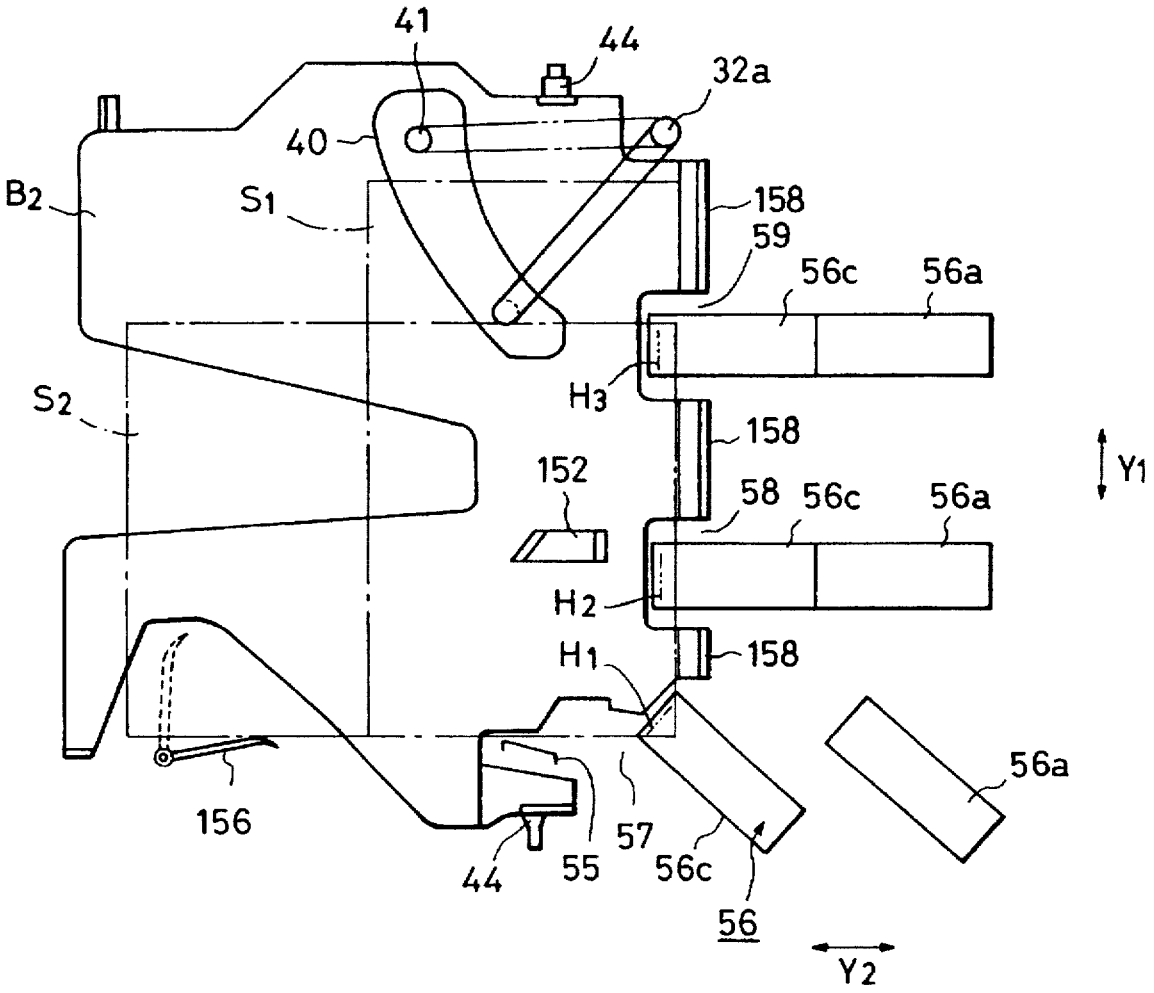
FIG. 18 is a plan view showing a bin tray portion of the sheet processing apparatus.

As shown generally in FIG. 3, the sorter body 15 has an electric stapler 56 disposed to face the bin B that opposes the lower discharge roller pair 22 so as to bind the sheets accommodated in the bin $B_2$. As shown in FIG. 18, stapler moving mechanism, to be described later, performs one-front-portion binding (binding position: $H_1$) of sheets $S_1$ and $S_2$ discharged onto the bins, two-portion binding of sheet $S_1$ (binding positions: $H_2$ and $H_3$) and one-inner-portion binding of sheet $S_2$ (binding position: $H_3$).

At the positions in each bin tray B at which stapling is performed, cut portions 57, 58 and 59 to prevent interference with the stapler 56 are formed.

The stapler 56 is able to move in directions indicated by arrows Y1 and Y2 shown in FIG. 18 and slides at the respective positions (56a←→56c) to perform stapling.

Stapler Apparatus

Figure 19:
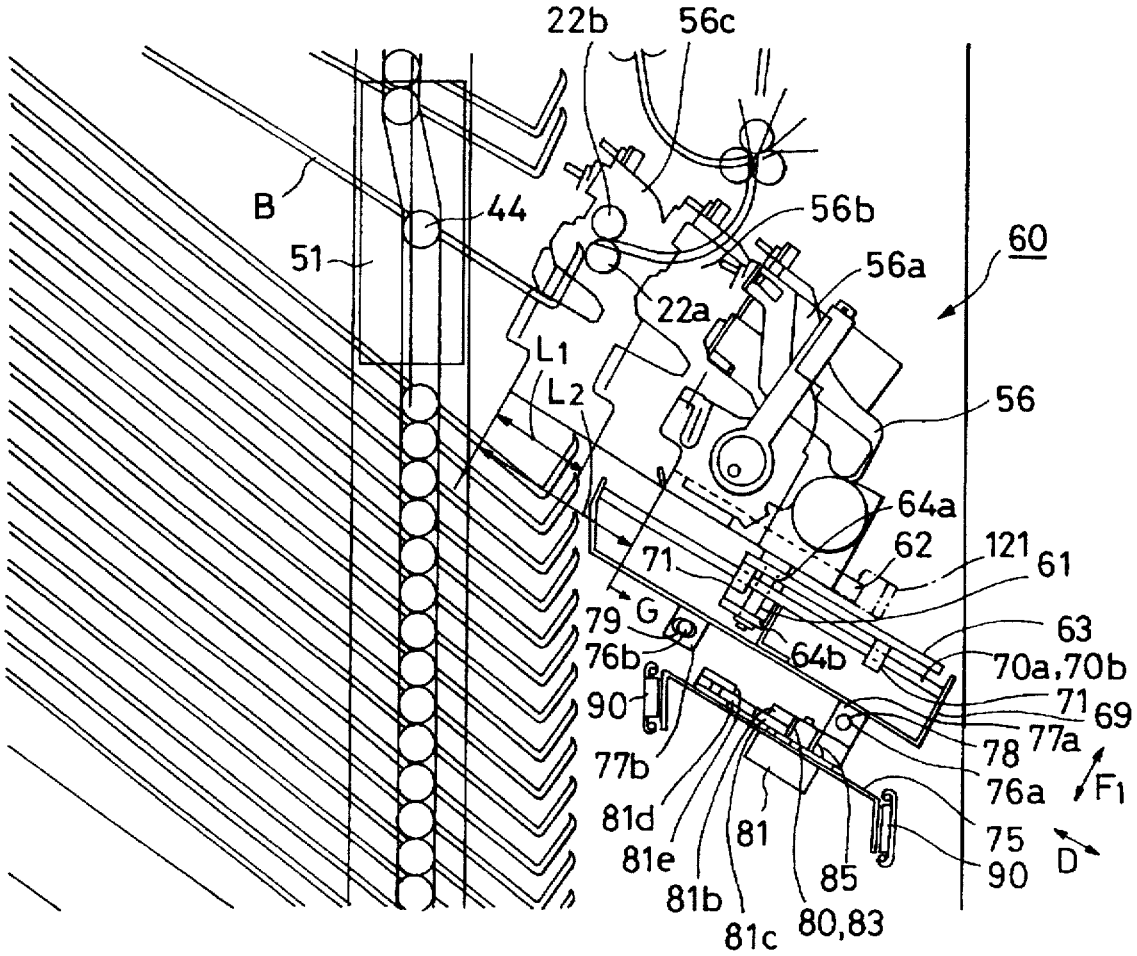
FIG. 19 is a vertical side view of a stapler portion of the sheet processing apparatus.

A stapler apparatus 60 will now be described with reference to FIGS. 19 and 20. The direction of the stapler 56 shown in FIG. 19 shows a state where the binding positions $H_2$ and $H_3$ shown in FIG. 18 are stapled.

The stapler 56 is secured to a first support member 62 having a support shaft 61 secured thereto. A second support member 63 rotatively supports the support shaft 61 of the first support member 62 by holes in the two support portions 64a and 64b.

A spring member 65 is disposed at an end of the first support member 62, while another end of the same is secured to the second support member 63. Thus, the first support member 62 is urged on the second support member 63 around the support shaft 61 in a direction indicated by an arrow C and it is located by a stopper 66.

On a portion opposing the spring member 65 and the support shaft 61, a link 68 is connected to a solenoid 67 and is secured to the second support member 63.

In a lower portion of the second support member 63, a guide member 71 is engaged in a swinging manner to two rails 70a and 70b and movably supports the second support member 63 in the direction indicated by an arrow D.

The support holes in the guide member 71 are formed such that the hole to be engaged to either rail (70a or 70b) is formed into a circular hole and the hole to be engaged to the other rail is formed into an elongated round hole so that vibration of the second support member 63, and thus, the stapler 56, in directions indicated by arrows $F_1$ (FIG. 19) and $F_2$ (FIG. 20) is prevented.

The second support member 63 has a rack gear 72, while the third support member 69 has a motor 74 secured to thereto, the motor 74 having a pinion gear 73 to be engaged to the rack gear 72.

When the motor is rotated, the second support member 63 is moved in a direction indicated by an arrow D while being guided by the rails 70a and 70b.

Guide members 77a and 77b that are engaged to two rails 76a and 76b provided for a fourth support member 75 and that movably supports the third support member 69 in a direction indicated by an arrow $F_2$ are disposed below the third support member 69. Hole to be engaged to the rails 76a and 76b of the guide members 77a and 77b are formed such that either hole is formed into a circular hole 78 and the other hole is formed into an elongated round hole 79 so as to prevent vibration of the third support member 69 in directions indicated by arrows $F_1$ (FIG. 19) and D (FIG. 20).

A motor 81 for rotating a belt pulley 80 and an idler pulley 83 that rotates around a shaft 82 are secured to the fourth support member 75. A belt 84 is arranged between the two pulleys 80 and 83, a portion of the belt 84 being secured to a secured portion 85 that is a portion of the third support member 69. Reference numeral 86 represents a bent tensioner. When the motor 81 is rotated, the belt is rotated so that the third support member 69 is moved in a direction indicated by an arrow $F_2$ while being guided by the rails 76a and 76b.

To detect waiting positions for the first, second, and the third support members 62, 63 and 69, detection means 87, 88 and 89 each comprising a microswitch are provided (see FIG. 20).

The fourth support member 75 is supported by a rail 90 or the like which is detachable with respect to the body of the apparatus when maintenance is performed. The fourth support member 75 is usually located and mounted by a locking mechanism, to be described later, in the sorter body 15.

Locking Mechanism for Stapler

The fourth support member 75 is drawn toward the operator (to the left portion of FIG. 20) by the operator when a staple cartridge is to be mounted on the electric stapler 56 or when a staple becomes jammed. If the fourth support member 75 can be drawn toward the operator when the electric stapler 56 is located at an arbitrary position, the electric stapler 56 and the stopper 158 of the bin can interfere with each other and become damaged. Accordingly, a front locking mechanism is provided to prevent drawing of the fourth support member 75 unless the third support member 69 having the stapler 56 mounted thereon is located at the home position.

Figure 44A:
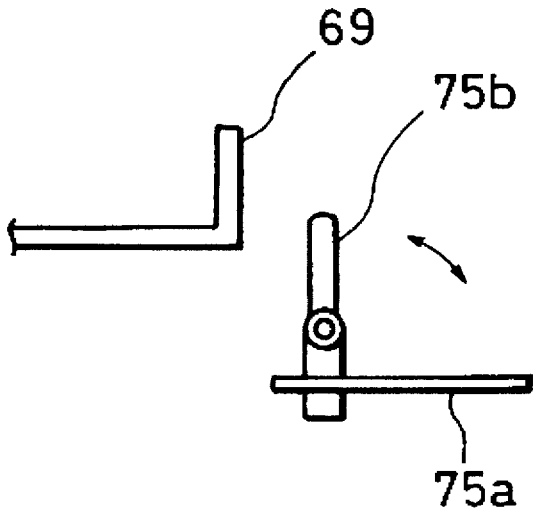
FIGS. 44 (*a*) and 44 (*b*) are schematic views showing a front locking mechanism.
Figure 44B:
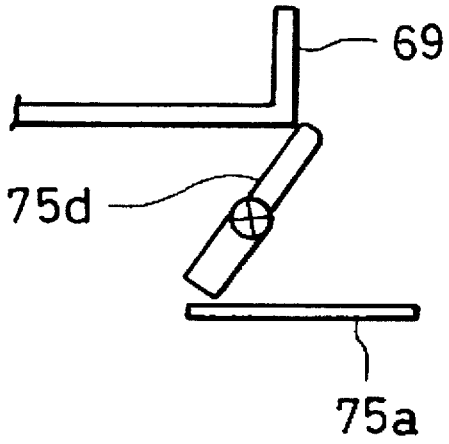

The front locking mechanism will now be described. Referring to FIG. 20, a lock pin 15*a* projects over the sorter body 15. A locking member 75*a* that can be engaged to the locking pin 15*a* is rotatively attached to the fourth support member 75. The locking member 75*a* is, by a stopper 75*b*, usually secured to a position, to which it is engaged to the locking pin 15*a*. The stopper 75*b* is structured such that the engagement is suspended when the third support member 69 is moved to the home position. Referring to FIGS. 44 (*a*) and (*b*) that are views along a direction indicated by an arrow G shown in FIG. 19, the stopper 75*b* is secured to the fourth support member 75 in such a manner that the stopper 75*b* can be swung in the direction indicated by the arrow shown in FIG. 44 (*a*). If the third support member 69 is not in contact, the stopper 75*b* is located to engage the locking member 75*a* as shown in FIG. 44 (*a*). If the third support member 69 has been moved to the home position and brought into contact with the stopper 75*b*, the engagement of the locking member 75*a* is suspended. A handle 75*c* is coaxially provided with the rotational center of the locking member 75*a*. A twisted coil spring 75d is secured to the handle 75*c* and the stopper 75*b*. Therefore, when the handle 75*c* is pulled in the direction indicated by the dashed-line arrow, the engagement between the stopper 75*b* and the locking pin 15*a* is, through the twisted coil spring 75*d*, suspended.

Therefore, if the third support member 69 is not located at the home position, pulling of the handle 75*c* cannot rotate the locking member 75*a* because of the stopper 75*b*. If the handle 75*c* is pulled to suspend the engagement of the stopper 75*b* when the third support member 69 has been moved to the home position, the locking member 75*a* is rotated to suspend the engagement with the locking pin 15*a*. Thus, the fourth support member 75 can be drawn to a position in front of the sorter body 15. When the fourth support member 75 is mounted on the sorter body 15, the handle 75*c* is mounted while being gripped and then the handle 75*c* is released, the elastic force of the twisted coil spring 75*d* causes the locking member 75*a* to be engaged to the locking pin 15*a*. When the fourth support member 75 is moved, the stopper 75*b* engages and locks the locking member 75*a*. Therefore, drawing of the fourth support member 75 by an operator when the stapler 56 is not at the home position is prevented, thereby improving safety and reliability.

When the fourth support member 75 is mounted on the sorter body 15, the combined weight of the electric stapler 56 mounted on the fourth support member 75, and the first, second and the third support members 62, 63 and 69 for supporting the electric stapler 56 cause the fourth support member 75 to be brought into contact with the inner end of the sorter body 15, thus causing the foregoing elements to be moved toward inside of the apparatus due to inertia. Therefore, the electric stapler 56, the leading end passage 26, and the stopper 158 may interfere with each other and becomes damaged. Accordingly, an inner locking mechanism for locking the moving mechanism of the third support member 69 is provided.

The inner locking mechanism will now be described. Referring to FIG. 20, a small-diameter gear 81*b* of a two-speed gear is engaged to a motor gear 81*a* attached to the motor 81. A ratchet 81*d* is attached to a large-diameter gear 81*c* in such a manner that the ratchet 81*d* is capable of engaging to the same. The ratchet 81*d* has a structure that it can be engaged to and separated from the large-diameter gear 81*c* by a solenoid 81*e*. The solenoid 81*e* is usually turned off, and the ratchet 81*d* and the large-diameter gear 81*c* are, in the foregoing state, engaged to each other. Only when the motor 81 is turned on, the solenoid 81*e* is turned on so that the engagement is suspended.

As a result, the belt pulley 80 is not rotated. Therefore, even if the fourth support member 75 is drawn from the sorter body 15 or it is mounted on the sorter body 15, the third support member 69 is not moved. In particular, undesirable inward movement of the third support member 69 with the electric stapler 56 mounted thereon when the fourth support member 75 is also mounted. Therefore, safety and reliability can be improved.

Figure 21:
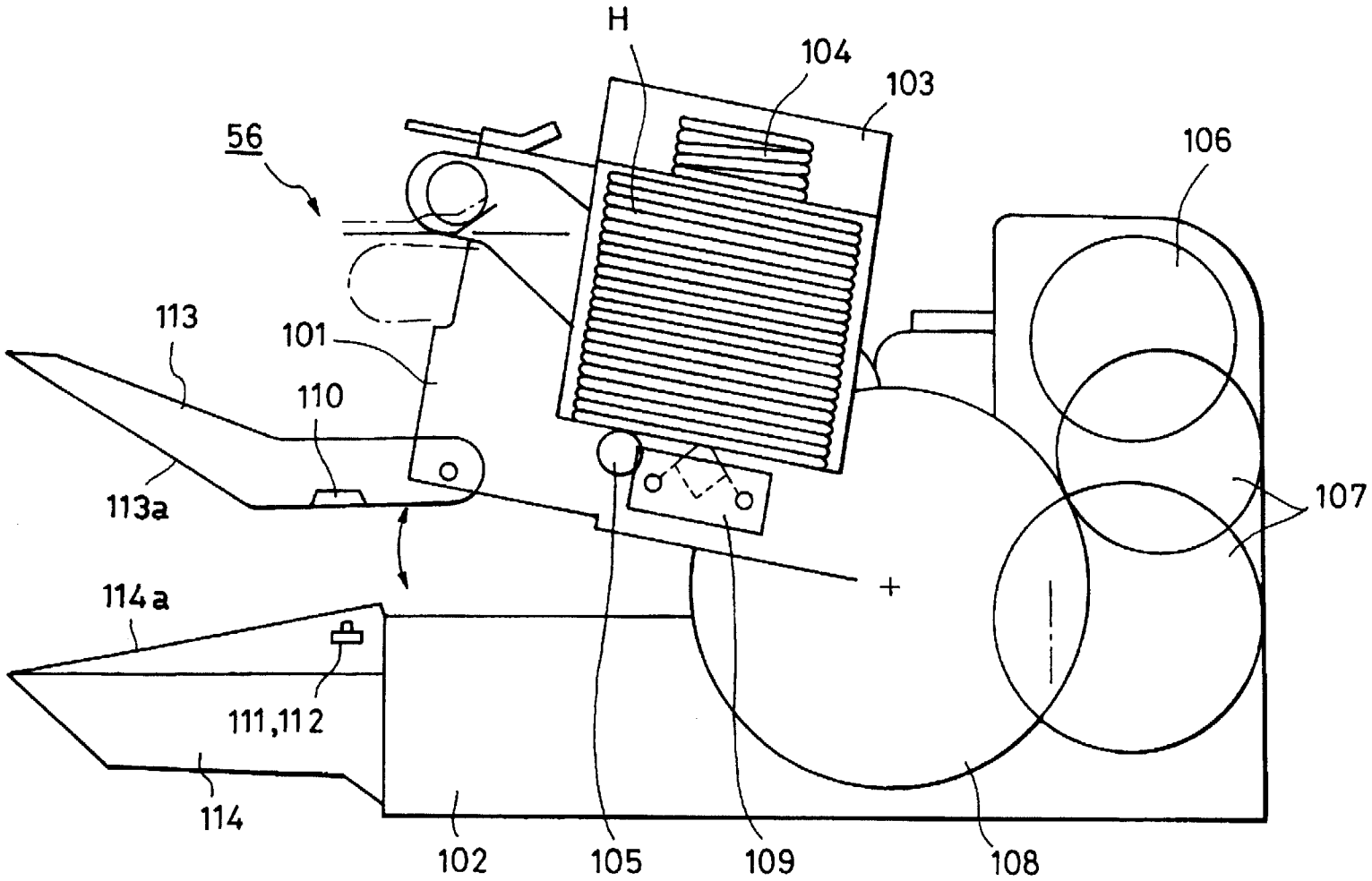
FIG. 21 is a side view showing the structure of the stapler portion.

The specific structure and basic operation of the stapler 56 will now be described. Referring to FIG. 21, the stapler 56 is formed into an alligator-shape and comprises a forming portion 101 in the upper portion thereof; and a staple table 102 in the lower portion thereof. A staple cartridge 103 is detachably mounted in the stapler 56, the staple cartridge 103 including about 5,000 staples H connected in the form of a plate. The plate-like staples H loaded into the staple cartridge 103 are urged downwards by a spring 104 disposed to the uppermost portion of the staple cartridge 103 so that a feeding roller 105 disposed in the lowermost portion is given conveyance force. Each of the staples H fed by the feeding roller 105 is formed into a U-shape facing side when the forming portion 101 is swung.

When a staple motor 106 is rotated, the forming portion 101 causes an eccentric cam gear 107 to be rotated. Thus, an eccentric cam 108 integrally formed with the eccentric cam gear 107 swings the forming portion 101 toward the staple table 102 as indicated by an arrow so that the forming portion 101 performs a clinching operation (a stapling operation).

A reflection-type sensor 109 detects when the staple cartridge 103 does not contain enough staples to complete a stapling operation. Reflection-type sensor 109 is disposed in the lower portion of the staple cartridge 103. The detection is performed so that the minimum number of the staples is determined as follows: number (n) of the bin trays B×the maximum number (2) of portions to be stapled, that is, a state where 2n staples exist, can be detected. This ensures that the cartridge contains enough staples to complete the stapling operation for even the largest possible number of staplings.

Figure 22:
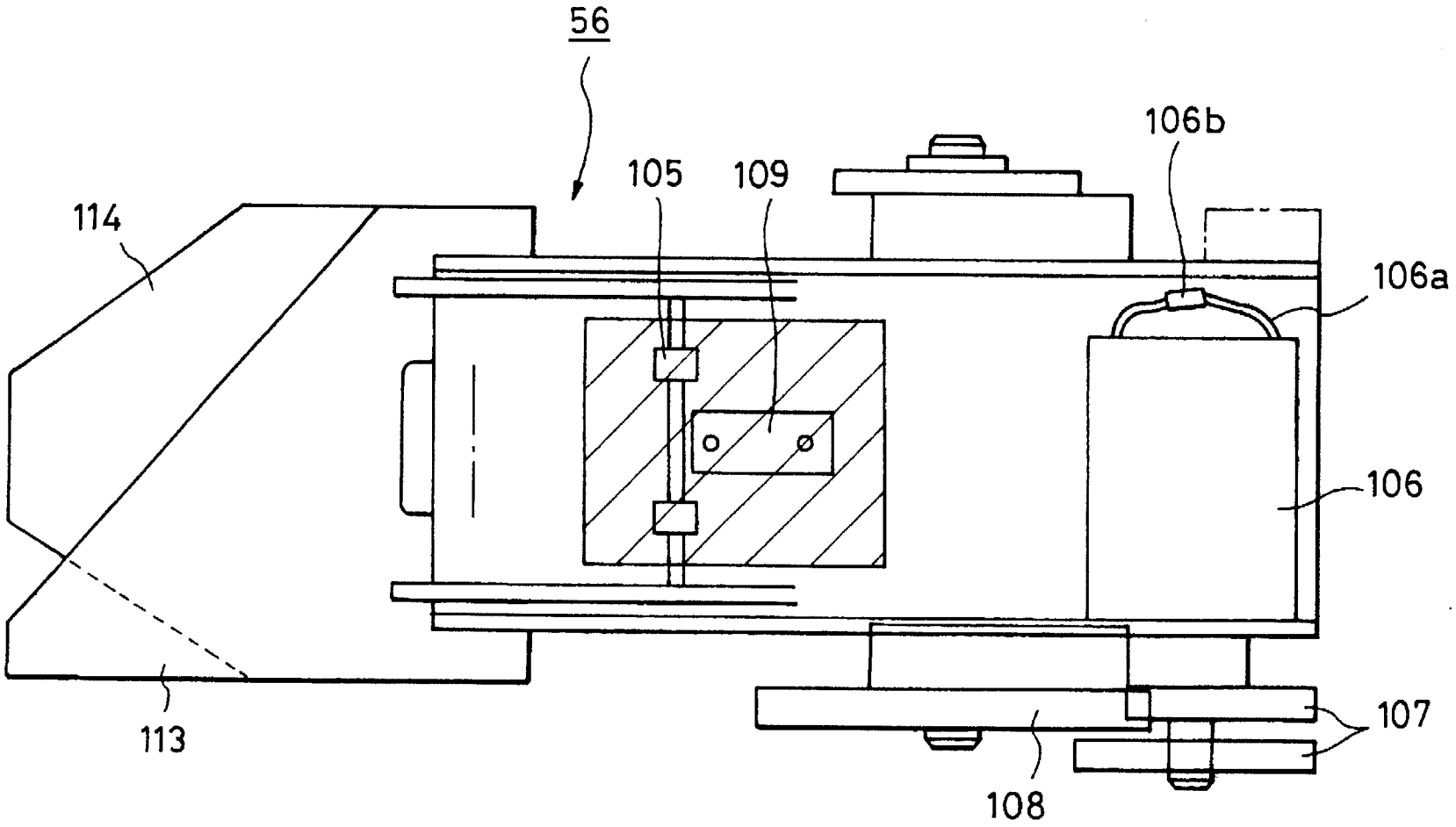
FIG. 22 is a plan view showing the structure of the stapler portion.

Detection of jammed staples H (clogged staples) to be fed by the staple cartridge 103 will now be described with reference to FIGS. 22 and 23. Referring to FIG. 22, a cord 106*a* for supplying an operation electric current is connected to the staple motor 106, the cord 106*a* having an electric-current sensor (an abnormality detection means) 106*b* serving as a load detection means for detecting the flowing electric current.

Figure 23:
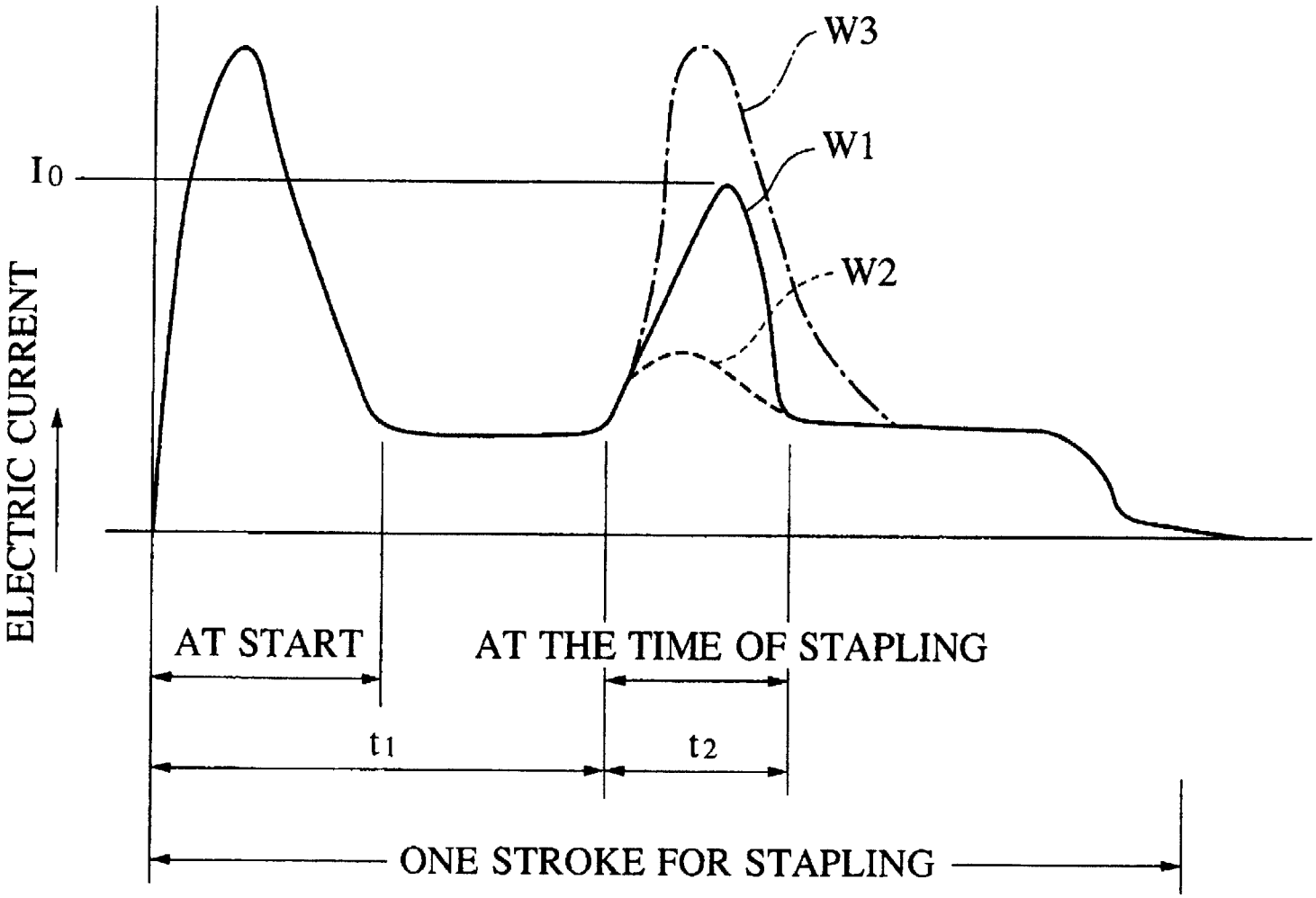
FIG. 23 is a graph of waveform showing electric current that flows in a staple motor during one stapling process of the stapler.

FIG. 23 shows the waveform of an electric current that flows in the staple motor 106 during one stapling process detected by the electric current sensor 106*b*.

Referring to FIG. 23, W1 indicates the waveform realized under normal stapling conditions when the staple H has been ejected to pass through the sheet bundle S and bent, fixing the sheet bundles S. W2 indicates the waveform realized when idle stapling (although the stapler 56 has been operated, no staple H has been ejected) has been performed. Since no load acts when the staple H penetrates the sheet bundle S and when the staple H is bent, the level of the electric current is lowered. W3 indicates the waveform when a defective stapling operation has been performed or a staple has become jammed. In the foregoing case, an excess load is usually generated and the level of the electric current is greatly increased.

Therefore, when the level of the electric current is near $I_0$ (the initial value), a discrimination can be made that the stapling operation is being performed normally. If $I>I_0+C$ (C represents scattering), a discrimination can be performed that jamming of a staple, defective stapling, or a mechanical problem of the stapler 56 has occurred. If $I<I_0-C$, a discrimination can be made that idle stapling has been performed.

Figure 24:
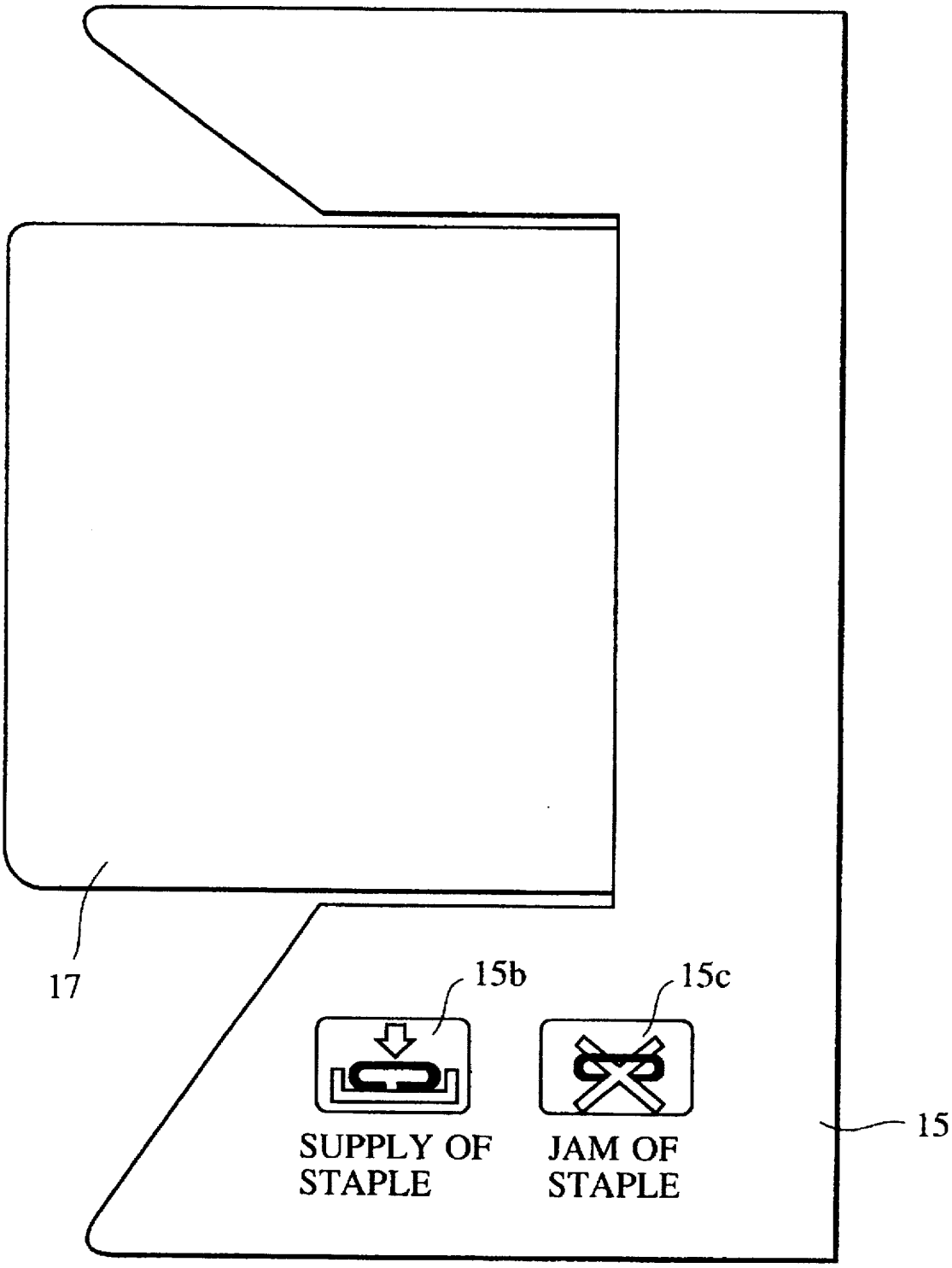
FIG. 24 is a plan view showing a staple-less display portion showing a staple-less state and a staple-jam display portion showing a staple-jam state of the stapler.

As shown in FIG. 24, the staple-less state or the staple-jam state of the stapler 56 are respectively displayed on a staple-less display portion (abnormal display means) 15*b* and a staple-jam display portion (abnormal display means) 15*c* formed in the portion of the sorter body 15 adjacent to an operator. If the stapler 56 has encountered the staple-less state, the staple-less display portion 15*b* flashes. If the stapler 56 has encountered the staple-jam, the staple-jam display portion 15*c* flashes, thereby notifying the operator of the foregoing problems.

Paper Detection Means Provided for Stapler

Figure 25:
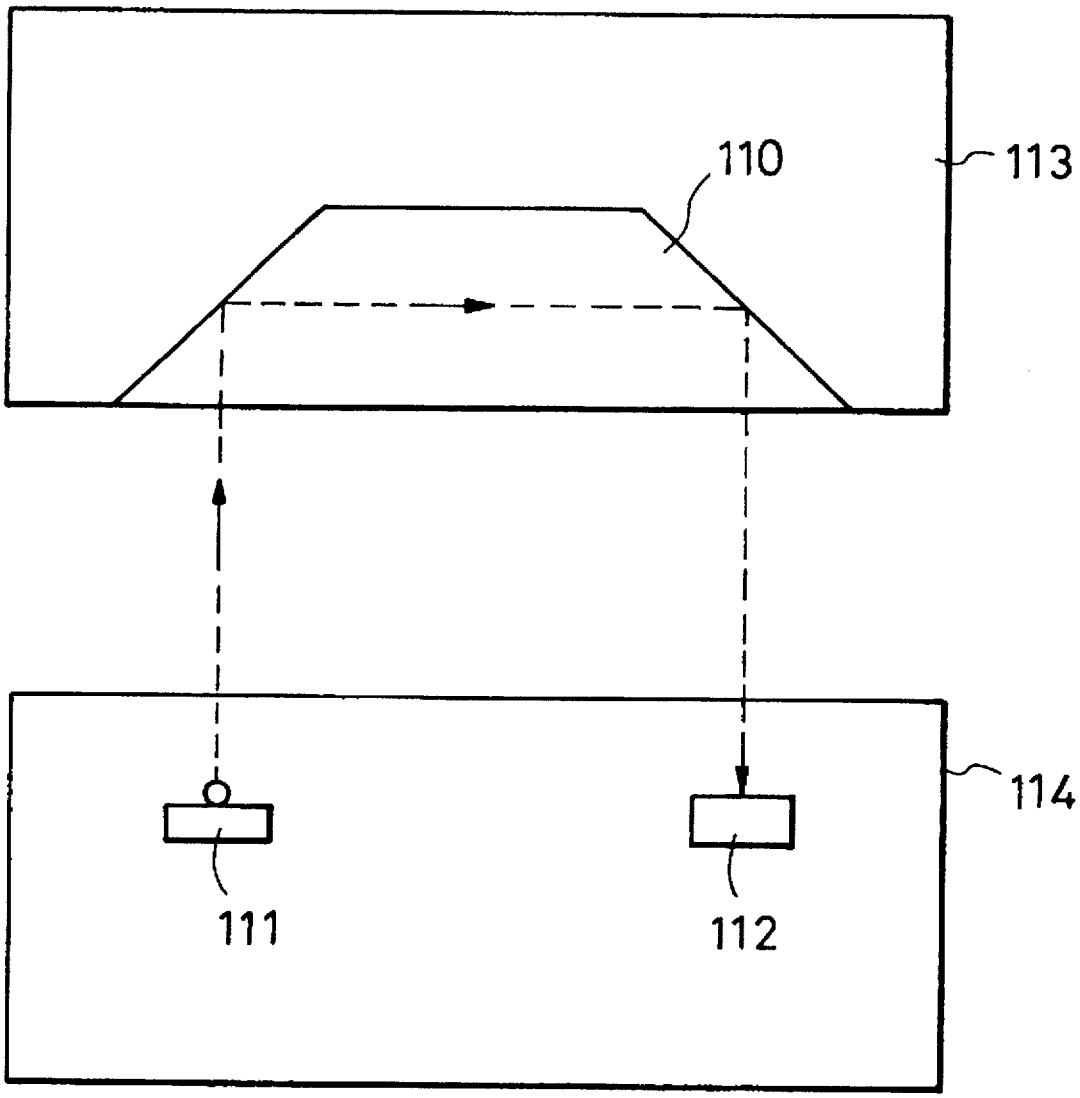
FIG. 25 is a vertical cross sectional view showing a guide member of the stapler.

As shown in FIGS. 21 and 25, the forming portion 101 and the staple table 102 respectively comprise an upper guide member 113 and a lower guide member 114. The upper guide member 113 is provided with a prism 110, while the lower guide member 114 is provided with a light emitting device 111 comprising an LED or the like; and a light receiving device 112 comprising a phototransistor or the like. The light emitting device 111 and the light receiving device 112 detect whether or not a sheet S exists between the forming portion 101 of the stapler 56 and the staple table 102 so as to prevent idle stapling by the stapler 56. If the stapler 56 performs the idle stapling operation, the staple H is used wastefully and the idly ejected staple H is dispersed in the apparatus. Such problems can be prevented using the paper detection means.

As shown in FIG. 25, the detection by means of the sheet detection sensor is performed in such a manner that light emitted by the light emitting device 111 is reflected by the prism 110 so as to be detected by the light receiving device 112 if no sheet is present between the upper and lower guide members. Light emitted by the light emitting device 111 is blocked by sheet S present between the upper and lower guide members, so that whether or not a sheet S exists is detected. If the sheet S has been detected by the sheet detection sensor provided for the upper and lower guide members 113 and 114, the sheet S can reliably be stapled by stapler 56. Thus, idle stapling can be prevented.

As a result of the foregoing structure, a sheet S is detected when the stapling operation is performed within the width of the stapler 56. Thus, a space required to provide a detection means for detecting sheet S individually from the stapler 56 can be eliminated. The width of a cut portion required to be formed in the bin tray B can be minimized so that deterioration in the alignment characteristic of the sheet S and the strength of the bin tray B are prevented. Even if the reverse side (facing the light emitting device and the light receiving device) is black, the existence of the sheet can reliably be detected.

Referring to FIG. 21, the upper guide member 113 and the lower guide member 114 are respectively attached to the forming portion 101 and the staple table 102. The upper guide member 113 and the lower guide member 114 act in such a manner that a tapered surface 114*a* of the lower guide member 114 is introduced to a portion below the bin tray B when the stapler 56 is moved to a stapling position 56*c* to staple the sheets S so as to move the staple 56 onto the staple table 102. As a result, the position of stapling the sheet S is determined. The upper guide member 113 guides the stapler 56 into the stapling position 56*c* between the forming portion 101 and the staple table 102 in such a manner that the end of the contact of sheets stacked on the bin tray B with the guide surface 113*a*, which causes the stacking characteristic and the aligning characteristic to deteriorate, is prevented.

Figure 26:
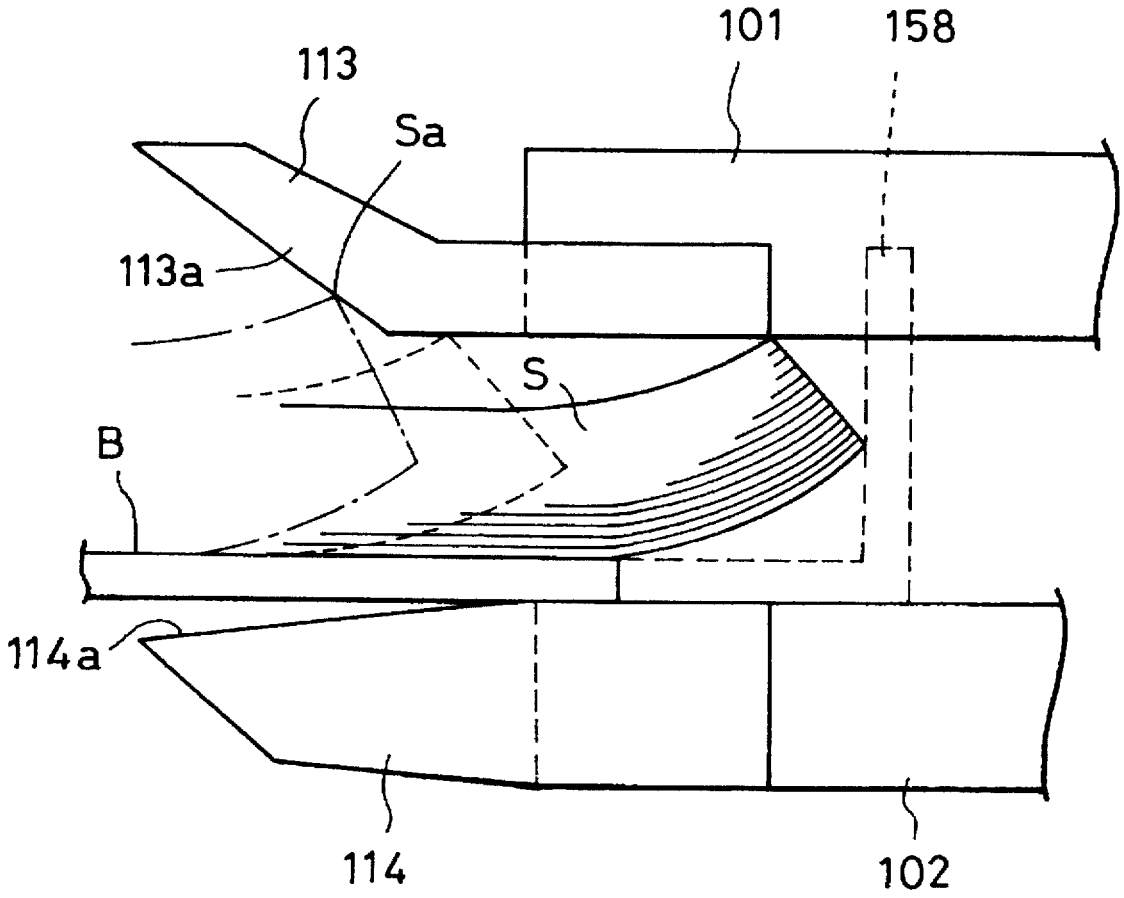
FIG. 26 is an explanatory view showing an operation of the stapler to introduce into the bin tray.

The guiding operation to be performed by the upper and lower guide members 113 and 114 will now be described. Referring to FIG. 26, when the stapler 56 is moved to the stapling position 56*c*, the upper paper end $S_a$ of the sheet bundle S indicated by an alternate long and one short dash line is downwards restricted along the tapered surface (the guide surface) 113*a* of the upper guide member 113 so as to be guided between the upper guide member 113 and the bin tray B as indicated by a dashed line. Then, the bin tray B is gradually moved upwards by the lower guide member 114, and the stapler 56 is further moved so that the bin tray B is supported by the staple table 102. As a result, the stapling position is determined and the stapling operation by the forming portion 101 is performed.

As a result of the foregoing structure, the stapling operation is performed in such a manner that the sheet bundle S is initially introduced between the stapler 56 and the bin tray B by the tapered surface 113*a* of the upper guide member 113 and the stapling operation can be performed smoothly without deterioration in the sheet stacking characteristic and the aligning characteristic while preventing dislocation of the stapling position. Since the upper guide member 113 holds the end of the sheet and guides the introduction, the stapler 56 can be moved to the stapling position 56*c* in such a manner that the contact of the end of the sheet that causes the stacking characteristic to deteriorate can be prevented. Thus, the end of the sheet can smoothly be introduced.

Figure 27B:
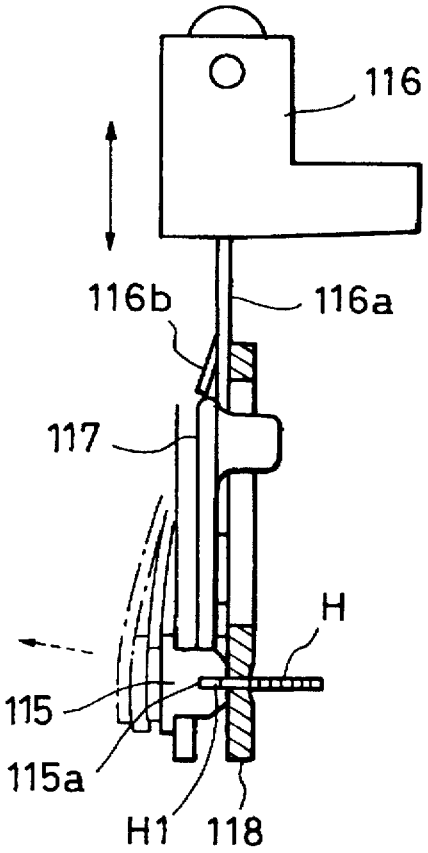
FIG. 27 (*a*) is a perspective view, and FIG. 27 (*b*) is a side cross sectional view showing the structure for the stapling operation performed by the forming portion of the stapler.
Figure 27A:
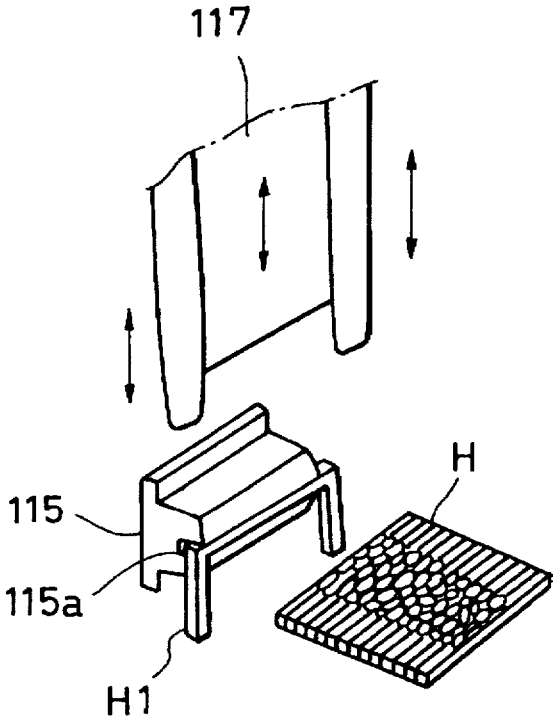

The stapling operation of the stapler 56 will now be described specifically. Referring to FIGS. 27 (*a*) and 27 (*b*), the plate-like staples H accommodated in the staple cartridge 103 are, one by one, fed by the feeding roller 105 to a staple bending block 115. Thus, the leading staple H is held in a holding groove 115*a* of the staple bending block 115. The eccentric cam gear 108 (shown in FIGS. 21 and 22) is rotated so that the forming portion 101 is moved downwards to the operation position. As a result, as shown in FIG. 27 (*b*), a drive mechanism (not shown) move a driver 116 downwards so that the plunger 116*a* is moved downwards. At this time, a pushing claw 116*b* formed in a portion of the plunger 116*a* pushes the bending block 117 formed into a U-shape facing side to press the upper surface of the staple bending block 115. The staple H held in the holding groove 115*a* of the staple bending block 115 is bent into a U-shape facing side, as shown in FIG. 27 (*a*).

The plunger 116*a* is further moved downwards so that the pushing claw 116*b* is separated from the bending block 117. Thus, only the plunger 116*a* is pushed downwards to reach the tapered portion of the staple bending block 115. While pushing aside the staple bending block 115 to a position (in a direction indicated by a dashed-line arrow) indicated by an alternate long and a short dash line, only the leading staple H formed into the U-shape facing side is sheared by a staple shearing member 118 to inject the staple H into the sheet S. Then, the staple H is pushed against the staple table 102 so that the sheet S is stapled. When the further rotation of the eccentric cam gear 108 moves the forming portion 101 to the upper waiting position, the driver 116 is pulled upwards so that the plunger 116*a* is moved upwards to be restored to the waiting position. Thus, one stapling operation is completed.

Staple Cartridge

Figure 28:
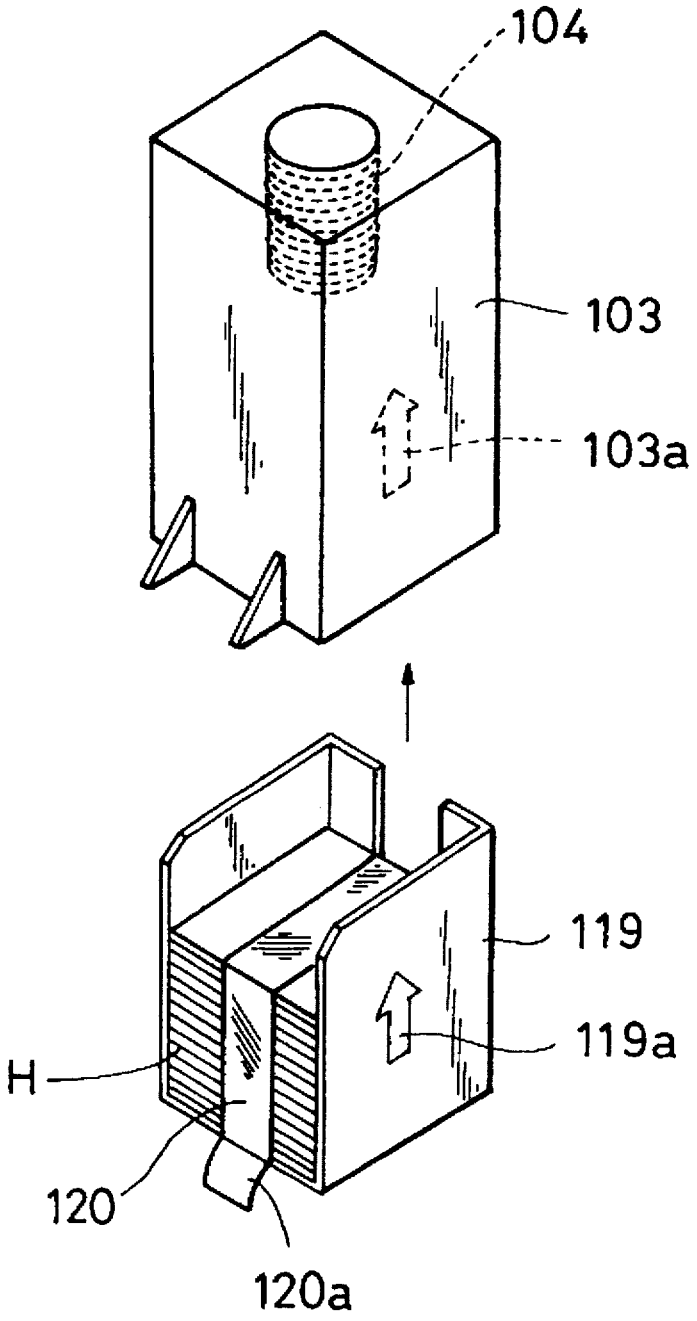
FIG. 28 is a diagram showing a staple cartridge and staples.

The structure of the staple cartridge 103 and a method of loading the staple H to be accommodated in the staple cartridge 103 will now be described. The staple cartridge 103, as shown in FIG. 28, comprises an integrally-formed box-like transparent case having an open bottom and being made of plastic or resin. A spring 104 is attached to the upper surface of the staple cartridge 103 to urge downwards the staple H loaded in the staple cartridge 103. The staple H loaded in the staple cartridge 103 is fastened by a fastening means, such as a clicking member, so that the staple H is not dropped through the opening.

A plurality of the staples H are connected to be formed into a plate-like shape, and a plurality of the plate-like structures are stacked before they are loaded into the staple cartridge 103. Before the staples H are loaded, a plurality of the plate-like structures are stacked and held by a wrapping paper 119 in such a manner that the two sides ends are held in the form of a U-shape facing side, and a tape 120 is wound around the plate-like structures. A handle 120*a* is projected over the tape 120 so that separation is easily performed by pulling the handle 120*a*.

An arrow 103*a* indicating the loading direction for the staple H is formed on one side surface of the staple cartridge 103. The arrow 103*a* can be formed by printing or embossing the case. Also the side surface of the wrapping paper 119 for wrapping the staples H has an arrow 109*a* that indicates the loading direction for the staples H. The reason for this is that, if the staples H are loaded into the staple cartridge 103 inversely in longitudinal direction or the sides, the stapling operation cannot be performed effectively. Thus, the foregoing problems can be prevented.

When the staple cartridge 103 is empty, as detected by the reflection-type sensor 109, the operator draws the fourth support member 75 from the sorter body 15 as shown in FIG. 20, and upwards removes the staple cartridge 103 mounted on the stapler 56, as shown in FIG. 21. As shown in FIG. 28, the staples H wrapped by the wrapping paper 119 are loaded into the staple cartridge 103 against the force of the spring 104 in such a manner that the arrows 119*a* and 103*a* are made coincide with each other. Then, the handle 120*a* is pulled to peel off the tape 120 that bundles the staples H. Thus, the loading operation is completed. Then, the staple cartridge 103 accommodating the staples H is again mounted on the stapler 56, and the fourth support member 75 is mounted on the sorter body 15. Thus, the operation is completed.

As a result of the foregoing structure, loading is performed such that the arrow 103*a* formed on the side surface of the staple cartridge 103 and the arrow 109a formed on the wrapping paper 119 wrapping the staples H coincide with each other. Thus, the operator is prevented from mistakenly loading the staples H inversely in the longitudinal direction or the sides. Thus, sheets S can effectively be stapled.

Figure 29:
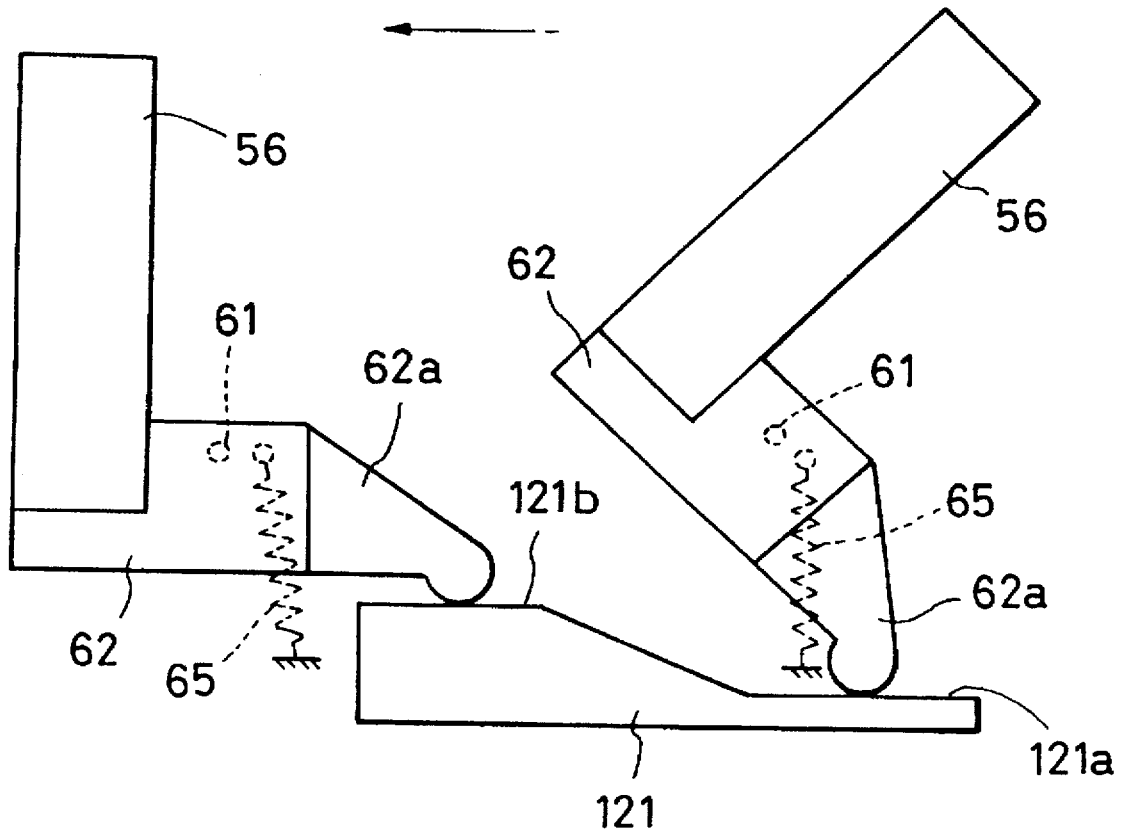
FIG. 29 is a diagram showing a mechanism for rotating a support member having the stapler mounted thereon.

As shown in FIG. 29, the first support member 62 for supporting the stapler 56 has the cam 62*a* formed integrally. The plate cam 121 is secured to the frame (not shown) of the sorter body 15. The stapler 56 is set to a position, at which the first support member 62 is pulled by the spring member 65 to correspond to the one-front-portion binding position, that is, to a position (the home position) at which the leading portion diagonally faces the inner portion of the apparatus.

If the stapler 56 encounters a jammed staple, the handle 75*c* is gripped to draw the fourth support member 75 toward the front portion of the apparatus (the left portion of FIG. 20). Thus, the cam 62*a* is initially brought into contact with a thin portion 121*a* of the plate cam 121. As the stapler 56 moves in a direction indicated by the arrow, the cam 62*a* is brought into a thick portion 121*b* through the inclined cam surface. The first support member 62 is rotated counter-clockwise around the support shaft 61 against the elastic force of the spring member 65 so that the clinching portion of the stapler 56 is rotated in a direction toward the front portion. When the fourth support member 75 has been accommodated in an inner portion (in the right portion of FIG. 20), the cam 62*a* is initially in contact with the thick portion 121*b* of the plate cam 121. As the stapler 56 is moved, the first support member 62 is rotated clockwise around the support shaft 61 due to the elastic force of the spring member 65. After the accommodating operation has been completed, it is brought into contact with the thin portion 121*a* and the stapler 56 is returned to the home position.

As a result of the foregoing structure, since the clinching portion of the stapler 56 is located in a position adjacent to the operator when the fourth support member 75 has been drawn, the operator is able to clearly recognize the staple jam, and therefore to easily correct the problem. By using the support shaft 61 of the first support member 62 for use in the stapling operations, such as the one-front-portion binding and two-portion binding operations, and as the rotational shaft for the staple jam correcting operation, the necessity of providing a rotational shaft or the like for the stapler 56 can be eliminated. Therefore, the jam overcoming operation can be simplified. Since the stapler 56 can be rotated in synchronization with the drawing and accommodating operations of the stapler unit, excellent operability can be realized, and the staple jam correcting operation can be completed quickly.

Although this embodiment has the structure such that the first support member 62 is rotated in synchronization with the drawing and accommodating operations of the fourth support member 75, the first support member 62 is not required to be moved in synchronization with the operation of the fourth support member 75. For example, another structure may be employed in which the first support member 62 is eccentrically supported around the support shaft 61; when the stapler 56 is at the home position, the first support member 62 is secured by a securing member, such as a claw, and the foregoing securing state is suspended by a button or the like after the fourth support member 75 has been removed from the body of the apparatus so that the first support member 62 is rotated around the support shaft 61 due to the weight of the stapler 56 to cause the clinching portion of the stapler 56 to face the front portion of the apparatus. A structure may be employed in which the cam formed on the first support member 62 is brought into contact with the frame of the sorter body in the accommodation state so that the first support member 62 is rotated in the reverse direction, and securing to the securing member is again realized at the position at which the stapler 56 is returned to the home position.

The stapler apparatus 60 has the foregoing structure. The image processing apparatus 1 and the sorter 11 respectively provided with control apparatuses (a CPU) 1A and (a CPU) 11A to control the stapling operations and sheet feeding (see FIG. 1).

Since this embodiment has the foregoing structure, the sheet S discharged from the image processing apparatus, such as a copying machine, is, through an introduction port 18, guided by the deflector 24 that is displaced to correspond to the non-sort mode (a mode in which sheets are not classified) and the sort mode (a mode in which sheets are classified) so as to be introduced into the first sheet conveyance passage 19 or the second sheet conveyance passage 20.

Binding Operation

The binding operations in a plurality of bins B will now be described with reference to flow charts shown in FIGS. 34 to 38.

One-Front-Portion Binding

The binding operation in a plurality of bins B is performed such that the binding operation is performed in the bin B after the sheets have been finally discharged and accommodated.

Figure 30:
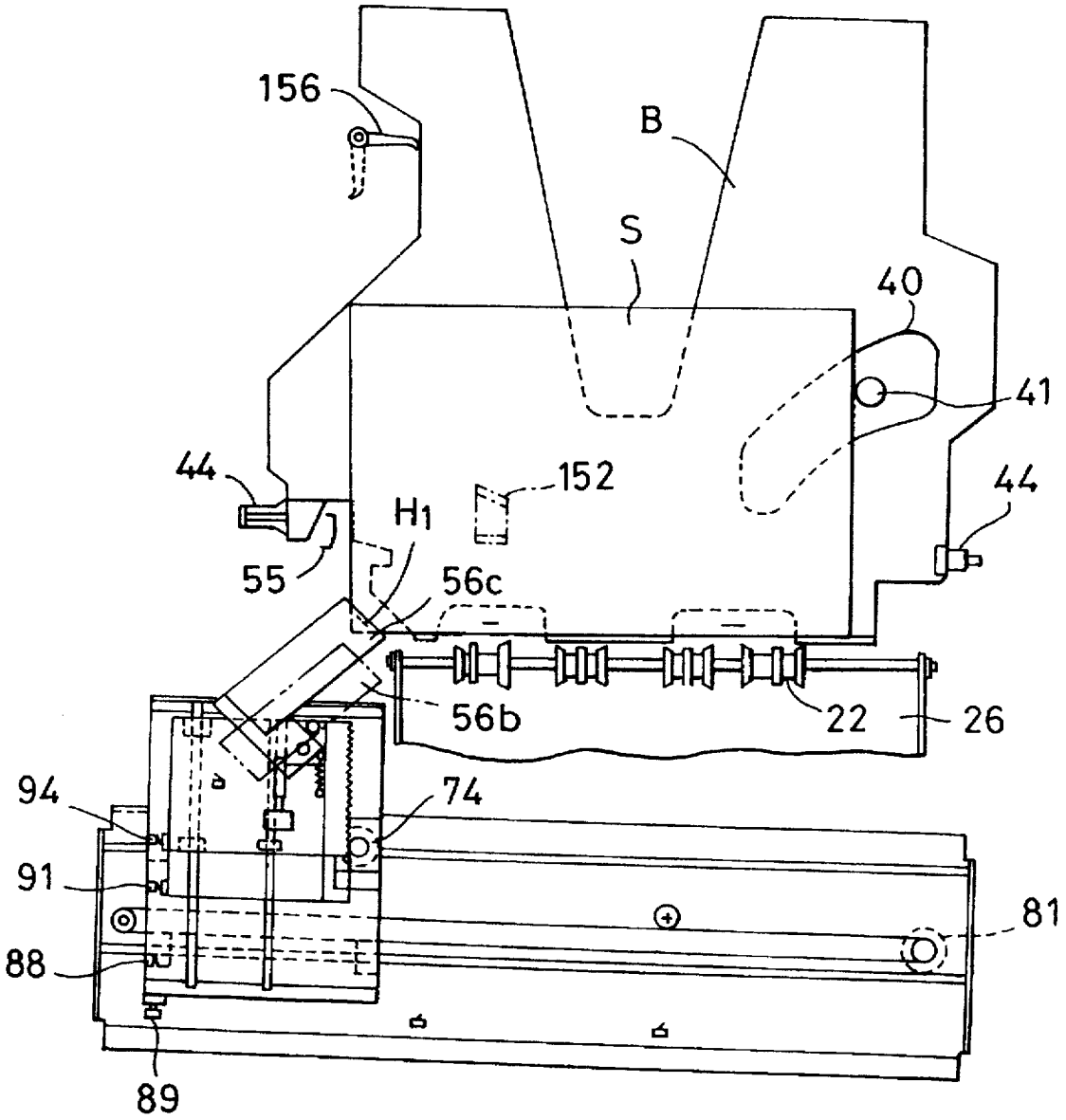
FIG. 30 is a plan view showing the stapler portion and the bin tray portion in a state when the stapling operation is performed in the sheet processing apparatus.
Figures 34, 34A:
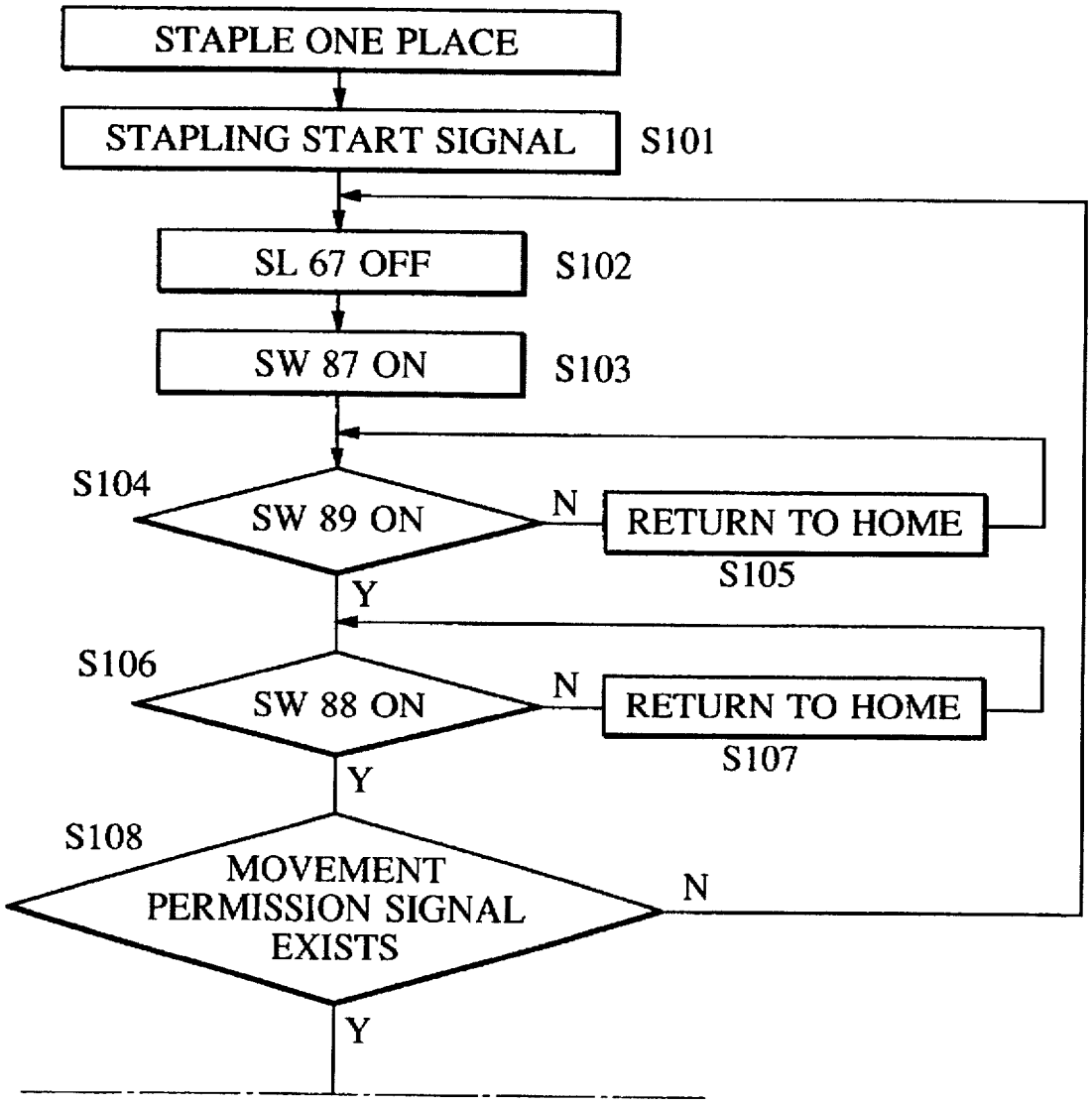
FIGS. 34, 34A and 34B are flow charts showing the stapling operation in the sheet processing apparatus.
Figure 34B:
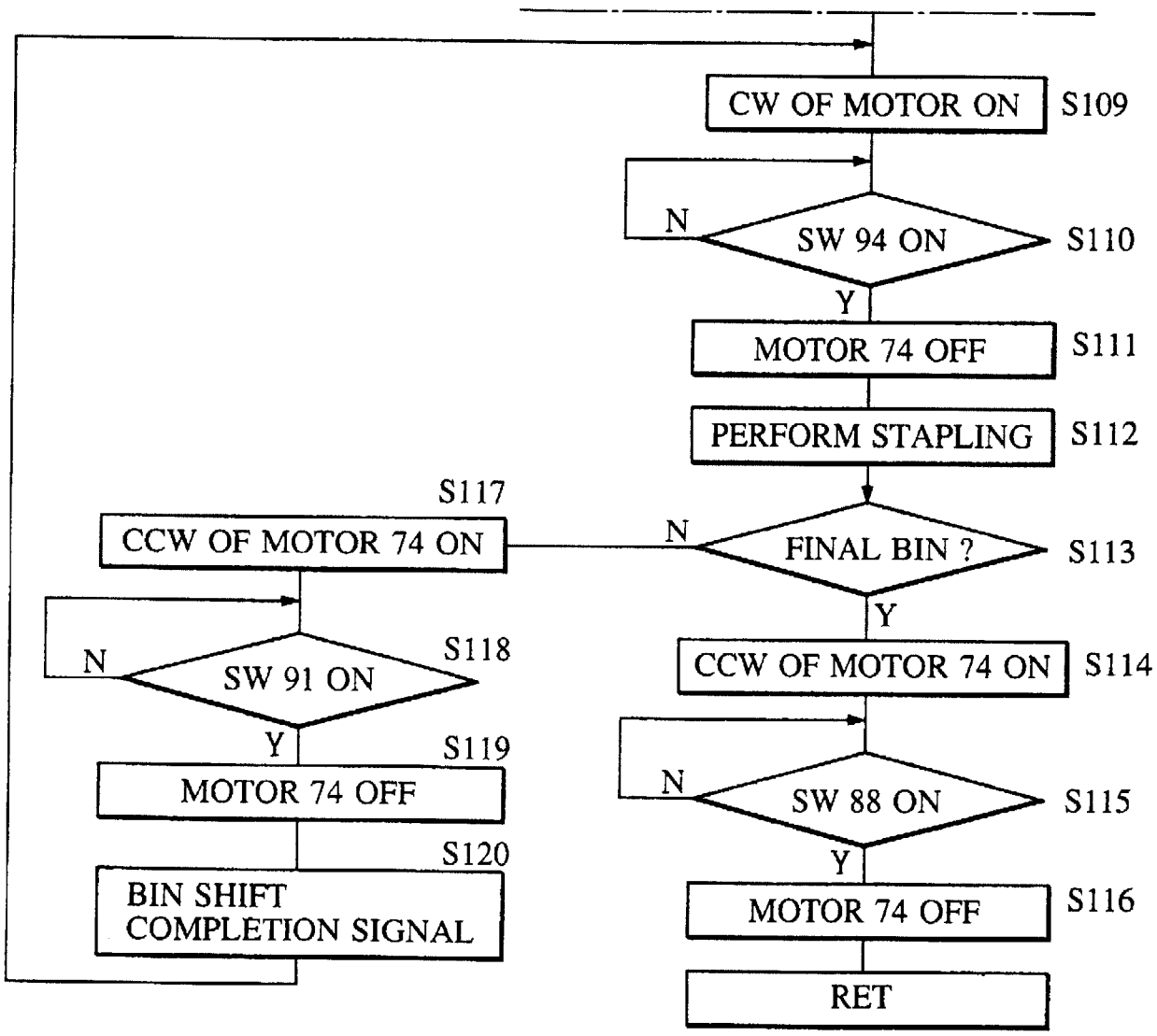

Initially, the operation to be performed in the case where the one-front-portion binding (binding position: $H_1$ (FIG. 18)) operation is performed will now be described. Referring to FIGS. 30, 34A and 34B, the second support member 63 is, as described above, moved together with the stapler 56 on the first support member 62 so that the stapler 56 is moved from the waiting position 56*a* to the stapling position 56*c*.

Referring to FIG. 34A and 34B, when a signal indicating the selection of one-portion binding has been supplied from the control means (S101), the solenoid 67 turns off (S102), and switch 87, shown in FIG. 20, turns on (S103), indicating the position of stapler 56 to perform one-portion binding at position $H_1$. Thereafter, whether the second support member 63 and the third support member 69 are at the home or waiting positions is detected by detection means 88 and 89 (S104 and S106). If they are not at their waiting positions they are returned to the waiting positions (S105 and S107).

When all elements have been moved to predetermined positions, the control means transmits a signal permitting movement to the stapling position by the second support member 63 (S108) so that motor 74 is rotated in a clockwise direction (S109). In this way, stapler 56 is moved from the intermediate waiting position at 56*b* to the stapling position 56*c* to perform sapling at position $H_1$. When switch 94 turns on (S110), motor 74 is turned off (S111). Stapling is then performed at position $H_1$ (S112), as shown in FIG. 30.

Where the sheets are only stacked in one bin, or the sheets are stacked in several bins and stapling has been performed in the final bin (S113), the motor 74 rotates in a counterclockwise direction (S114) to move the stapler to the waiting position 56*a*. After switch 88 turns on, indicating that the waiting position has been reached, motor 74 stops (S116). This completes the stapling operation for one-portion stapling where only a single bin contains sheets or where the last bin has been stapled.

In the case where a plurality of bins contains sheets to be stapled, after the stapling operation in the first bin has been completed, the motor 74 is rotated in a counterclockwise direction (S117). Afterwards, the stapler 56 is not returned to position 56*a*, but is moved instead to the intermediate waiting portion 56*b*. When the intermediate waiting position 56*b* is detected by the detection means 91 (S118) (shown in FIGS. 3 and 30), the rotation of the motor 74 is stopped (S119).

In response to a bin-shifting completion signal (S120), sheets in the second bin are subjected to a process such that the stapler 56 is, by the foregoing drive means, moved from the intermediate waiting position 56*b* to the stapling position 56*c*. After the stapling operation has been completed, the stapler 56 is returned to the intermediate waiting position 56*b*. In response to a signal representing the completion of the sequential operations of the stapler 56, a next bin shifting operation is performed, and the operation is repeated. Thus, the stapling operation is automatically completed. After the stapling operation in the final bin has been completed, the second support member 63, first support member 62 and the stapler 56 are returned so that the stapler 56 is returned from the stapling position 56*c* to the waiting position 56*a*.

As a matter of course, the bin shifting operation is repeated as many times as necessary to staple the sheets in each bin.

Referring to FIG. 19, distance $L_1$ between the stapling position 56*c* and the intermediate waiting position 56*b* is shorter than distance $L_2$ between the stapling position 56*c* and the waiting position 56*a*. The reason for this is that the position 54*b* to which the stapler 56 is relieved when the stapling operation is continuously performed, is the minimum necessary to prevent interference with the bin when shifting the bin. Therefore, the time required to perform the reciprocating operation can be shortened and thus the time taken to complete the stapling operation can be shortened.

Two-Portion Binding

Figure 31:
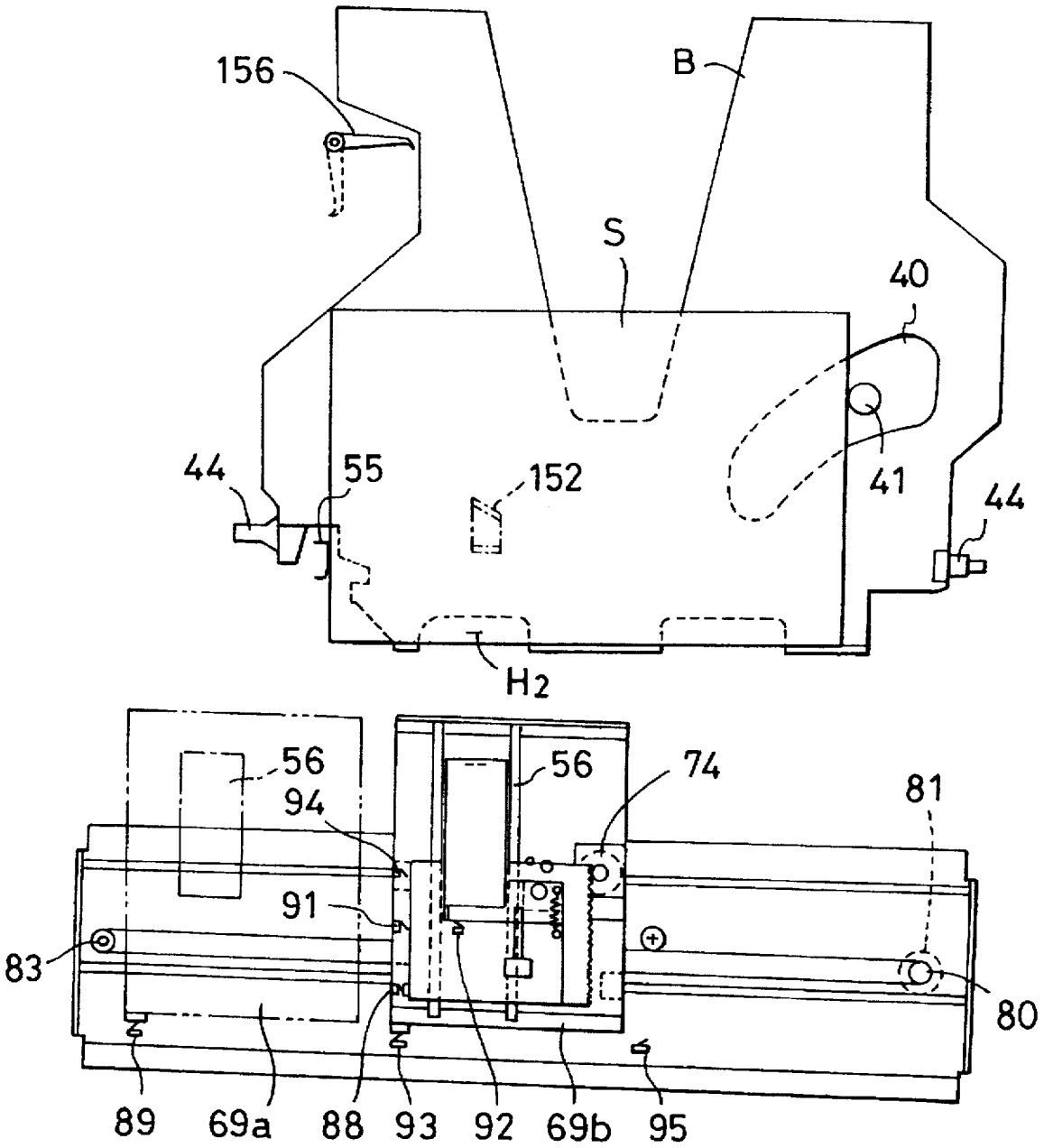
FIG. 31 is a plan view showing the stapler portion and the bin tray portion in a state when the stapling operation is performed in the sheet processing apparatus.
Figure 35A:
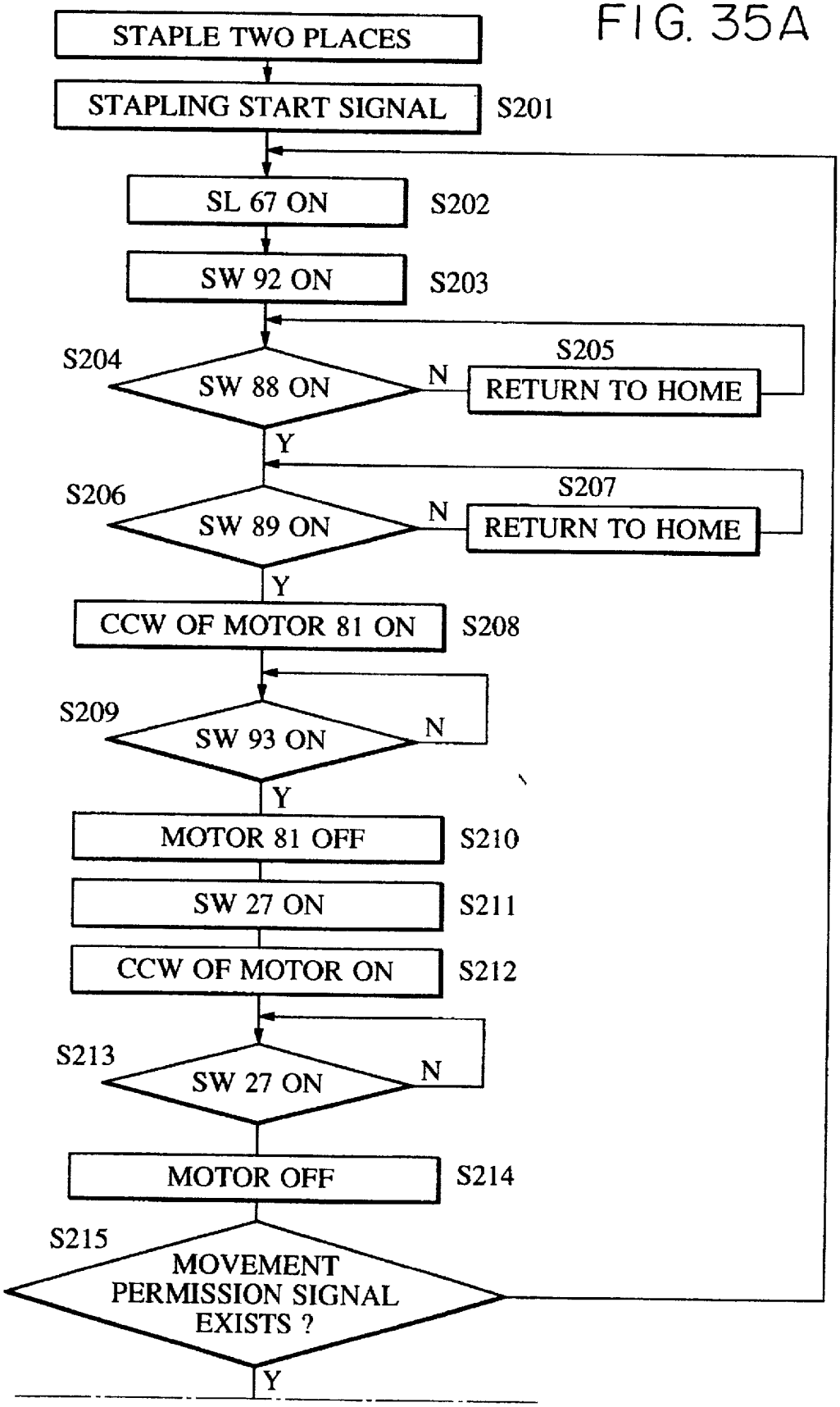
FIGS. 35, 35A and 35B are flow charts showing the stapling operation to be performed in the sheet processing apparatus.
Figures 35, 35B:
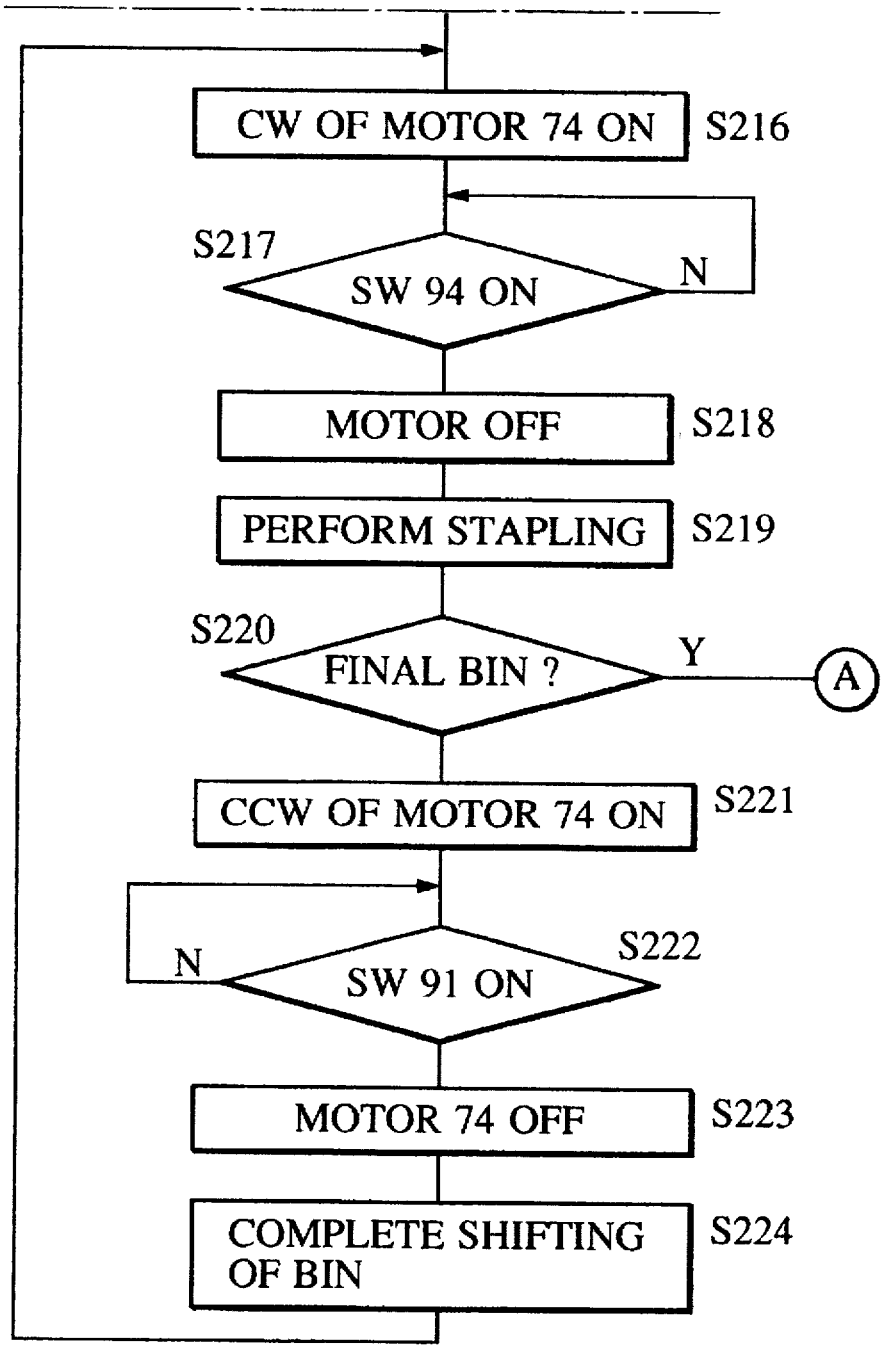
Figure 36:
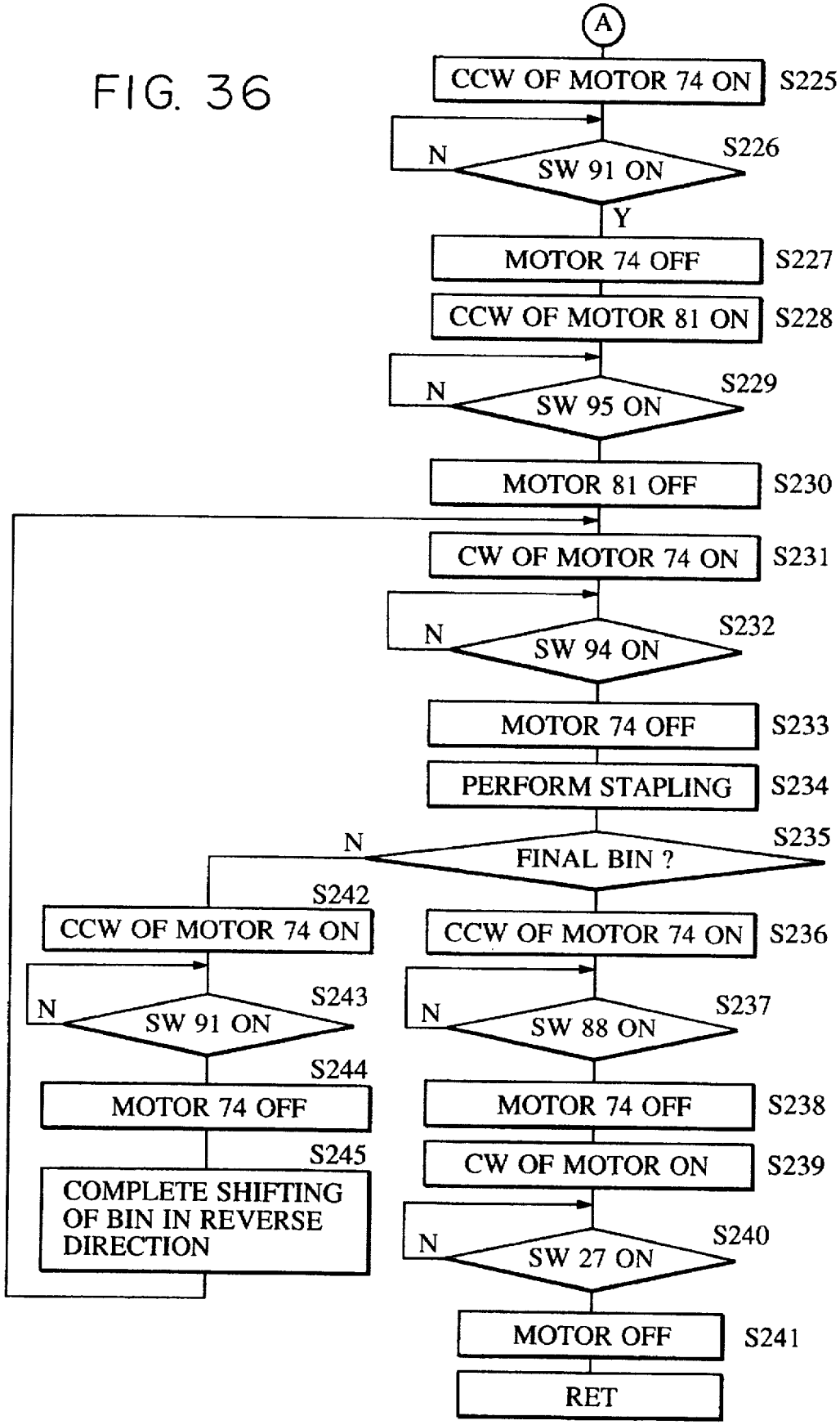
FIG. 36 is a flow chart showing the stapling operation to be performed in the sheet processing apparatus following the operation shown in FIGS. 34, 34A and 34B.
Figure 37:
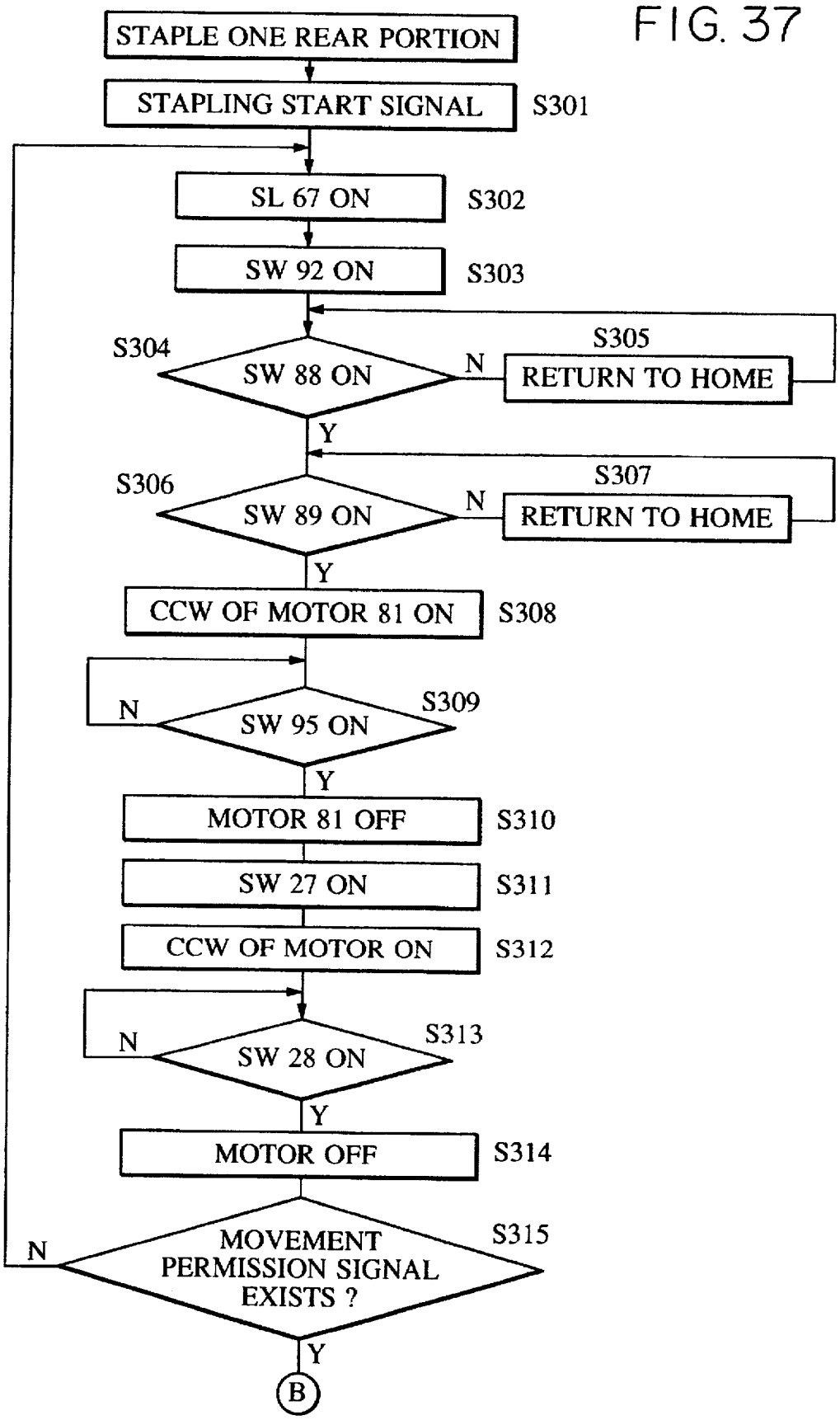
FIG. 37 is a flow chart showing the stapling operation to be performed in the sheet processing apparatus.

Referring to FIGS. 35 and 36, when a signal indicating the two-portion binding operation has been supplied from the control means (S201), the solenoid 67 is turned on (S202) so that the first support member 62 is, together with the stapler 56, rotated counterclockwise around the support shaft 61 so as to be located at the position indicated by the alternate long and two short dashed line shown in FIG. 31.

The completion of the rotation is detected by the detection means 92 (S203). Whether or not the second support member 63 and the third support member 69 are at the waiting positions is detected by the detection means 88 and 89 (S204 and S206). If they are not at their waiting positions, they are returned to the waiting positions (home positions) (S205 and S207).

At substantially the same time as the foregoing operation, the motor 81 is rotated counterclockwise (S208) so that the third support member 69 is moved from the position 69*a* to the position 69*b*, and the motor 81 is stopped (S210).

The position 69*b* of the third support member 69 is detected by the detection means 93 (S209).

The motor 81 may comprise, for example, a DC motor, and its rotation may be detected by the detection means 93. A stepping motor or the like may be employed so as to be stopped after the movement by a predetermined distance from the detection means 89 that detects the waiting position of the third support member 69. In the foregoing case, the detection means 93 also serves as a means for detecting the stop position.

At substantially the same time as the foregoing operation, the leading passage 26 in the state detected by the detection means 27 (S211) moved from the usable position 26*a* (the position indicated by a continuous line shown in FIG. 3) to the relief position 26*b* (alternate long and short dashed line shown in FIG. 3) when the drive motor (not shown) of the sheet conveyance system is rotated to rotate the eccentric cam 29*a* of the foregoing pushing mechanism.

If the leading passage 26 has reached the relief position 26*b*, as detected by the detection means 28 (S213), the drive motor (not shown) is stopped (S214), and the leading passage 26 is maintained at the relief position.

Figure 32:
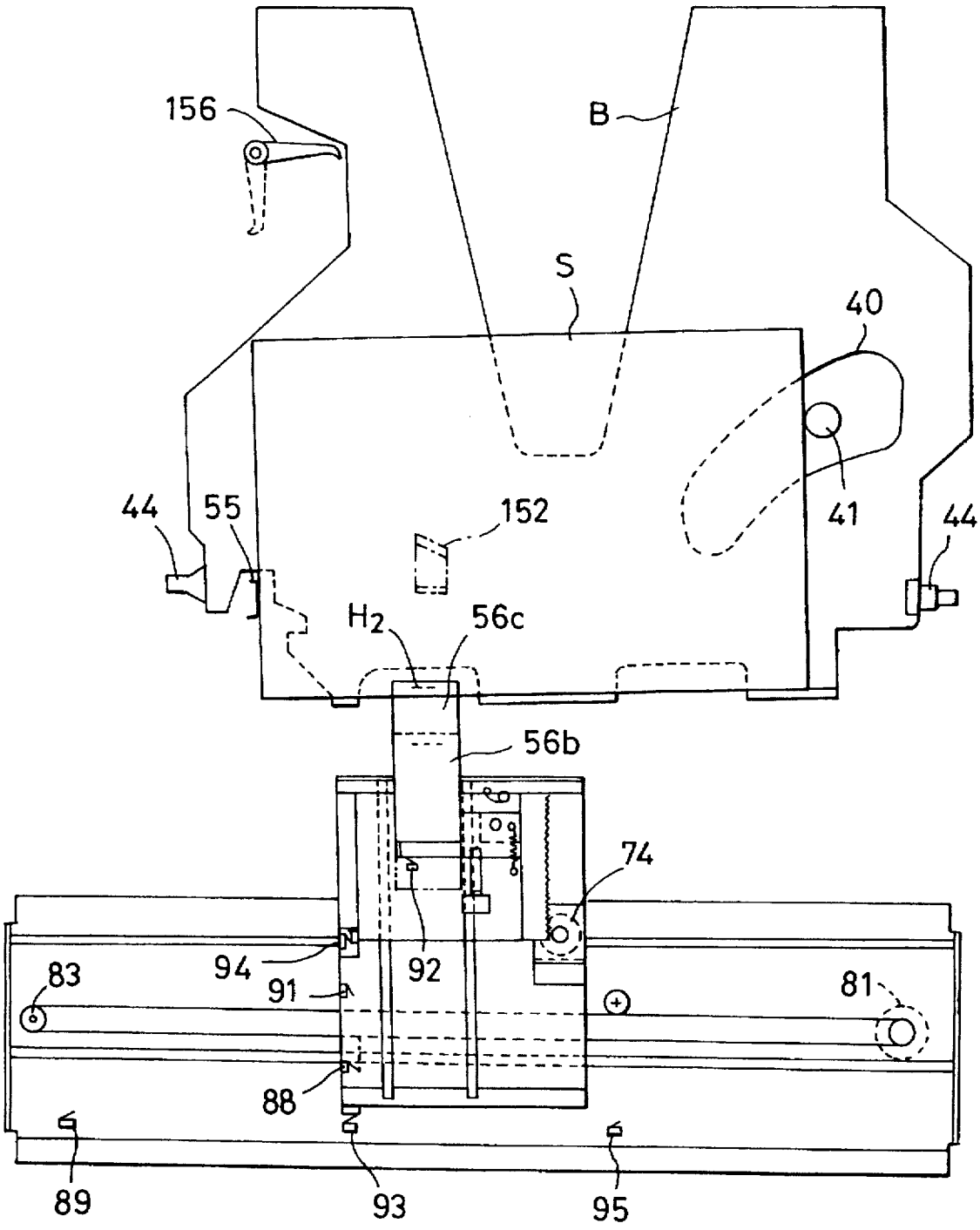
FIG. 32 is a plan view showing the stapler portion and the bin tray portion in a state when the stapling operation is performed in the sheet processing apparatus.

When the detection means 93, 92, 28 and 88 have supplied signals to the control means indicating that all elements have been moved to predetermined positions, the control means, in a manner similarly to the one-front-portion binding operation, transmits a signal that permits the movement to the stapling position of the second support member 63 (S215) so that the motor 74 is rotated clockwise (S216). Thus, the stapler 56 is moved from the intermediate waiting position 56*b* to the stapling position 56*c*. The detection means 94 performs the detection operation (S217), and then the motor 74 is stopped (S218). Then, staple H is injected at the stapling position $H_2$ for the sheet S (S219)(see FIGS. 31 and 32).

If the detection means 28 does not detect the leading passage 26, that is, if the leading passage 26 has not been moved to the relief position (alternate long and short dashed line shown in FIG. 3), the movement of the second support member 63 is inhibited.

In the foregoing operation, the relief position 26b for the leading passage 26 is determined to be a position at which interference can be prevented when the stapler 56 is moved to the stapling position 56c. Since the stapler 56 is operated in such a manner that its respective positions are confirmed by the detection means 28, 93, 92 and 88 (in particular, by the detection means 28), the interference between the stapler 56 and the bin B and the leading passage 26 can be prevented. The movement of the leading passage 26 and the movements of the first support member 62 and the third support member 69 are performed during a period in which the first support member 62 is detected by the detection means 88. Therefore, if the stapler 56 is at the waiting position 56a, any process may be performed previously or the processes may be performed simultaneously.

Thus, the stapling operation by the stapler 56 is completed.

In a case where one bin is processed (S220), the stapler 56 is moved to the intermediate waiting position 56b for the same reason as that for the foregoing process, the motor 74 is rotated counterclockwise (S225). After the detection means 91 has detected the stapler 56, the motor 74 is stopped (S227), followed by restoring the stapler 56.

Then, the motor 81 is rotated counterclockwise (S228), and the third support member 69 is moved to the position 69c. The position 69c of the third support member 69 is detected by the detection means 95 (S230) (see FIG. 33).

At the foregoing position, the second support member 63 is moved, and the motor 74 is rotated clockwise (S231) so that the stapler 56 is moved from the intermediate waiting position 56b to the stapling position 56c. After the detection means 94 has performed the detection (S232), the motor 74 is stopped (S233). One staple H is ejected at the binding position $H_3$ which is one of the two-portion binding positions (S234). Since binding in one bin is performed (S234), the motor 74 is rotated counterclockwise (S226) to move the stapler 56 from the stapling position 56c to the waiting position 56a. After the detection means 88 has performed the detection (S337), the motor 74 is stopped (S338). Thus, binding in one bin is completed.

When the detection means 88 has detected that the second support member 63 is at the waiting position, the drive motor (not shown) of the sheet conveyance system is rotated reversely (S239) so that the leading passage 26 is returned to the usable position 26a (the position indicated by the continuous line shown in FIG. 3). The returned leading passage 26 is detected by the detection means 27 (S240). Thus, the drive motor is stopped (S241).

The operation of binding to be performed in a plurality of bins B will now be described.

Initially, the third support member 69 is moved to the position 69b, and stapling of the stapling position $H_2$ in the final bin is performed (the stapler 56 is moved from the waiting position 56a to stapling position 56c).

In steps S201 to S220, the stapler 56 is moved from the stapling position 56c to the intermediate waiting position 56b by counterclockwise rotation of the motor 74 (S221). After the detection means 91 has performed the detection (S222), the motor 74 is stopped (S223).

When shifting of the bins has been completed similarly to the foregoing process (S224), the foregoing operation (intermediate waiting position 56b→stapling position 56c→intermediate waiting position 56b) is repeated so that stapling is performed. Thus, stapling at position $H_2$ of the sheets in the bins, the number of which is the desired number of copies, is completed.

At the position of the bin at which stapling at the stapling position $H_2$ is performed, the third support member 69 is moved to the position 69c (S220 to S230) similarly to the foregoing process.

At the foregoing position, the stapler 56 is moved from the intermediate waiting position 56b to the stapling position 56c so that stapling is performed (S231 to S232). Then, the motor 74 is rotated counterclockwise (S242) to move the stapler 56 to the intermediate waiting position 56b. After the detection means 91 has performed the detection (S243), the motor 74 is stopped (S244) to return the stapler 56.

Then, the bin is shifted in a direction opposing the direction, in which the bin has been shifted (S245), and a similar operation (intermediate waiting position 56b→stapling position 56c→intermediate waiting position 56b) is repeated with shifting the bin so that stapling is performed (S231 to S234).

After stapling at the position $H_3$ has been completed in the final bin (the bin in which the stapling at position $H_2$ has been first performed), the stapler 56 is returned to the waiting position 56a so that two portion stapling in all bins is completed (S236, S237 and S238).

The third support member 69 is moved from the position 69c to the position 69a at a predetermined timing. If the fact that the stapler 56 is at the waiting position 56a, that is, the fact that the second support member 63 is at the waiting position has been detected by the detection means 88, the leading passage 26 is returned to the usable position 26a (the position indicated by the continuous line shown in FIG. 30). The position 26a is detected by the detection means 27 (S239 to S241).

If the detection means 88 has not detected the second support member 63, movement of the leading passage 26 to the usable position 26a is inhibited.

Referring to FIG. 3, as a matter of course, the detection means 27 and the stapler 56 are disposed not to interfere with each other in the thrusting direction (a front portion of FIG. 3).

One-Inner-Portion Binding

Figure 33:
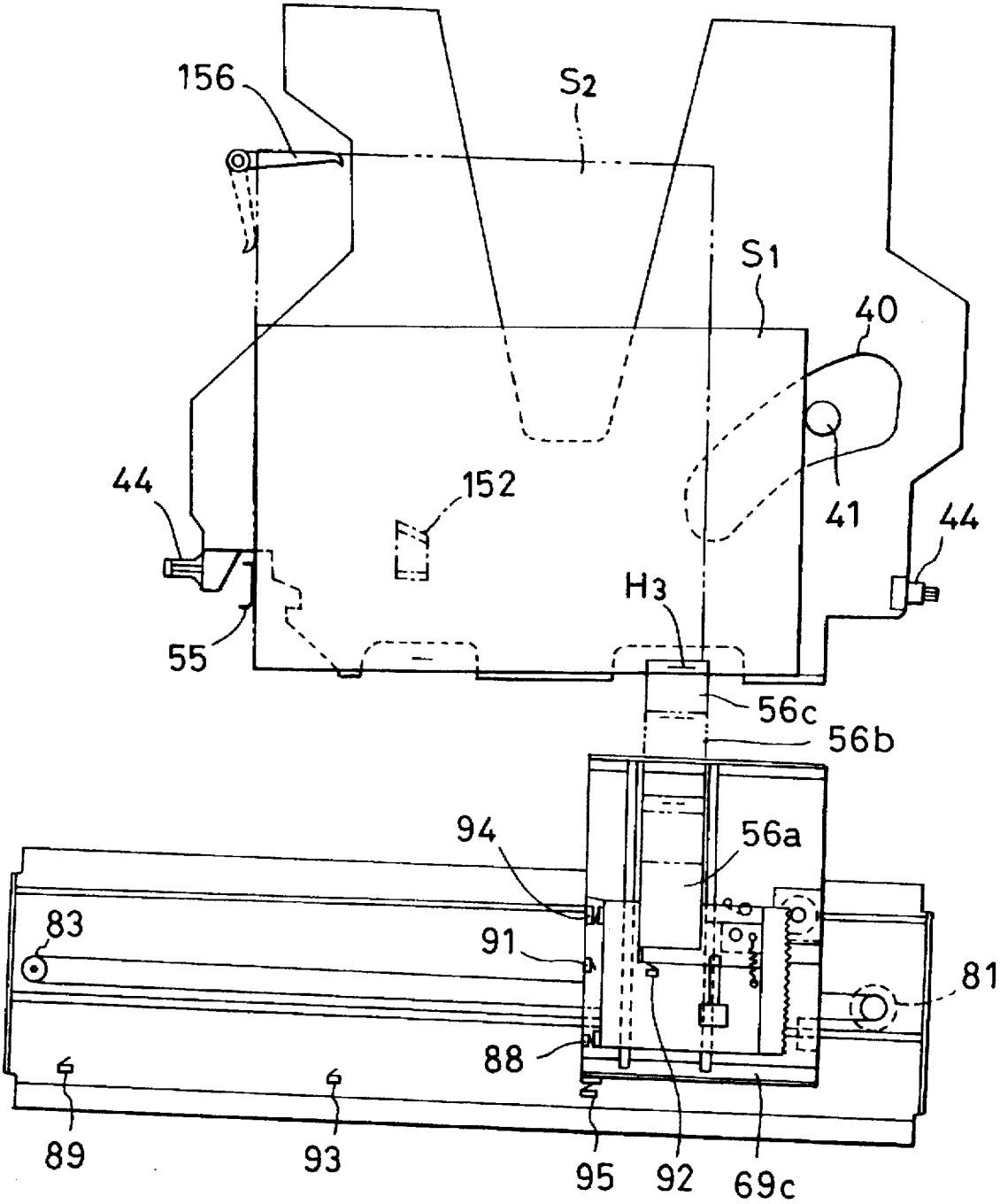
FIG. 33 is a plan view showing the stapler portion and the bin tray portion in a state when the stapling operation is performed in the sheet processing apparatus.
Figure 38:
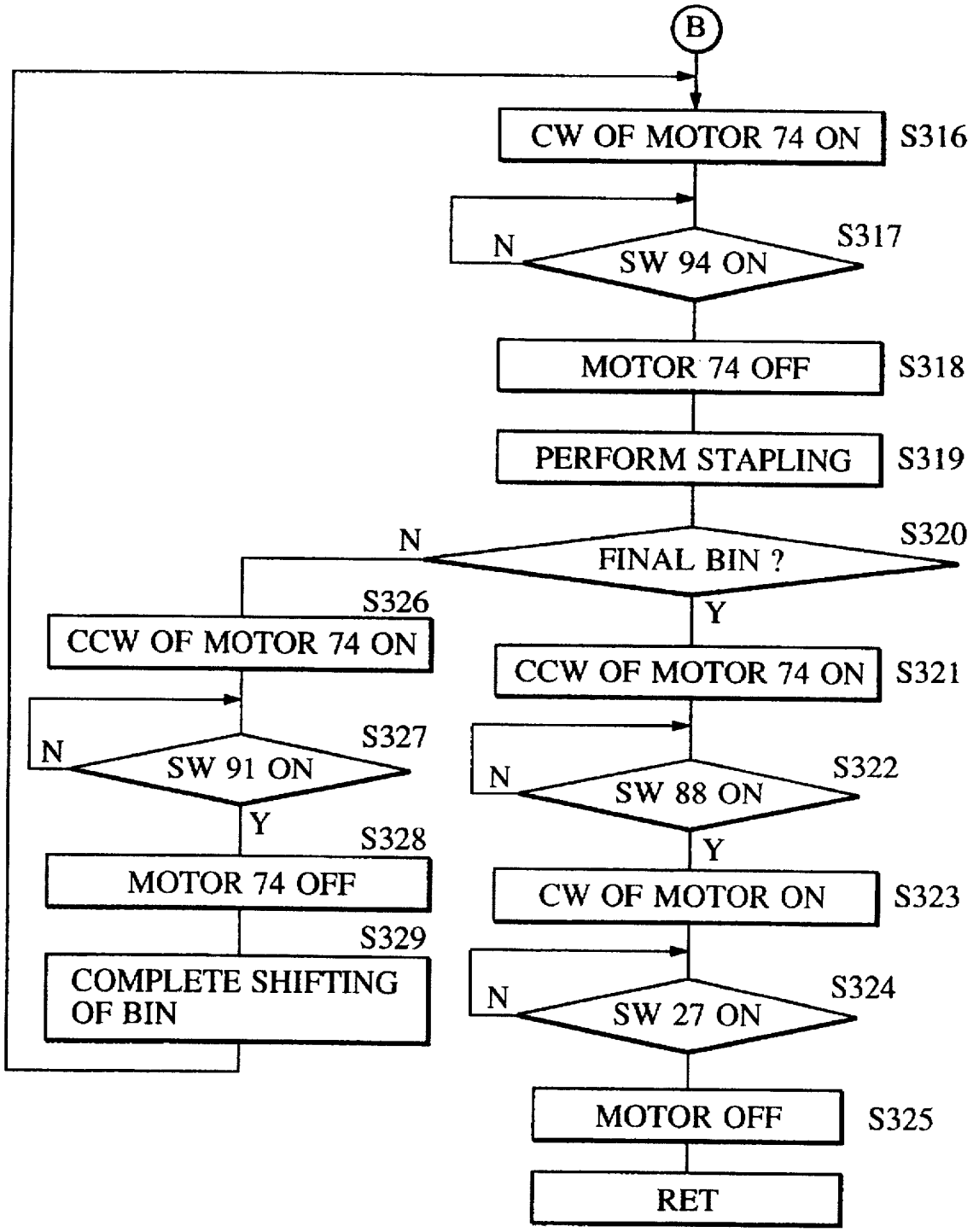
FIG. 38 is a flow chart showing the stapling operation to be performed in the sheet processing apparatus following the operation shown in FIG. 36.

Referring to the flow charts in FIGS. 31 and 38, if a signal representing the one-inner-portion binding operation (binding position $H_3$) at which sheet $S_2$ is stapled (as shown in FIG. 33) has been supplied from the control means (S301), the solenoid 67 is turned on similarly to the foregoing two-portion binding operation (S302). The stapler 56 is brought to a state shown in FIG. 33 (the foregoing position is detected by the detection means 92 (S303)).

Similarly, the initial position for each process is detected by the detection means 88 and 89 (S304 and S306). If the positions have not been detected, the stapler 56 is returned to the waiting position (S305 and S307), and the third support member 69 is moved to the position 69c by counterclockwise rotating the motor 81 (S308). The foregoing position is detected by the detection means 95 so that the motor 81 is stopped (S310).

Also the leading passage 26 is moved to the relief position 26b by rotating the drive motor (not shown) of the sheet conveyance system in a state where the detection means 27 has detected the same (S311), similarly to the two-portion binding operation. The detection means 28 detects the position 26b (S313), and the drive motor is stopped (S314).

The operation order of the leading passage 26 and the operations of the first, second and the third support members 62, 63 and 69 may be determined arbitrarily.

Similarly to the foregoing operation, when the detection means 95, 92, 88 and 28 have confirmed all operation positions, a signal permitting movement is transmitted (S315), and the second support member 63 is moved to the stapling position by rotating the motor 74 clockwise (S316). The stapler 56 is moved from the waiting position 56*a* to the stapling position 56*c*. When the detection means 94 has performed the detection (S317), the motor 74 is stopped (S318), stapling at the stapling position $H_3$ is performed (S319). In a case of a one-bin process (S320), the motor 74 is rotated counterclockwise (S321) to move it to the waiting position 56*a*. After the detection means 88 has performed the detection (S322), the motor 74 is stopped (S325), and thus the stapling operation is completed. If the detection means 28 has not detected it, that is, if the leading passage 26 has not been moved to the relief position 26*b*, movement of the second support member 63 to the sheet stapling position is inhibited.

If the detection means 88 has detected that the second support member 63 is at the waiting position, the drive motor (not shown) of the sheet conveyance system is rotated reversely (S323) so that the leading passage 26 is returned to the usable position 26*a* (the position indicated by the continuous line shown in FIG. 3). After the detection means 27 has performed the detection (S324), the drive motor is stopped (S325).

If the detection means 88 has not detected the second support member 63, the movement of the leading passage 26 to the usable position 26*a* is inhibited.

The stapling operations in a plurality of bins B will now be described.

Similarly to the foregoing process, the third support member 69 is moved to the position 69*c*, and the leading passage 26 is moved to the relief position 26*b*. Then, similarly to the one-front-portion binding operation, the stapler 56 is moved from the waiting position 56*a* to the stapling position 56*c* so that stapling at the stapling position $H_3$ is performed (S301 to S320). Then, the motor 73 is rotated counterclockwise (S326), followed by returning the stapler 56 to the intermediate waiting position 56*b* at which it can be detected by the detection means 91 (S327). Then, the motor 74 is stopped (S328).

After sheets in the first bin have been stapled at the position $H_3$, simultaneously with the completion of shifting of the bin (S329), the movement of the stapler 56 (intermediate waiting position 56*b*←→stapling position 56*c*) and the stapling operation are repeated. After stapling of a predetermined number of bundles has been completed (S316 to S320 and S326 to S329), the stapler 56 is returned to the waiting position 56*a* (S321 to S323).

Similarly to the foregoing process, when the detection means 88 has detected the stapler 56 at the waiting position 56*a*, the leading passage 26 is returned to the usable position 26*a* (the position indicated by the continuous line shown in FIG. 3) (if the detection means 88 has not detected it, the movement of the leading passage 26 is inhibited). Also the third support member 69 is returned to the position 69*a* (S324 and S325).

Thus, the stapling operation is performed in the case of the one-front-portion binding operation, the two-portion binding operation, and the one-inner-portion binding operation to staple one and a plurality of sheet bundles.

The stapling mode may be an afterward stapling operation in which a stapling start button (not shown) is used after sheets have been distributed and stacked on the bins due to the sorting operation; or a stapling operation in which stapling is automatically started after sorting has been completed.

The foregoing operation may, of course, be performed in a group mode (a mode in which the copies of the same original document are classified and stacked on one bin).

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A sheet processing apparatus comprising:

at least one sheet receiving tray for accommodating sheets;

sheet discharge means for discharging the sheets onto said at least one sheet receiving tray;

aligning means for pressing end surfaces of the sheets accommodated in said at least one sheet receiving tray to align the sheets;

processing means for processing the sheets accommodated in said at least one sheet receiving tray; and control means for controlling said aligning means and for changing a pressing force in the widthwise direction of the sheets exerted by said aligning means in accordance with a change in mode of a process performed by processing means.

2. A sheet processing apparatus according to claim 1, wherein the change in the processing mode is a change in a processing position.

3. A sheet processing apparatus according to claim 2, wherein the pressing force is reduced if the processing position is near a position at which the sheets are pressed by said aligning means.

4. A sheet processing apparatus according to claim 3, wherein the pressing force is substantially zero when the processing position is near a position at which the sheets are pressed by said aligning means.

5. A sheet processing apparatus according to claim 2, wherein said aligning means does not contact the sheets when the processing position is near the position at which the sheets are pressed by said aligning means.

6. A sheet processing apparatus according to claim 1, wherein said processing means comprises binding means, and a change in the processing mode is a change in the binding position.

7. A sheet processing apparatus according to claim 6, wherein a pressing force is reduced if the binding position is near a position at which the sheets are pressed by said aligning means.

8. A sheet processing apparatus according to claim 7, wherein the pressing force is substantially zero when the binding position is near the position at which the sheets are pressed by said aligning means.

9. A sheet processing apparatus according to claim 6, wherein said aligning means does not contact the sheets when the binding position is near the position at which the sheets are pressed by said aligning means.

10. A sheet processing apparatus according to claim 1, wherein said aligning means performs:

a first operation for aligning each sheet after the sheet is discharged to said at least one sheet receiving tray by said sheet discharge means; and a second operation for holding a sheet bundle when accommodation of the sheets is completed and the sheet bundle is processed, wherein when the second operation is performed, said control means changes the pressing force in accordance with a change in the processing mode, but when the first operation is performed, said control means does not change the pressing force even if the processing mode is changed.

11. A sheet processing apparatus according to claim 1, wherein said aligning means performs:

a first operation for aligning each sheet after the sheet is discharged to said at least one sheet receiving tray by said sheet discharge means; and a second operation for holding a sheet bundle when accommodation of the sheets is completed and the sheet bundle is processed, wherein when a processing position is apart from the position at which the sheets are pressed by said aligning means, said control means does not change the pressing force in each of the first and second operations, and when a processing position is near the position at which the sheets are pressed by said aligning means, said control means reduces the pressing force in the second operation, and does not change the pressing force in the first operation even if the processing mode is changed.

12. A sheet processing apparatus according to claim 1, wherein said aligning means is an aligning member that presses the sheets to a reference position for alignment to align the sheets, said processing means comprises binding means having a one-portion-binding mode, in which a sheet bundle is bound adjacent to the reference position for alignment, and a two-portion-binding mode, in which the sheet bundle is bound at two positions between said aligning means and the reference position for alignment, and said control means reduces the pressing force when binding is performed adjacent to the reference position for alignment in the two-portion-binding mode.

13. A sheet processing apparatus according to claim 1, wherein said aligning means is an aligning member that presses the sheets to a reference wall for alignment to align the sheets, said processing means comprises binding means having a one-portion-binding mode, in which a sheet bundle is bound adjacent to the reference wall for alignment, and another one-portion-binding mode, in which the sheet bundle is bound adjacent to said aligning means, and said control means reduces the pressing force when binding is performed adjacent to said aligning means.

14. A sheet processing apparatus according to claim 1, wherein the sheets discharged by said discharge means and to be pressed and processed by said aligning means and said processing means, respectively, are sheets having the same size.

15. A sheet processing apparatus comprising:

at least one sheet receiving tray for accommodating one or more sheets;

sheet discharge means for discharging the sheets onto said at least one sheet receiving tray forming a sheet bundle;

aligning means for pressing end surfaces of the sheets accommodated in said at least one sheet receiving tray to align the sheets;

processing means for processing the sheets accommodated in said at least one sheet receiving tray; and control means for changing a pressing force in the widthwise direction of the sheets exerted by said aligning means in accordance with a change in the number of sheet bundles accommodated on said at least one sheet receiving tray when said processing means performs processing.

16. A sheet processing apparatus according to claim 15, wherein the pressing force is reduced when the number of sheet bundles is small.

17. A sheet processing apparatus according to claim 16, wherein the pressing force is substantially zero when the number of the sheet bundles is small.

18. A sheet processing apparatus according to claim 15, wherein said aligning means does not contact the sheets when the number of the sheet bundles is small.

19. A sheet processing apparatus according to claim 15, wherein said processing means comprises binding means.

20. A sheet processing apparatus according to claim 15, wherein said aligning means performs:

a first operation for aligning each sheet after the sheet is discharged to said at least one sheet receiving tray by said sheet discharge means; and a second operation for holding a sheet bundle when accommodation of the sheets is completed and the sheet bundle is processed, wherein when the second operation is performed, said control means changes the pressing force in accordance with a change in the number of the sheet bundles, but when the first operation is performed, said control means does not change the pressing force even if the number of the sheet bundles is changed.

21. A sheet processing apparatus according to claim 15, wherein said aligning means performs:

a first operation for aligning each sheet after the sheet is discharged to said at least one sheet receiving tray by said sheet discharge means; and a second operation for holding a sheet bundle when accommodation of the sheets is completed and the sheet bundle is processed, wherein when a number of the sheet bundles is large, said control means does not change the pressing force in each of the first and second operations, and when the number of the sheet bundles is small, said control means reduces the pressing force in the second operation, but does not change the pressing force in the first operation even if the number of the sheet bundles is changed.

22. A sheet processing apparatus according to claim 15, wherein the sheets discharged by said discharge means and to be pressed and processed by said aligning means and said processing means, respectively, are sheets having the same size.

23. A sheet processing apparatus comprising:

at least one sheet receiving tray for accommodating one or more sheets;

sheet discharge means for discharging the sheets onto said at least one sheet receiving tray forming a sheet bundle;

aligning means for pressing end surfaces of the sheets accommodated in said sheet receiving tray to align the sheets;

processing means for processing the sheets accommodated in said at least one sheet receiving tray, wherein said aligning means has a first mode for aligning each sheet after the sheet is discharged and a second mode for aligning a sheet bundle when the sheet bundle is bound; and control means for controlling a pressing force in the widthwise direction of the sheets exerted by said aligning means, such that the pressing force in the second mode is less than the pressing force exerted in the first mode.

24. A sheet processing apparatus according to claim 23, wherein the pressing force exerted in the second mode is substantially zero.

25. A sheet processing apparatus according to claim 23, wherein said aligning means does not contact the sheets.

26. A sheet processing apparatus comprising:

at least one sheet receiving tray for accommodating one or more sheets;

sheet discharge means for discharging the sheets onto said at least one sheet receiving tray, forming a sheet bundle;

aligning means for pressing end surfaces of the sheets accommodated in said at least one sheet receiving tray to align the sheets;

processing means for processing the sheets accommodated in said at least one sheet receiving tray; and control means for determining a position at which processing is performed by said processing means in relation to a position at which alignment is performed by said aligning means and for controlling said aligning means in accordance with the determination, such that (i) when the position at which processing is performed by said processing means is distant from a position at which alignment is performed by said aligning means, said control means causes said aligning means to press the end surfaces of the sheets to align the sheets when said processing means performs processing, and (ii) when the position at which processing is performed by said processing means is near the position at which alignment is performed by said aligning means, said control means causes said aligning means to be located apart from the end surfaces of the sheets when said processing means performs processing.

27. A sheet processing apparatus according to claim 26, wherein said processing means comprises binding means, the sheets are pressed against a reference wall by said aligning means, and the distant position is near the reference wall.

28. A sheet processing apparatus comprising:

at least one sheet receiving tray for accommodating one or more sheets;

sheet discharge means for discharging the sheets onto said at least one sheet receiving tray forming a sheet bundle;

aligning means for pressing end surfaces of the sheets accommodated in said at least one sheet receiving tray to align the sheets;

processing means for processing the sheets accommodated in said at least one sheet receiving tray; and control means for determining a number of sheet bundles and for controlling said aligning means in accordance with the determination, such that (i) when the number of sheet bundles is large, said control means causes said aligning means to press the end surfaces of the sheets to align the sheets when said processing means performs processing, and (ii) when the number of sheet bundles is small, said control means causes said aligning means to be located apart from the end surfaces of the sheets when said processing means performs processing.

29. A sheet processing apparatus according to claim 28, wherein said processing means comprises binding means, and the sheets are pressed against a reference wall by said aligning means.

30. A sheet processing apparatus comprising:

at least one sheet receiving tray for accommodating sheets;

sheet discharge means for discharging the sheets onto each of said at least one sheet receiving tray forming a sheet bundle;

aligning means for pressing end surfaces of the sheets accommodated in said at least one sheet receiving tray to align the sheets;

processing means for processing the sheets accommodated in said sheet receiving tray, wherein said aligning means operates in a first mode when the sheet is discharged and operates in a second mode when the sheet bundle is processed; and control means for determining whether said aligning means is operating in the first mode or the second mode and controlling said aligning means in accordance with the determination, such that (i) said control means causes said aligning means to press the end surfaces of the sheets when said aligning means is in the first mode; and (ii) said control means causes said aligning means to be located apart from the end surfaces of the sheets when said aligning means is in the second mode.

31. A sheet processing apparatus according to claim 30, wherein said processing means comprises binding means, and the sheets are pressed against a reference wall by said aligning means.

32. An image forming apparatus having a sheet processing apparatus, said image forming apparatus comprising:

image forming means;

at least one sheet receiving tray for accommodating sheets on which images have been formed;

sheet discharge means for discharging the sheets onto said at least one sheet receiving tray;

aligning means for pressing end surfaces of the sheets accommodated in each of said at least one sheet receiving tray to align the sheets;

processing means for processing the sheets accommodated in each of said at least one sheet receiving tray; and control means for changing the pressing forces in the widthwise direction of the sheets by said aligning means in accordance with a change in mode of said processing means when said processing means performs processing.

33. An image forming apparatus having a sheet processing apparatus, said image forming apparatus comprising:

image forming means;

at least one sheet receiving tray for accommodating sheets on which images have been formed;

sheet discharge means for discharging the sheets onto said at least one sheet receiving tray;

aligning means for pressing end surfaces of the sheets accommodated in said at least one sheet receiving tray to align the sheets;

processing means for processing the sheets accommodated in said at least one sheet receiving tray; and control means for controlling the pressing force in the widthwise direction of the sheets by said aligning means in accordance with a change in a number of sheet bundles when said processing means performs processing.

34. An image forming apparatus having a sheet processing apparatus, said image forming apparatus comprising:

image forming means;

at least one sheet receiving tray for accommodating sheets on which images have been formed;

sheet discharge means for discharging the sheets onto said at least one sheet receiving tray forming sheet bundles;

aligning means for pressing end surfaces of the sheets accommodated in said at least one sheet receiving tray to align the sheets;

processing means for processing the sheets accommodated in said sheet receiving tray, wherein said aligning means operates in a first mode when the sheet is discharged and operates in a second mode when the sheet bundle is processed; and control means for determining whether said aligning means is operating in the first mode or the second mode and for controlling said aligning means in accordance with the determination, such that the pressing force in the widthwise direction of the sheets by said aligning means in the second mode is less than pressing force in the first mode.

35. An image forming apparatus having a sheet processing apparatus, said image forming apparatus comprising:

image forming means;

at least one sheet receiving tray for accommodating sheets on which images have been formed;

sheet discharge means for discharging the sheets onto said at least one sheet receiving tray;

aligning means for pressing end surfaces of the sheets accommodated in said at least one sheet receiving tray to align the sheets;

processing means for processing the sheets accommodated in said at least one sheet receiving tray; and control means for determining a position at which processing is performed and for controlling said aligning means in accordance with the determination, such that (i) when the position at which processing is performed by said processing means is distant from a position at which alignment is performed by said aligning means, said control means causes said aligning means to press the end surfaces of the sheets to align the sheets when said processing means performs processing, and (ii) when the position at which processing is performed by said processing means is near the position at which alignment is performed by said aligning means, said control means causes said aligning means to be located apart from the end surfaces of the sheets when said processing means performs processing.

36. An image forming apparatus having a sheet processing apparatus, said image forming apparatus comprising:

image forming means;

at least one sheet receiving tray for accommodating sheets on which images have been formed;

sheet discharge means for discharging the sheets onto said at least one sheet receiving tray forming sheet bundles;

aligning means for pressing end surfaces of the sheets accommodated in said at least one sheet receiving tray to align the sheets;

processing means for processing the sheets accommodated in said at least one sheet receiving tray; and control means for determining a number of sheet bundles and for controlling said aligning means in accordance with the determination, such that (i) when the number of sheet bundles is large, said control means causes said aligning means to press the end surfaces of the sheets to align the sheets when said processing means performs processing, and (ii) when the number of sheet bundles is small, said control means causes said aligning means to be located apart from the end surfaces of the sheets when said processing means performs processing.

37. An image forming apparatus having a sheet processing apparatus, said image forming apparatus comprising:

image forming means;

at least one sheet receiving tray for accommodating sheets on which images have been formed;

sheet discharge means for discharging the sheets onto said at least one sheet receiving tray;

aligning means for pressing end surfaces of the sheets accommodated in said at least one sheet receiving tray to align the sheets;

processing means for processing the sheets accommodated in said sheet receiving tray, wherein said aligning means operates in a first mode when the sheet is discharged and operates in a second mode when the sheet bundle is processed; and control means for determining whether said aligning means is operating in the first mode or the second mode and for controlling said aligning means in accordance with the determination, such that (i) said control means causes said aligning means to press the end surfaces of the sheets to align the sheets when said aligning means is in the first mode when said processing means performs processing, and (ii) said control means causes said aligning means to be located apart from the end surfaces of the sheets when said aligning means is in the second mode when said processing means performs processing.

38. A sheet processing apparatus according to claim 6, wherein said binding means comprises stapler means.

39. A sheet processing apparatus according to claim 19, wherein said binding means comprises stapler means.

40. A sheet processing apparatus according to claim 27, wherein said binding means comprises stapler means.

* * * * *

UNITED STATES PATENT AND TRADEMARK OFFICE

CERTIFICATE OF CORRECTION

PATENT NO. : 5,700,002

DATED : December 23, 1997

INVENTOR(S) : Katsuhito KATO, et al.

It is certified that error appears in the above-indentified patent and that said Letters Patent is hereby corrected as shown below:

Column 2, line 60, delete "bundles" and insert therefor
--bundle--.

Column 4, line 37, delete "form" and insert therefor --from--.

Column 10, line 35, after "(a)", insert --)--.

Column 15, line 27, delete "positions" and insert therefor
--position--.

Column 16, line 28, after "made", insert --to--.

Column 19, line 41, delete "discharge" and insert therefor
--discharged--;
Line 42, delete "the damage of" and insert therefor
--damaging--
Line 51, delete "bundle" and insert therefor
--bundles--;
Line 57, delete "remaining" and insert therefor
--remain--.

Column 22, line 53, after "smaller", insert --than--.

UNITED STATES PATENT AND TRADEMARK OFFICE

CERTIFICATE OF CORRECTION

PATENT NO. : 5,700,002
DATED : December 23, 1997
INVENTOR(S) : Katsuhito KATO, et al.

It is certified that error appears in the above-indentified patent and that said Letters Patent is hereby corrected as shown below:

Column 24, line 21, delete "remains" and insert therefor --remain--;
Line 24, after "Mode", insert --)--;
Line 52, after "smaller", insert --than--.

Column 27, line 14, delete "an" and insert therefor --a--;
Line 36, delete the comma (",") after "intervals".

Column 28, line 23, delete ", that is,";
Line 39, delete "is", first occurrence, and insert therefor --a--;
Line 44, delete the comma (",") after "considerably";
Line 54, delete "outwards pushes" and insert therefor --pushes outwards--;
Line 56, delete "holds" and insert therefor --holding--.

Column 30, line 32, delete "Hole" and insert therefor --Holes--.

Column 31, line 55, after "toward", insert --the--;
Line 58, delete "becomes" and insert therefor --become--.

Column 34, line 45, delete "move" and insert therefor --moves--.

UNITED STATES PATENT AND TRADEMARK OFFICE

CERTIFICATE OF CORRECTION

PATENT NO. : 5,700,002 
DATED : December 23, 1997
INVENTOR(S) : Katsuhito KATO, et al.

It is certified that error appears in the above-indentified patent and that said Letters Patent is hereby corrected as shown below:

Column 35, line 18, delete "sides" and insert therefor --side--;
Line 41, after "made", insert --to--.

Column 37, line 30, after "that", insert --the--;
Line 33, delete "sapling" and insert therefor --stapling--;
Line 41, after "reached,", insert --the--.

Column 47, line 16, after "than", insert therefor --a--.

Signed and Sealed this

Seventeenth Day of November, 1998

*Attest:*

*Attesting Officer*

BRUCE LEHMAN

*Commissioner of Patents and Trademarks*